US012655997B2

(12) United States Patent
Gross

(10) Patent No.: US 12,655,997 B2
(45) Date of Patent: Jun. 16, 2026

(54) CUSTOMIZABLE MODULAR HYDRONIC SYSTEM

(71) Applicant: Aris Hydronics Inc, Milwaukie, OR (US)

(72) Inventor: Benjamin Robert Gross, Milwaukie, OR (US)

(73) Assignee: ARIS HYDRONICS INC, Milwaukie, OR (US)

( * ) Notice: Subject to any disclaimer, the term of this patent is extended or adjusted under 35 U.S.C. 154(b) by 663 days.

(21) Appl. No.: 18/066,995

(22) Filed: Dec. 15, 2022

(65) Prior Publication Data

US 2024/0200795 A1 Jun. 20, 2024

(51) Int. Cl.
*F24F 1/0314* (2019.01)
*E04B 2/56* (2006.01)

(52) U.S. Cl.
CPC ..... *F24F 1/0314* (2019.02); *E04B 2/56* (2013.01)

(58) Field of Classification Search
CPC .. F24F 1/03; F24F 1/031; F24F 1/0314; F24F 1/0057; E04B 2/56
See application file for complete search history.

(56) References Cited

U.S. PATENT DOCUMENTS 3,722,580 A * 3/1973 Braver ..... F24F 1/005 62/263
4,169,500 A * 10/1979 Braver ..... F24F 1/0057 165/76
8,126,595 B2 2/2012 Milder et al.
9,239,193 B2 1/2016 Kadle et al.
9,592,717 B2 3/2017 Katch
10,345,002 B2 7/2019 Thomas
10,458,727 B2 10/2019 Gregory
11,187,418 B1 * 11/2021 DeLoach ..... F24F 13/22
2004/0026525 A1 2/2004 Fiedrich
2004/0094289 A1 5/2004 Harshberger et al.
(Continued)

FOREIGN PATENT DOCUMENTS

AU 2020100925 A4 7/2020
CZ 710 U1 9/1993
(Continued)

*Primary Examiner* — Steven S Anderson, II
(74) *Attorney, Agent, or Firm* — Howard Russell; Cera Oh

(57) ABSTRACT

Interior space customizable, re-customizable, modular, hydronic system, comprising: one or more modular base heating and/or cooling units, each adapted for residing between studs of the room's wall and selectively comprising one of a frame adapted to be completely recessed between studs, partially (e.g., approximately ½-way) recessed between the studs, and not recessed at all but still substantially located between the studs, each modular base unit adapted for successive repeated linear implementation with other modular base units of like composition to meet greater or lesser heating and/or cooling needs of the interior space; and one or more contiguous face cover members, and optional edge members, adapted to be secured to corresponding modular base unit(s), wherein the face cover members and optional edge cover members each comprise peripheral edges adapted to achieve, singularly or in combination, an aesthetically coherent face, and optional aesthetically coherent edge cover members, for the system.

16 Claims, 51 Drawing Sheets

(56) References Cited

U.S. PATENT DOCUMENTS

| | | | |
|---|---|---|---|
| 2006/0107618 | A1 | 5/2006 | Hydock |
| 2007/0187521 | A1 | 8/2007 | Wawak |
| 2011/0030932 | A1 | 2/2011 | Tucker et al. |
| 2011/0201265 | A1 | 8/2011 | Messinger et al. |
| 2014/0059961 | A1 | 3/2014 | Yin et al. |
| 2021/0108825 | A1 | 4/2021 | Roj et al. |
| 2022/0146147 | A1 | 5/2022 | White |

FOREIGN PATENT DOCUMENTS

| | | | |
|---|---|---|---|
| EP | 3124879 | A1 | 6/2020 |
| RU | 2369807 | C1 | 10/2009 |
| WO | 20080086981 | A1 | 8/2005 |
| WO | 108700310 | B | 3/2021 |
| WO | 2021162883 | A1 | 8/2021 |

* cited by examiner

CUSTOMIZABLE MODULAR HYDRONIC SYSTEM

CONTINUITY AND CLAIM OF PRIORITY

This is an original U.S. nonprovisional patent application.

FIELD

The invention relates to modular hydronic systems, whether for heating and cooling, for heating or cooling systems alone, and whether comprising radiator or fan-coil-type systems, and more particularly the invention relates to such a hydronic room conditioning system that is not only able to be readily customizable at the time of install in terms of size to meet an area's, such as a micro-zone's, heating and cooling needs, using from one to a plurality of modularly-sized base units, but which is also readily customizable at the time of install, in terms of aesthetic characteristics (color, patterns, and trim material) of the system to accommodate the area's initial interior design, as well as to be readily re-customizable at a later date after initial install, both in terms of aesthetics and heating and cooling needs to accommodate changed interior design or heating and cooling needs of the area (for example as might be encountered in the case of a re-model of a room).

BACKGROUND

Hydronic systems are known in the art, whether radiator type or fan-coil-type systems, such as heating and cooling systems, or heating or cooling systems alone, for interior spaces. With such hydronic systems, an interior portion of the system within a defined space is connected to a heat pump, buffer tank, pump, or a boiler, most often located exterior of the defined space. Hydronic systems work by circulating heated (or cooled) hydronic fluid, such as water or water mixed with an antifreeze (e.g., propylene glycol) additive, throughout the system via a sealed pipe network, wherein thermal energy is transferred into or removed from a space by both convection and conduction via air passing through a heat exchanger within a radiator or fan coil/fan convector housing unit. Further, there are commonly available and known such systems employing fans to enhance the efficiency of the system in dispersing heated or cooled air throughout the space.

One known wall mount hydronic room conditioning product, released by Purmo Group (UK) LTD, known as Myson headquarters, allows a installer to attach a single outer casing with top, front, and side coverage, which came packaged with a single heater/cooler unit (chassis), over the single heater/cooler unit (chassis) after it has been installed.

Another known wall mount hydronic room conditioning product, provided by Galleti SpA, allows for a customer to choose from a variety of colors for a single fan coil unit, including allowing for the customization of aesthetic characteristics (color & pattern) of the individual units at the time of ordering and purchase.

This and other commonly-available hydronic room conditioning products, however, have not allowed for easy, full (front, top, bottom, and sides) customization of the aesthetic characteristics of their hydronic room conditioning products at the time of or after the time of install, nor have they provided for the customization of max btu output of their hydronic room conditioning products at the time of or after the time of install. Further previously-known hydronic space conditioning systems have not been known for providing a plurality of components that form a truly modular system adaptable to design (both from a max micro-zone heating and/or cooling standpoint and from an aesthetics and interior design standpoint) to meet the various individualized customer demands in the marketplace for flexibility of output and design.

In other words, currently available hydronic room conditioning products have not been flexible in terms of enabling the increase of the maximum hourly thermal transfer while further facilitating response to other interior design and aesthetic conditions or changes. Thus, for example, when initially installing a hydronic system, with current room conditioning product designs one has had to plan very far in advance, needing to design to a theoretical maximum number of Btu's paired with budgetary considerations—when perhaps the realworld maximum has been unknown, or unknowable, prior to installation and use. In other words, current systems have not been made available which have allowed for an easy increase of the maximum Btu capacity of the micro-zone conditioning should a space have been enlarged or otherwise remodeled or re-designed, or if new owners have taken over and have wanted more capacity, all without the need to have essentially started from scratch with a new individual room conditioning product. This is because prior art systems have not been truly modular and fully customizable.

Thus, it would be desirable if there were available a readily customizable modular hydronic heating and/or cooling space conditioning system with components adapted to be selected from a plurality of different component supplies provided with a view to initial customizability or re-customizability, both in terms of capacity and interior design, so that persons wouldn't have to struggle so hard at the time of initial installation to try to anticipate all of the possible future changed (increased or decreased) needs of the system, and further so that they can easily tailor their system to initially determined needs, as well as easily install a system readily adapted for a pleasing and readily customizable aesthetic, such as for a unitary coherent looking design with components that are able to be selected from any of a plurality of component supplies (e.g., a number of different bins of modular edge, corner, and face member, components having matching colors and patterns), all without having to worry about not being able to readily modify the system should interior space needs or interior designs change in the future.

Further, this lacking in the prior art has introduced unnecessary inflexibility into the design and installation process. Whereas before a hydronic system installer essentially has been more necessary throughout the entire process of installation and completion of such, it would be desirable if the hydronic system installer were enabled in installing the base units of the system, while allowing for the possibility for a designer to come in separately later to create an appealing and desirable aesthetic for the resulting base unit, or base units, of the system and based on the designer's knowledge of a plurality of different modular component supplies. In other words, it would be as if such a system were "cognizant" of the fact that changes to systems, both in terms of capacity changes and interior design-type changes, would be needed. Whereas such flexibility, modularity, and customizability (e.g. the anticipation of such needs in a coherent overall system design) are not currently readily available given the state of the prior art.

SUMMARY

In accordance with an aspect and embodiment of the disclosure, there is provided a customizable, modular, hydronic system, such as hydronic radiators and fan coils, any of which may be adapted for use in an interior area, such as a house, micro-zone or a room, together with other connected hydronic components such as a reversible heat pump, a buffer tank, a pump, an air handler, or a boiler. The system of this aspect of the disclosure comprises a first modular base unit comprising at least one heat exchanger within a modular base unit frame optionally adapted for residing between studs of the room's wall and selectively comprising one of a frame adapted to be completely recessed in the wall between the studs, partially recessed in the wall between the studs, and not recessed, as in the case of a wall-mounted system.

The modular base unit is adapted for retaining heated, or alternatively cooled, hydronic fluid in the at least one heat exchanger adapted for being circulated throughout the first modular base unit by the other connected hydronic components. Also, the first modular base unit is adapted for successive repeated linear implementation with an at least optional second modular base unit of like composition to the first base unit, the system thus being readily adaptable to expansion to meet increased heating and cooling needs of the room depending upon its size and other characteristics.

The system of this first aspect and embodiment of the disclosure also comprises a first modular face cover member adapted to be secured to the first modular base unit, wherein the first face cover member comprises a peripheral edge and is optionally adapted for use with an at least optional second modular face cover member in case the at least an optional second modular base unit is included, or called for, depending upon the particular heating and cooling needs of the interior space.

Further, each at least optional second modular face cover member also comprises a peripheral edge, wherein each of the peripheral edges is adapted to be readily customized to achieve, singularly or in combination with others of the peripheral edges, an aesthetically coherently designed cover member for the hydronic system. Thus, the face cover members may be added after initial installation with the assistance of an interior designer, and the first face cover member and the at least second optional face cover member are also further adapted to be readily re-customized to achieve an alternative aesthetically coherent design, for example if the design of the room were to change, if the room were to be remodeled, or even if the owners of the room simply changed, or changed their minds. This greatly lends to the ease of interior design, or change of such, since the designer is no longer dependent upon having to remove, replace, or reinstall the hydronic system in order to simply change the exterior design treatments of the system to the degree one would have had to do so before.

Preferably, in accordance with this aspect and embodiment of the disclosure, the first modular face cover member of the system, and the at least optional second modular face cover member, are contiguous—meaning that even independent of color and ornamental surface design considerations, the face members are designed to look like a single face cover member. In fact, in accordance with an aspect and embodiment of the disclosure, users are enabled in choosing from single face covers that cover two or more base members.

Further, in accordance with aspect and embodiment of the disclosure, preferably each face cover member further comprises at least one vent in an anterior surface the face cover member (and the at least optional second contiguous modular face cover member). Still further, the system in accordance with this aspect of the disclosure preferably comprises at least one fan adapted for blowing air across the at least one heat exchanger of the at least one modular base unit and the at least optional second modular base unit, to carry adjacent heated, or alternatively cooled, air from the at least one heat exchanger through the at least one vent and into the interior room/space.

Further, preferably, in the case of partially recessed and non-recessed systems of the disclosure, there are provided a plurality of contiguous modular edge members and a plurality of modular corner edge members adapted for being interconnected around and relatively to one or more of the peripheries of the first modular face cover member and each the at least optional second modular face cover member. These modular edge members are contiguous in the sense that they align (as do the contiguous face cover members) so as to almost appear as though they are a singular, or integral, unit, when in fact they are actually comprised of a plurality of modular edge units. Thus, preferably in connection with this aspect and embodiment of the disclosure, the plurality of modular edge members and each of the plurality of modular corner edge members form, singularly or in combination with others of the first face cover member, the optional second modular face cover member—i.e., wherein the modular edge members, the corner members, and the face cover members all work together to form a seemingly integral face cover member.

Such plurality of modular edge members, and the plurality of modular corner edge members, thus form an aesthetically coherent design cover member, irrespective of colors and ornamental designs, for the hydronic system. Still further, the first modular face cover member and the at least optional second contiguous modular face cover member are adapted to be re-customized to achieve one or more alternative other aesthetically coherent designs, irrespective of colors and patterns, for the hydronic system, should the needs of the room change, should the room be remodeled, should new owners with new preferences come along, or simply should the owners change their minds.

In accordance with this aspect and embodiment of the disclosure, the plurality of modular edge members and the plurality of modular corner edge members, of the system, are adapted for being interconnected around and relative to one or more of the peripheries of the first modular face cover member and each the at least optional second contiguous modular face cover member to form, singularly or in combination with others of the first face cover member, the optional second contiguous modular face cover member, the plurality of modular edge members, and the plurality of modular corner edge members, any of a number of different color and/or pattern choices from a plurality of component supplies. Thus, the modular edge members and the modular corner edge members may be provided in varying color schemes and exterior pattern designs to give interior designers plenty of options when incorporating the hydronic unit into the existing or changed interior designs of the room. Thus, unlike prior art systems, there is made available the ability to design systems using a plurality of different component supplies (i.e., silver edge members, red edge members, and/or floral pattern face cover members—thus the numbers of possible color combinations for components is great).

In accordance with another aspect and embodiment of the disclosure, not only are the cover members selectable from stores of like modular component supplies, but further any base unit may be adapted to be selected from a plurality of base unit component supplies provided in view of initial and changing interior-design-type and system capacity type considerations.

Thus, not only are base units modular in terms of their ability to be designed for various Btu needs of a space, but the resulting system's face cover member (or members adapted from a plurality of continuous members), and corresponding edge and corner members, in the case of partially and non-recessed systems, are adapted to be selected from a plurality of face cover member component supplies provided in view of initial and changing interior-design-type considerations.

In accordance with another aspect and embodiment of the disclosure, there is provided a system wherein the first modular base unit and the at least optional second base unit of the modular hydronic heating and cooling system are adapted to be fully-recessed between studs of the wall of the room. In such embodiment the first face cover member for the first modular base unit and the at least optional second face cover member for the at least optional second modular base unit each further comprise at least one normally-oriented tab extending from an inside surface of the first face cover unit and the at least optional second contiguous face cover member. The tab is provided for plugging a corresponding vent in the frame member of the at least one base unit and the at least optional second modular base unit, and this is useful for re-routing air flow from one vent of each base unit to another vent in each face cover member. This aspect of the disclosure allows usage of the same base unit for both wall-mount, partially-recessed (e.g., approximately ½ way recessed in the wall), and fully-recessed systems, they base units differing from one another only insofar as their respective mounting tabs are located at different locations (forward and aft) on their side frames. This aspect of the disclosure teaches to further facilitate customer choice in customizability of design and further helps the cause of modularity since a single type of base unit may be used, each type of base unit differing from the others only by the location of their mounting tabs on the base unit side frames.

In accordance with this aspect and embodiment of the disclosure, there is also provided with fan coil unit types of hydronic systems wherein the first modular base unit and the at least optional second base unit of the modular hydronic heating and cooling system are adapted to be partially-recessed and/or non-recessed (i.e., mounted on the surface of a wall), wherein each of the face cover members, whether a singular face cover member for multiple base units or multiple face cover members for multiple base units comprise each an upper baffle, or a duct, and a lower baffle, or duct, each either integral with each modular face cover unit, or able to be fastened to each modular face cover unit (for example with tabs and screws), to ensure that air flow from the units is properly routed either into or out of each unit into the room (in the case of an upper, lower, or single unit), or into or out of the next adjacent unit (in the case of middle unit portions of a system comprising a plurality of vertically oriented units).

In accordance with another embodiment of an aspect of the disclosure, there is provided a system wherein the first modular base unit and the at least optional second modular base unit of like composition to the first modular base unit is adapted for being recessed substantially midway into the wall of the given interior space. Thus, in accordance with an embodiment of the disclosure, there is provided a hydronic system, wherein the first modular base unit and the at least optional second base unit of the modular hydronic heating and cooling system are adapted to be partially-recessed between the studs, wherein the first face cover member for the first modular base unit and the at least optional second face cover member for the at least optional second modular base unit appear contiguous one with the other. The fact that the face cover member for such a system appears to be contiguous comprises that peripheral edges of face cover members comprising the overall cover member are designed to be selectable from component supplies wherein, for example, internal edges may be squared off (and not rounded) such that from a small distance the two face cover members appear to be a coherent singular-appearing face cover member. Or in the case of, for example 3 or four linearly-aligned base unit members provided to supply heating/cooling to a larger room, the intermediate base unit face covers may be square off on both ends thereof—again being selectable from a modular component supply—to give the appearance that all three (or four) units are comprised of a single face cover member. Or alternatively, there may be provided component supplies of singular such face cover members to cover three (or four) base unit members.

The systems of any of the foregoing aspects and embodiments may be provided wherein the cover member is designed to have a substantially singular appearing face cover member, or even a single unitary face cover member. In other words, the face cover member may be comprised of a plurality of modular contiguous face cover members adapted to be aligned so as to appear to be a substantially singular face cover member, or literally there may be provided larger face cover members adapted for covering multiple, linearly-aligned, base units. And further, regardless of the number of linearly-aligned (horizontally or vertically-aligned) base unit members and corresponding face cover members, there may be provided a plurality of component supplies from which to select a minimal number of designs to construct singularly appearing modular edge and corner cover members.

Still further, the face cover member/members as previously described preferably cover supply piping to and from the system—for example supply piping routed directly underneath the modular base units of a system.

In accordance with an aspect and embodiment of the disclosure, there is provided a system wherein a plurality of base units are provided being linearly-aligned horizontally, wherein the cover member bridges at least one stud and covers supply piping to and from the system and between base units of the system. Or, alternatively, there may be provided a system wherein there are provided a plurality of base units linearly-aligned vertically, wherein the cover member covers supply piping to and from the system and between base units of the system.

In accordance with another aspect and embodiment of the disclosure, there is provided a customizable, modular, hydronic system adapted for use in an interior area, such as a micro-zone or a room, with other connected hydronic components such as a reversible heat pump, a buffer tank, a pump, an air handler, or a boiler. Such a system comprises a base unit comprising at least one heat exchanger within a modular base unit frame optionally adapted for residing between studs of the room's wall and selectively comprising one of a frame adapted to be completely recessed in the wall between the studs, partially recessed in the wall between the studs, and not recessed in the wall. In this context, a heat exchange may comprise any unit such as a radiator or a heating-coil. The modular base unit of this aspect and embodiment of the disclosure is adapted for retaining heated, or alternatively cooled, hydronic fluid in the at least one heat exchanger adapted for being circulated throughout the base unit by the other connected hydronic components.

Further, in accordance with this aspect and embodiment of the disclosure, there is provided a readily detachable and re-attachable face cover member adapted to be secured to the base unit and adapted for selection from a plurality of face cover member component supplies to facilitate coordination of the system's appearance with initial interior designs. The face cover member of this aspect of the disclosure is further adapted for easy re-customization according to any subsequent changes to interior designs for the interior space in which the system is used.

Preferably, the system of this aspect of the disclosure further comprises a plurality of modular edge members adapted for selection from a plurality of modular edge component supplies to further facilitate coordination of the system's appearance with initial interior designs, the modular edge members being adapted for easy re-customization according to any subsequent changes to interior designs for the interior space in which the system is used. Such modular edge and corner members are likewise preferably contiguous and selectable from a plurality of components supplies, such that when assembled together, they look like substantially singular coherent edge members with wrap-around corner members.

Preferably, as an example of one means of installation of the cover members, at least an upper one of the modular edge members and the modular corner members, but preferably at least an upper one and a lower one of the modular edge members and the modular corner members, are adapted with screw-hole tabs on their inner peripheries for installation of the modular edge members and the modular corner members to the wall around the periphery of the base unit(s). There may also be provided a bracket for hanging the modular edge members and the face cover member from the wall, wherein there may be provided a bracket for facilitating installation of modular edge members and modular corner members to the wall around the periphery of the base unit(s). In such case, the face cover member would then be correspondingly designed to slide into, or snap into, the modular edge members and modular corner members with either a snap-in, or slight-force, fit wherein baffle, or duct, portions of the face cover members are further retained in-between sheet metal portions of the base units having defined vent holes therein. Further, as an example of another means of installation of the face cover member to modular edge members and the modular corner members, there may be provided tab members at each corner of the face cover member adapted to slide into the modular corner members to hold the face cover member in place. This latter example would be suitable where the cover members are to be used with a radiator-type modular base unit, since with that type of a unit the face cover member need not have duct work, or a baffle, that could otherwise be used to hold the face cover member on relative to the modular base unit of a fan coil-type modular system.

In accordance with another embodiment according to one or more foregoing aspects of the disclosure, there is further provided a customizable, modular, hydronic system adapted for use in an interior area, such as a house, micro-zone or a room, with other connected hydronic components such as a reversible heat pump, a buffer tank, a pump, an air handler, or a boiler. The system in accordance with this embodiment comprises first and second modular base units, each the first and second base unit comprising at least one heat exchanger within a modular base unit frame optionally adapted for residing between studs of the room's wall and selectively comprising one of a frame adapted to be completely recessed in the wall between the studs, partially recessed in the wall between the studs, and not recessed.

The first and second modular base units of this embodiment are adapted for retaining heated, or alternatively cooled, hydronic fluid in each at least one heat exchanger, the fluid being adapted for being circulated throughout the first and second modular base units by the other connected hydronic components, the first and second modular base units being adapted for successive repeated linear implementation similar to that described in accordance with another embodiment of the system described herein.

The system in accordance with this embodiment further comprises a modular face cover member adapted to be secured to the first and second modular base units, wherein the face cover member comprises a peripheral edge, wherein the face cover member is adapted to be readily customized to achieve an aesthetically coherently designed cover member for the hydronic system, and wherein the face cover member is also adapted to be readily re-customized to achieve an alternative aesthetically coherent design.

In accordance with yet another aspect and embodiment of the disclosure, there is provided a customizable, modular, hydronic system adapted for use in an interior area, such as a micro-zone or a room, with other connected hydronic components such as a reversible heat pump, a buffer tank, a pump, an air handler, or a boiler. The system in accordance with this aspect and embodiment comprises: a base unit comprising at least one heat exchanger within a modular base unit frame optionally adapted for residing between studs of the room's wall and selectively comprising one of a frame adapted to be completely recessed in the wall between the studs, partially recessed in the wall between the studs, and not recessed in the wall, the modular base unit being adapted for retaining heated, or alternatively cooled, hydronic fluid in the at least one heat exchanger adapted for being circulated throughout said base unit by the other connected hydronic components.

The system in accordance with this aspect and embodiment of the disclosure further comprises a readily detachable and re-attachable face cover member adapted to be secured to said base unit, for example via the baffle, or duct portions sliding into, or snapping into portions of the base units having defined vent holes therein, and adapted for selection from a plurality of face cover member component supplies to facilitate coordination of the system's appearance with initial interior designs, said face cover member being further adapted for easy re-customization according to any subsequent changes to interior designs for the interior space in which the system is used.

Preferably, the system of this aspect and embodiment of the disclosure further comprises a plurality of modular edge members adapted for selection from a plurality of modular edge component supplies to further facilitate coordination of the system's appearance with initial interior designs, said modular edge members being adapted for easy re-customization according to any subsequent changes to interior designs for the interior space in which the system is used. Thus, as with a prior embodiment, as one means of installation of the cover member in such an embodiment, at least an upper one of the modular edge members and the modular corner members, but preferably at least an upper one and a lower one of the modular edge members and the modular corner members, are adapted with screw-hole tabs on their inner peripheries for installation of the modular edge members and the modular corner members to the wall around the periphery of the base unit(s). There may also be provided a bracket for hanging the modular edge members and the face cover member from the wall, wherein there may be provided a bracket for facilitating installation of modular edge members and modular corner members to the wall around the periphery of the base unit(s). In such case, the face cover member would then be correspondingly designed to slide into, or snap into, the modular edge members and modular corner members with either a snap-in, or slight-force, fit, and wherein the baffle, or duct, portions of the face cover members may be further retained in-between sheet metal portions of the base units having defined vent holes therein.

Still further, in accordance with an aspect and embodiment of the disclosure, there is provided a customizable, modular, hydronic system adapted for use in an interior area, such as a house, micro-zone or a room, with other connected hydronic components such as a reversible heat pump, a buffer tank, a pump, an air handler, or a boiler. The system in accordance with this aspect and embodiment of the disclosure comprises first and second modular base units, each first and second base unit comprising at least one heat exchanger within a modular base unit frame optionally adapted for residing between studs of the room's wall and selectively comprising one of a frame adapted to be completely recessed in the wall between the studs, partially recessed in the wall between the studs, and not recessed, the first and second modular base units being adapted for retaining heated, or alternatively cooled, hydronic fluid in each at least one heat exchanger adapted for being circulated throughout the first and second modular base units by the other connected hydronic components, wherein the first and second modular base units are adapted for successive repeated linear implementation (whether horizontal linear or vertical linear implementation).

The system in accordance with this aspect and embodiment further comprises a modular face cover member adapted to be secured to the first and second modular base units, wherein the face cover member comprises a peripheral edge, wherein the face cover member is adapted to be readily customized to achieve an aesthetically coherently designed cover member for the hydronic system, and wherein the face cover member is also adapted to be readily re-customized to achieve an alternative aesthetically coherent design.

In accordance with another aspect of the disclosure, there is provided a method of installing a hydronic heating and cooling system adaptable to be modularly scalable to meeting heating and cooling needs of a given interior space, in accordance with one or more aspects of the disclosure, the method comprising:

A. Determining the Btu needs and type of heating and cooling system needed to supply the given interior space;

B. Determining a desired configuration of system, whether vertically or horizontally oriented, and whether fully recessed between studs, partially recessed (e.g., approximately ½ way) between the studs, or non-recessed;

C. Selecting an appropriate number of modular base units to supply needed heating and cooling for the given interior space, whether a single modular base unit or a plurality of modular base units, from a modular base unit component supply;

D. Determining an appropriate number of modular edge members, if any, and a single appropriate face cover member, whether for covering a single modular base unit or a plurality of modular base units, from modular edge members, modular corner edge members, and modular face cover members, component supplies;

E. Marking locations for installation on a wall of the space to be treated, being sure to align as level the installation holes in the case of a desired horizontally linear arrangement, and installation holes in the case of a desired horizontally-linear arrangement, and anticipating the possibility for a need for a plurality of side-by-side, or a plurality of vertically-stacked, modular base units residing between the studs;

F. Installing hanging brackets onto studs anticipating the possibility for a need for a plurality of side-by-side, or a plurality of vertically-stacked, modular base units residing between the studs;

G. Hanging the appropriate number of base units on the hanging brackets with the base unit frame members located between the studs (at least in the case of fully recessed and partially recessed models);

H. Hooking up pipes and control unit electronics into the selected number of base units;

I. Selecting desired edge cover members, if any, and face cover members from a plurality of edge cover member and face cover member component supplies;

J. Assembling edge cover members, if any, and attaching them to the wall or a base unit, and attaching a face cover member to form an aesthetic coherent (e.g., substantially singular appearing) face and edge hydronic system covering member;

K. Placing the cover member over the base unit(s) such that vent holes in the one or more base units align with vent holes in one of the modular edge cover members and the face cover member to ensure unimpeded airflow through the system; and L. Securing the cover member onto the base units.

In accordance with another aspect of the disclosure, the method of installing the modular hydronic heating and cooling system further comprises the additional steps, after initial installation, of removing an existing cover member, and determining an aesthetically pleasing, in terms of color and design, face cover member and correspondingly aesthetically pleasing edge cover members, and selecting the same from a plurality of modular component supplies to account for changes in room design, system design, and or personal user preference. Thus, it may be seen that, in accordance with an aspect of the disclosure, this method of installing the modular hydronic system enables re-customization and thus enhances the numbers of options available to customers in customizing the appearance of their systems in light of other interior design considerations.

In accordance with yet another aspect of the disclosure, in the case of the method of installing a modular hydronic system that is to be fully-recessed between the studs, the step K. of placing the cover member over the one or more base units further comprises the step of simultaneously aligning and inserting normally-oriented tabs attached on an inner surface of the selected face cover member so that the tabs cover upper and lower vent holes in frame portions of the one or more base units thus effectively re-routing ventilation of the system to the pass through vent holes in the face cover member. This aspect of the disclosure allows usage of the same base unit for each wall-mount, partially-recessed (e.g., approximately ½ way recessed in the wall), and fully-recessed systems, the base units differing from one another only insofar as their respective mounting tabs are located at different locations (forward and aft) on their side frames. This aspect of the disclosure teaches to further facilitate customer choice in customizability of design and further helps the cause of modularity since a single type of base unit may be used, each type of base unit differing from the others only by the location of their mounting tabs on the base unit side frames.

When installing a fully-recessed system or a partially-recessed system, the step K. of placing the cover member over the base unit(s) further comprises the step of simultaneously aligning and inserting duct(s) of the cover members above an upper vent of the modular base unit and below a lower vent of the modular base unit, to help hold the cover member in place relative to the modular base unit. This aspect of the disclosure also lends to modularity of the system since the same base unit may be used for each wall-mount, partially-recessed, and fully-recessed systems, the base units differing from one another only insofar as their respective mounting tabs are located at different locations (forward and aft) on their side frames. This aspect of the disclosure teaches to further facilitate customer choice in customizability of design and further helps the cause of modularity since a single type of base unit may be used, each type of base unit differing from the others only by the location of their mounting tabs on the base unit side frames.

Thus, it will be appreciated that the number of component supplies for the base units may comprise a plurality of different supplies of base units with tabs at the rear of the side frames, or the back of the frames, of the base units, at mid-way on the side frames, or at the front on the side frames, to allow for easy selection and supply (i.e., from a catalog for supplies) depending on a chosen design, whether non-recessed (wall mounted), partially-recessed, or fully-recessed).

While it will be appreciated that portions of the aesthetic treatments of the system of the present disclosure may preferably be provided as unitary face plates adapted to cover one or more modular base heating/cooling units, a coherent aesthetic treatment may also comprise a plurality of modularly customizable face plates adapted for being matched to achieve a pleasing aesthetic, for example one that provides a substantially singular (i.e., integral appearing) cover member appearance.

Thus, the present system is adapted for being sourced from a plurality of modular component supplies, or bins, wherein a user is enabled in selecting any of a plurality of modular base units and cover members, whether edge cover members, corner cover members, and/or face cover members, wherein the component supplies are created anticipating enabling selection of modular components to meet the initial heating and/or cooling demands of a given space, and in terms of facilitating customizability and re-customizability of the aesthetics of the system considering interior design considerations, and possible changes to the interior design, presented by the given interior space.

The subject matter of the present invention is particularly pointed out and distinctly claimed in the concluding portion of this specification. However, both the organization and method of operation, together with further advantages and objects thereof, may best be understood by reference to the following descriptions taken in connection with accompanying drawings, wherein like reference characters refer to like elements.

BRIEF DESCRIPTIONS OF DRAWINGS

FIG. 1A is a front perspective view of an embodiment of a fully-recessed fan coil-type modular base unit (the unit also comprising a housing frame) adapted for use in a customizable, modular, hydronic system for heating/cooling an interior area, wherein in terms of piping layout the modular base unit is optionally adapted for selection from a component supply for ready customizable and recustomizable design use as an in-the-wall, between-studs, upper modular base unit of a series of such vertically-oriented modular base units, any of the modular base units of such a series of horizontally-oriented modular base units, or a singular such modular base unit;

FIG. 1B is a front left perspective view of the fully-recessed fan coil-type modular base unit of FIG. 1A (the unit also comprising a housing frame) adapted for use in a customizable, modular, hydronic system for heating/cooling of an interior area, wherein the modular base unit is optionally adapted for selection from a component supply for ready customizable and recustomizable design use as an in-the-wall, between-studs, modular base unit in any location in a series of such modular base units, whether horizontally-oriented or vertically-oriented, or a singular such modular base unit;

FIG. 1C is a front left perspective view of the fully-recessed fan coil-type modular base unit of FIGS. 1A and 1B, further showing how mounting flanges for the unit are attached at an anterior portion of the housing frame of the modular base unit adapted for enabling fully-recessed installation of the modular base unit between studs of a wall, wherein the modular base unit is optionally adapted for selection from a component supply adapted for ready customizable and recustomizable design use as a modular base unit in any location in a series of such modular base units, whether horizontally-oriented or vertically-oriented, or as a singular such modular base unit;

FIG. 1D is a front left perspective view of an alternative embodiment partially-recessed fan coil-type modular base unit, further showing how mounting flanges for the unit are attached at an intermediate portion of the housing frame of the modular base unit adapted for enabling partially-recessed installation of the modular base unit between studs of a wall, wherein the modular base unit is optionally adapted for selection from a component supply adapted for ready customizable and recustomizable design use as a modular base unit in any location in a series of such modular base units, whether horizontally-oriented or vertically-oriented, or as a singular such modular base unit;

FIG. 1E is a front left perspective view of another alternative embodiment non-recessed fan coil-type modular base unit, further showing how mounting flanges for the unit are attached at a posterior portion of the housing frame of the modular base unit adapted for enabling non-recessed installation of the modular base unit on the surface of a wall, wherein the modular base unit is optionally adapted for selection from a component supply as a modular base unit adapted for ready customizable and recustomizable design use as a modular base unit in any location in a series of such modular base units, whether horizontally-oriented or vertically-oriented, or as a singular such modular base unit;

FIG. 1F is a front perspective view of an embodiment of a fully-recessed fan coil-type modular base unit, wherein in terms of piping layout, the modular base unit is optionally adapted for selection from a component supply as a modular base unit adapted for ready customizable and recustomizable design use as an intermediate fully-recessed modular base unit, or a bottom base unit, in a vertically-oriented series of such modular base units (and adapted to be used with another modular base unit as the top such base unit as shown in FIG. 1A, or with another modular base unit as another intermediate such base unit as shown herein in this FIG. 1F)

FIG. 1G is a front perspective view of another embodiment of a fully-recessed modular base unit, namely a radiator-type modular base unit (the unit also comprising a housing frame) adapted for use in a customizable, modular, hydronic system for heating/cooling an interior area, wherein in terms of piping layout the modular base unit is optionally adapted for selection from a component supply for ready customizable and recustomizable design use as an in-the-wall, between-studs, upper modular base unit of a series of such vertically-oriented modular base units, any of the modular base units of such a series of horizontally-oriented modular base units, or a singular such modular base unit.

Figure 2B:
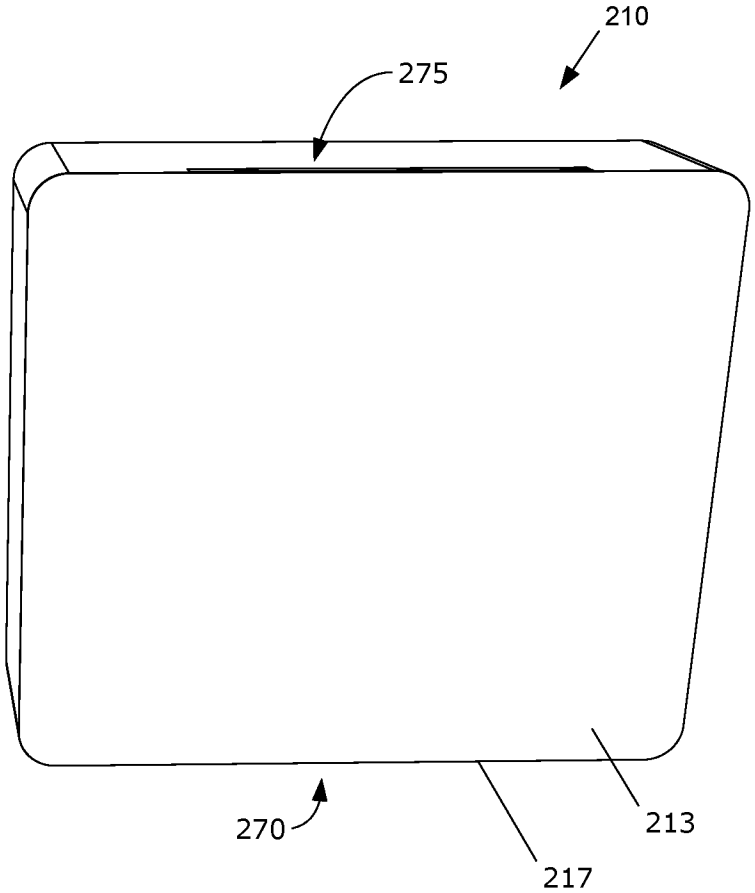
Figure 2A:
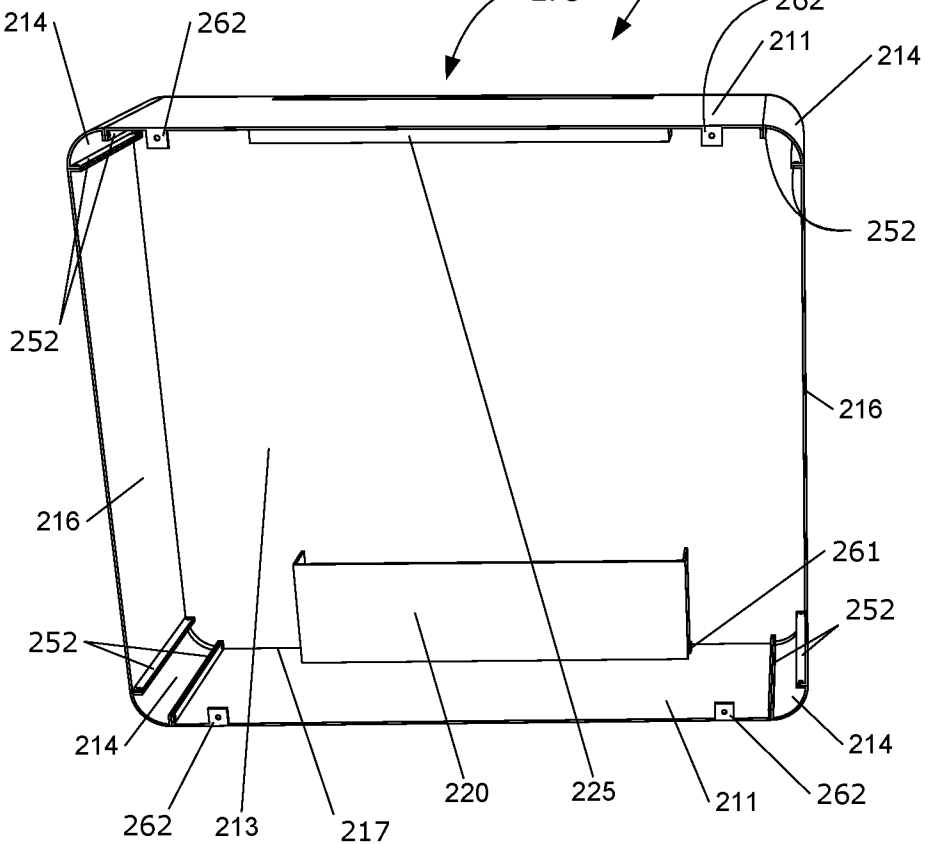
Figure 2C:
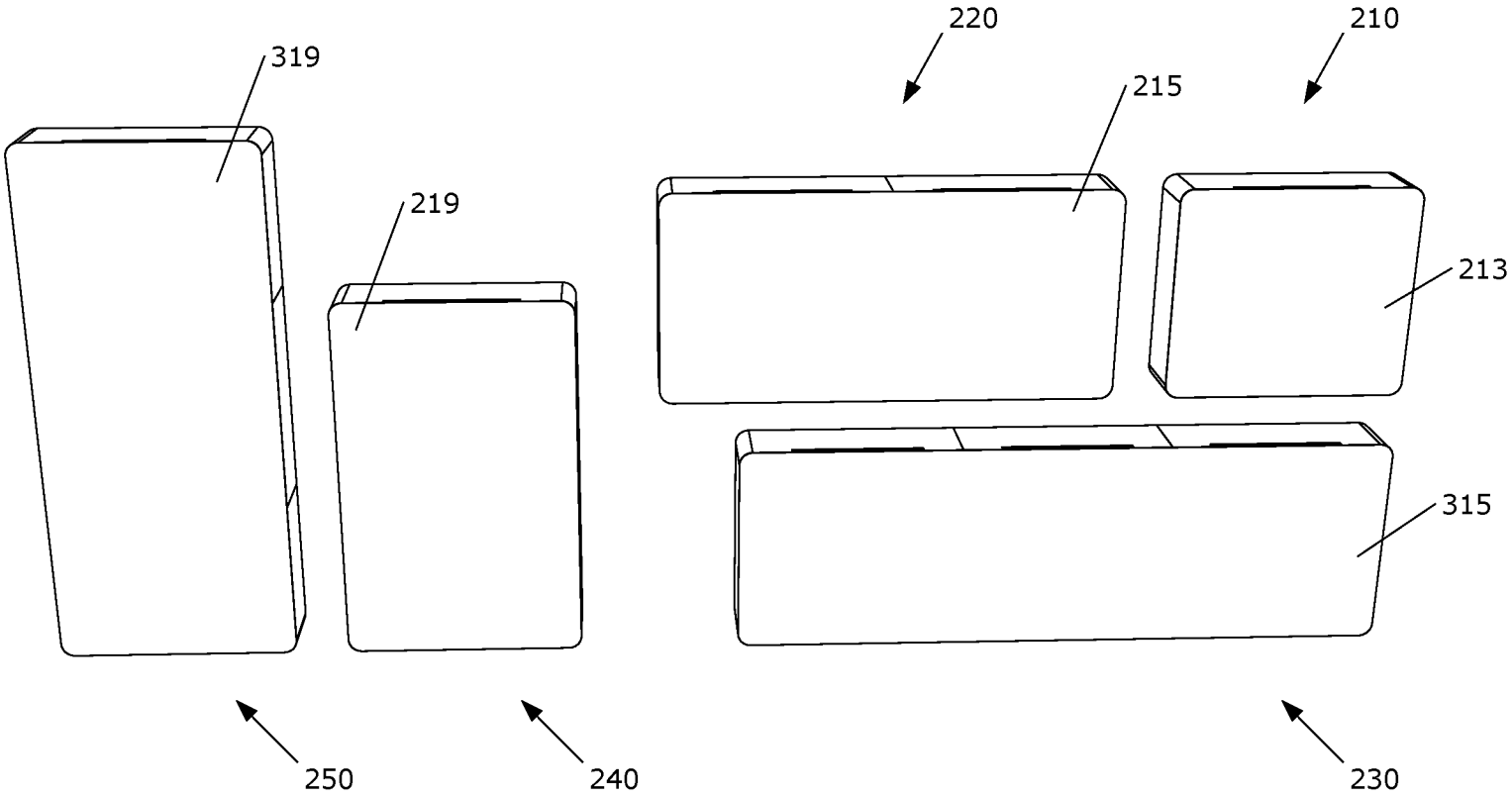
Figure 2D:
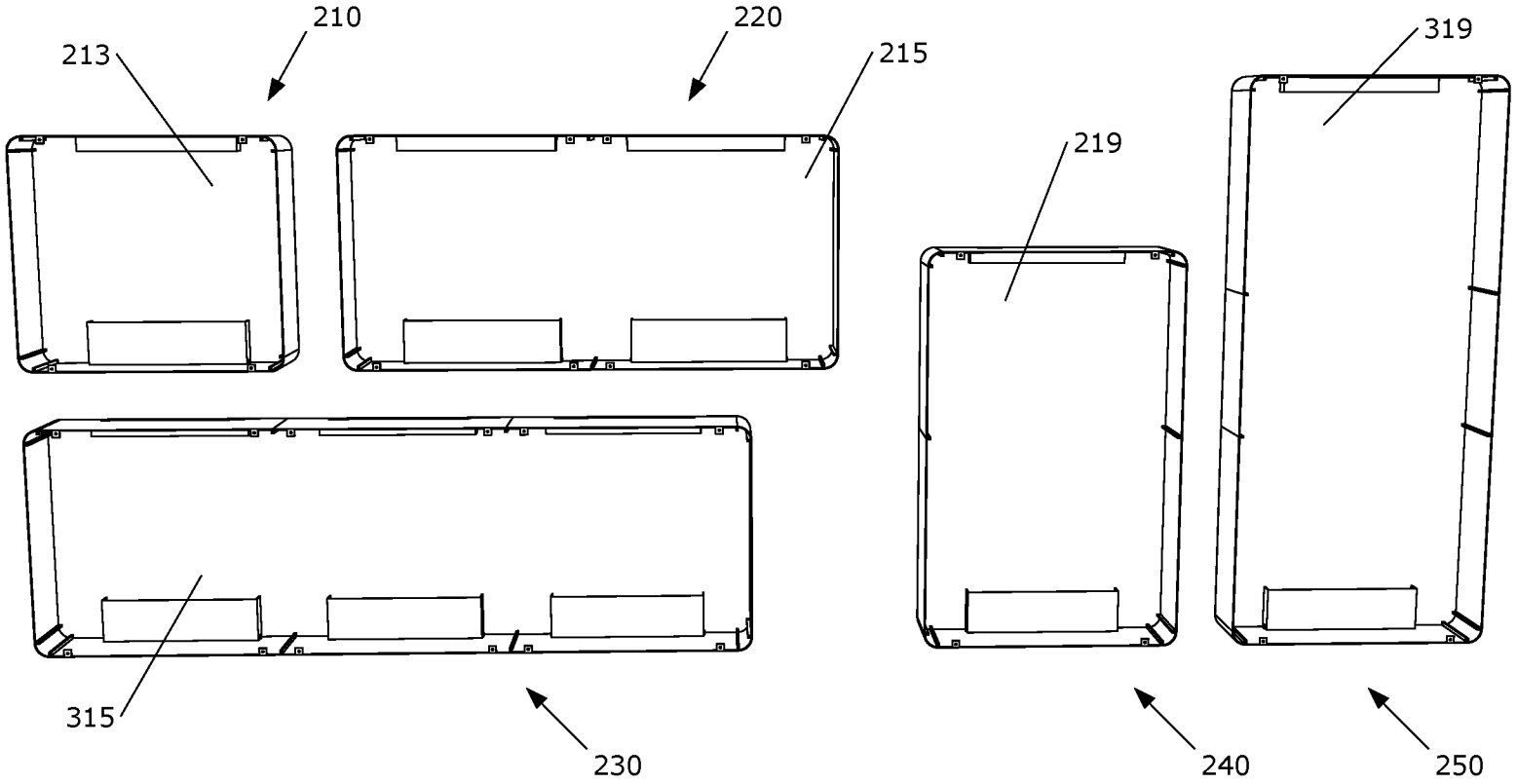
Figure 2E:
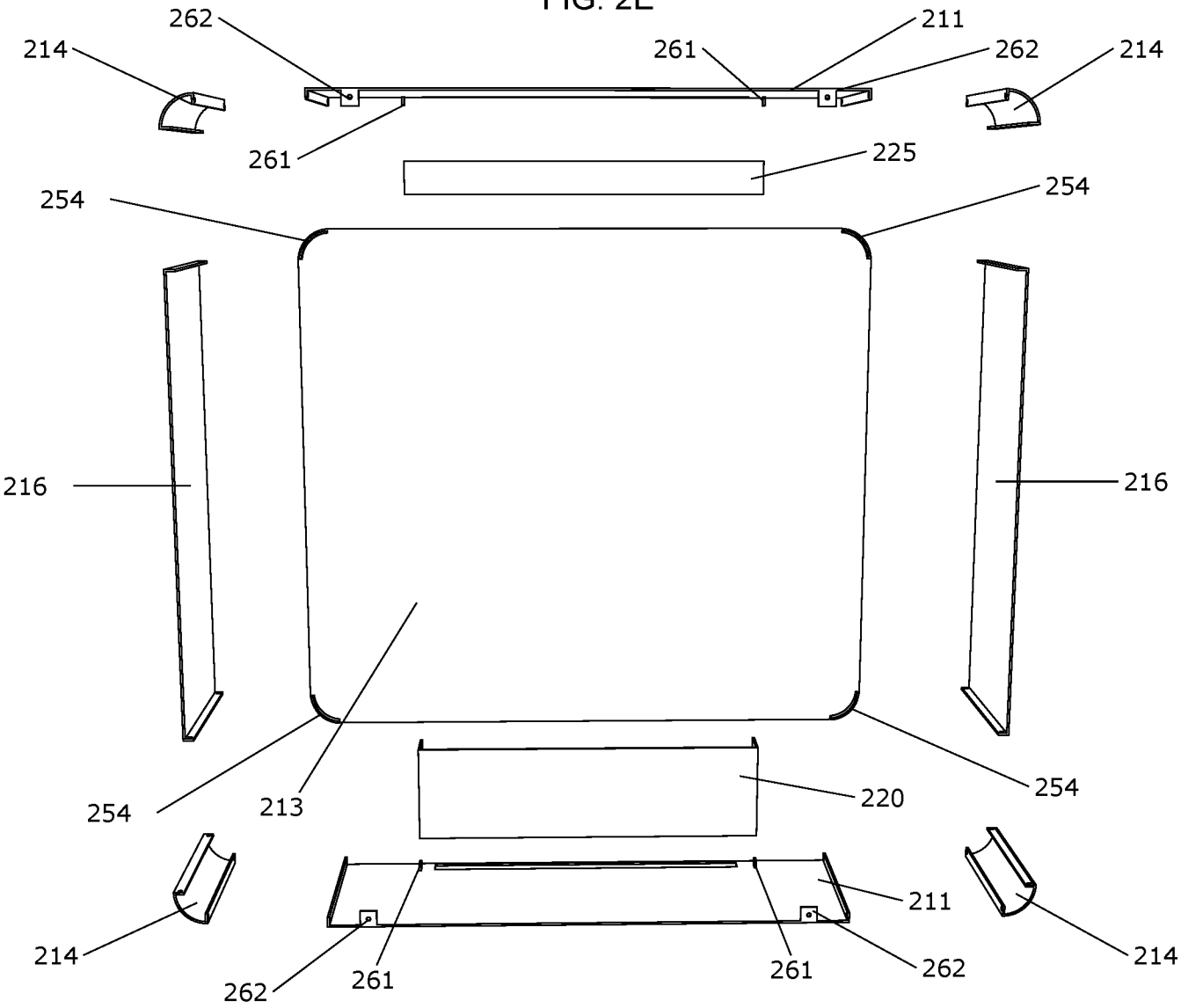
Figure 2F:
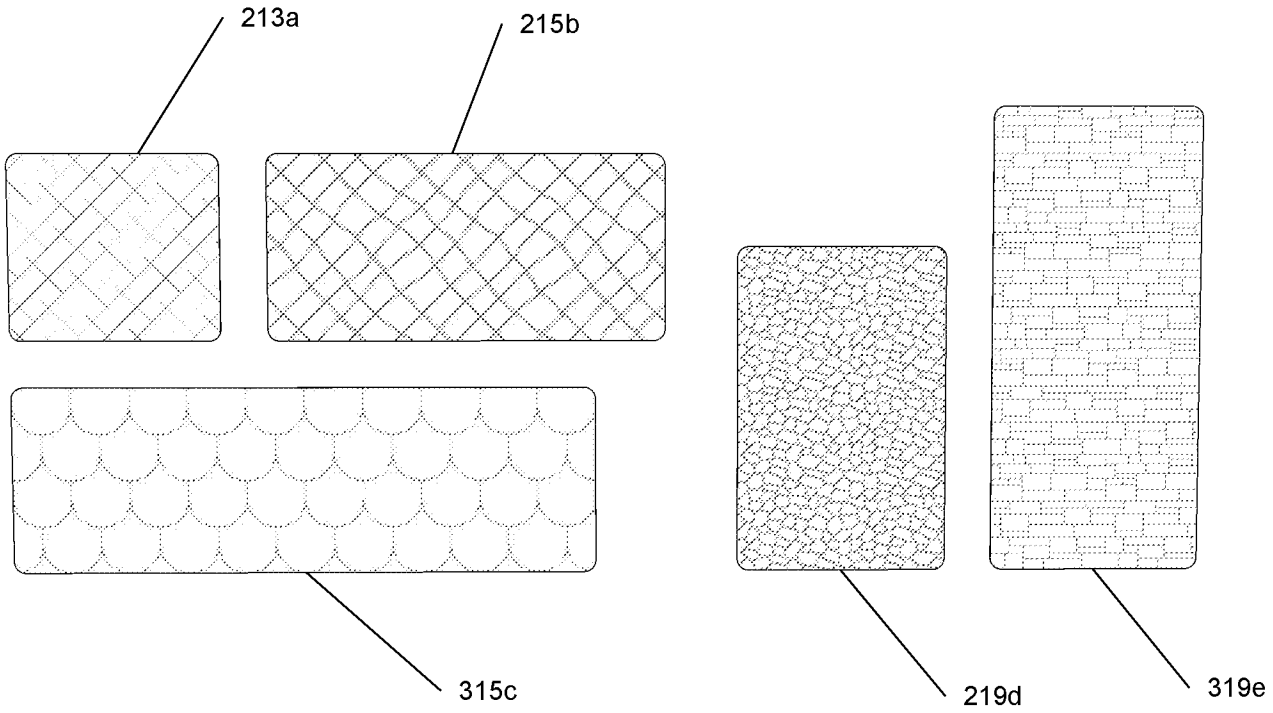
Figure 2G:
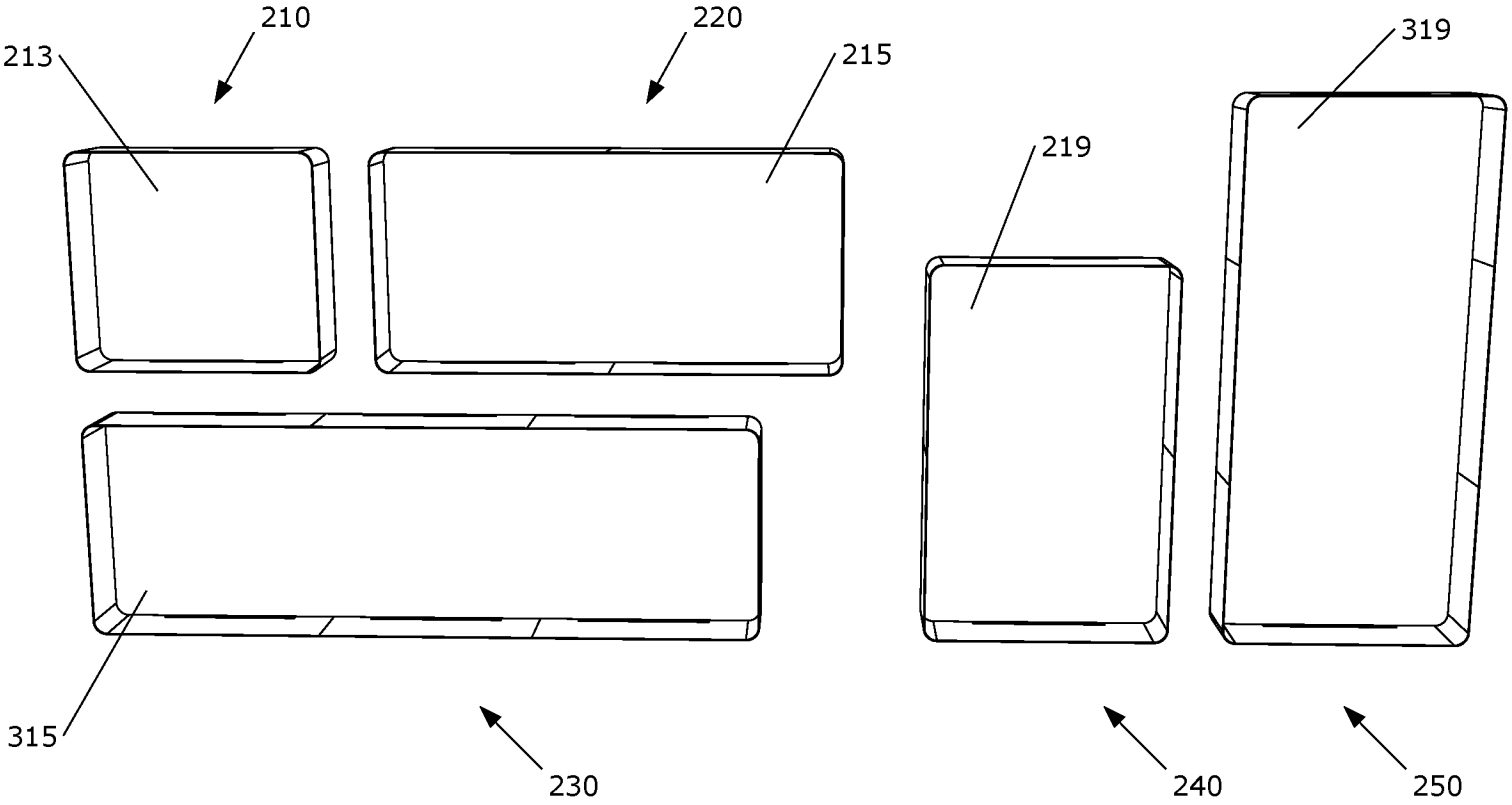
Figures 3A, 3B:
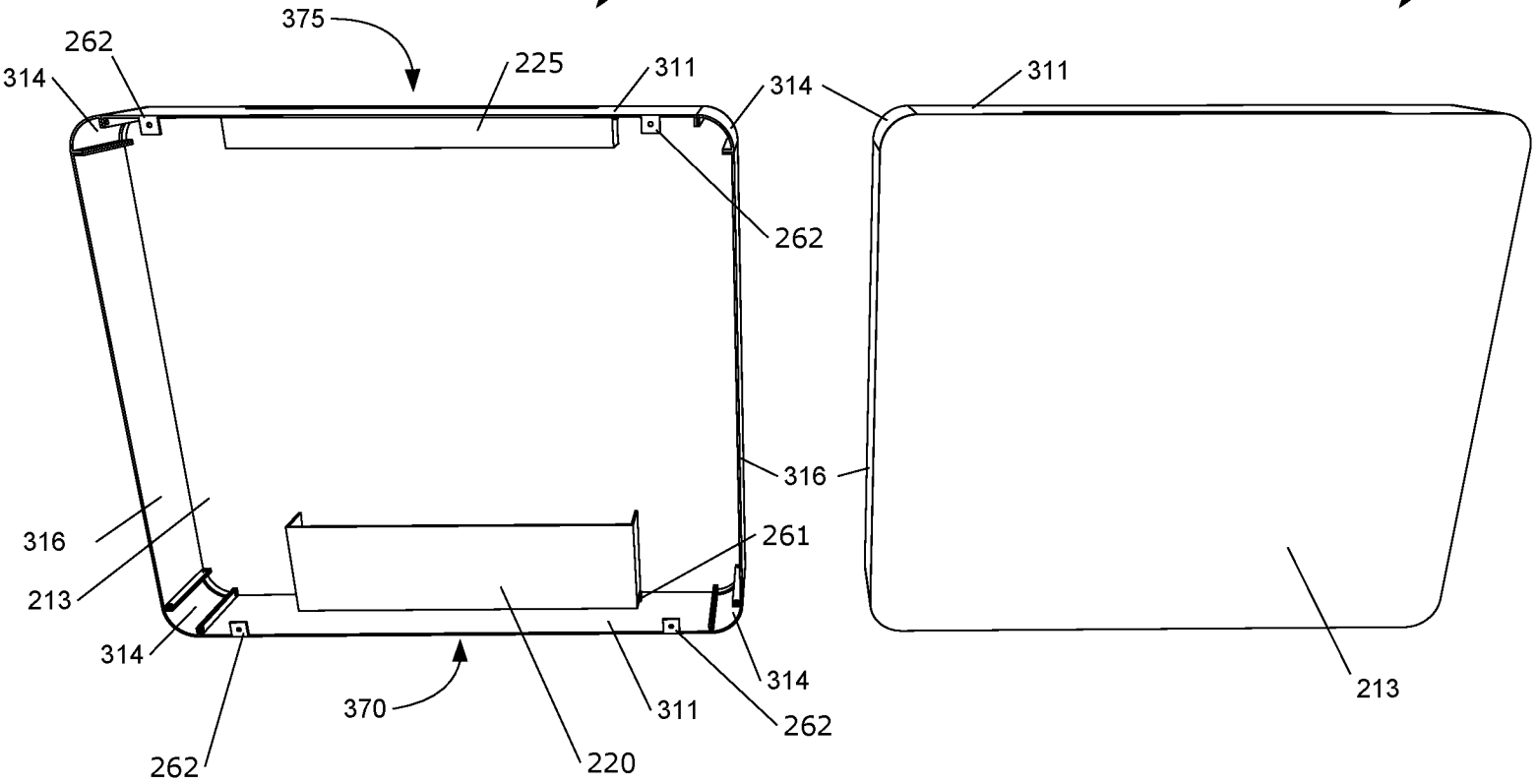
Figure 3C:
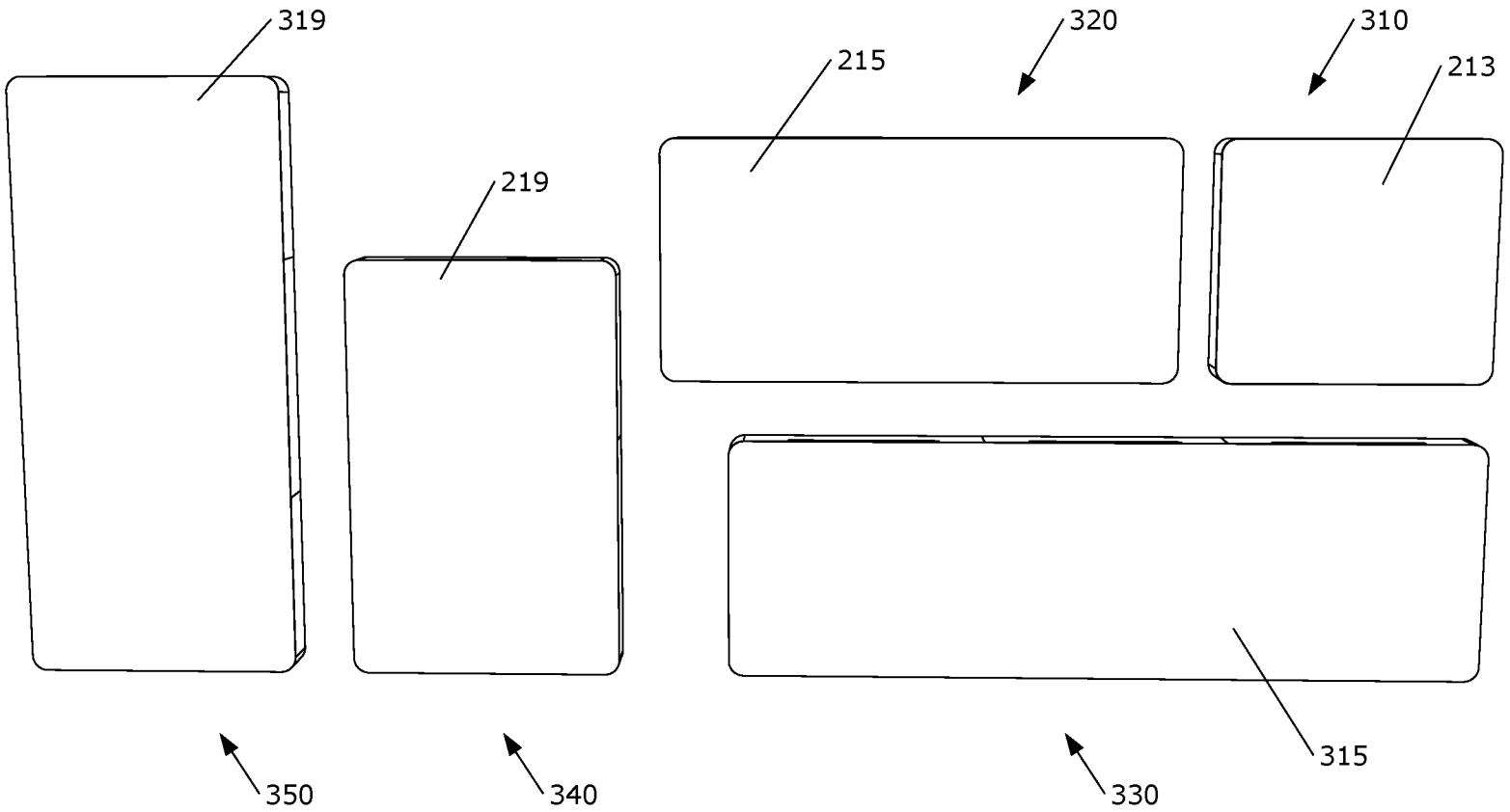
Figure 3D:
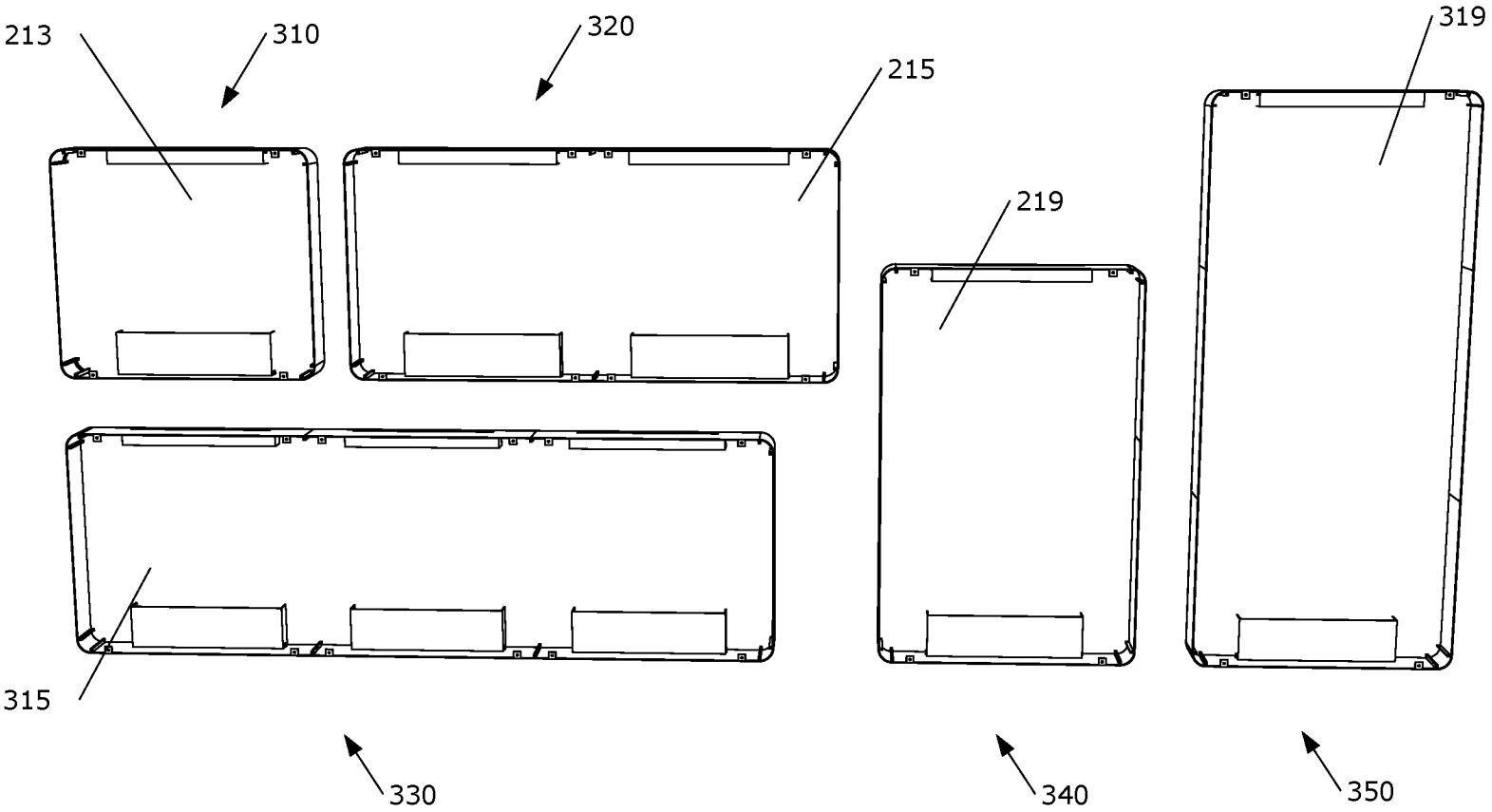
Figure 3E:
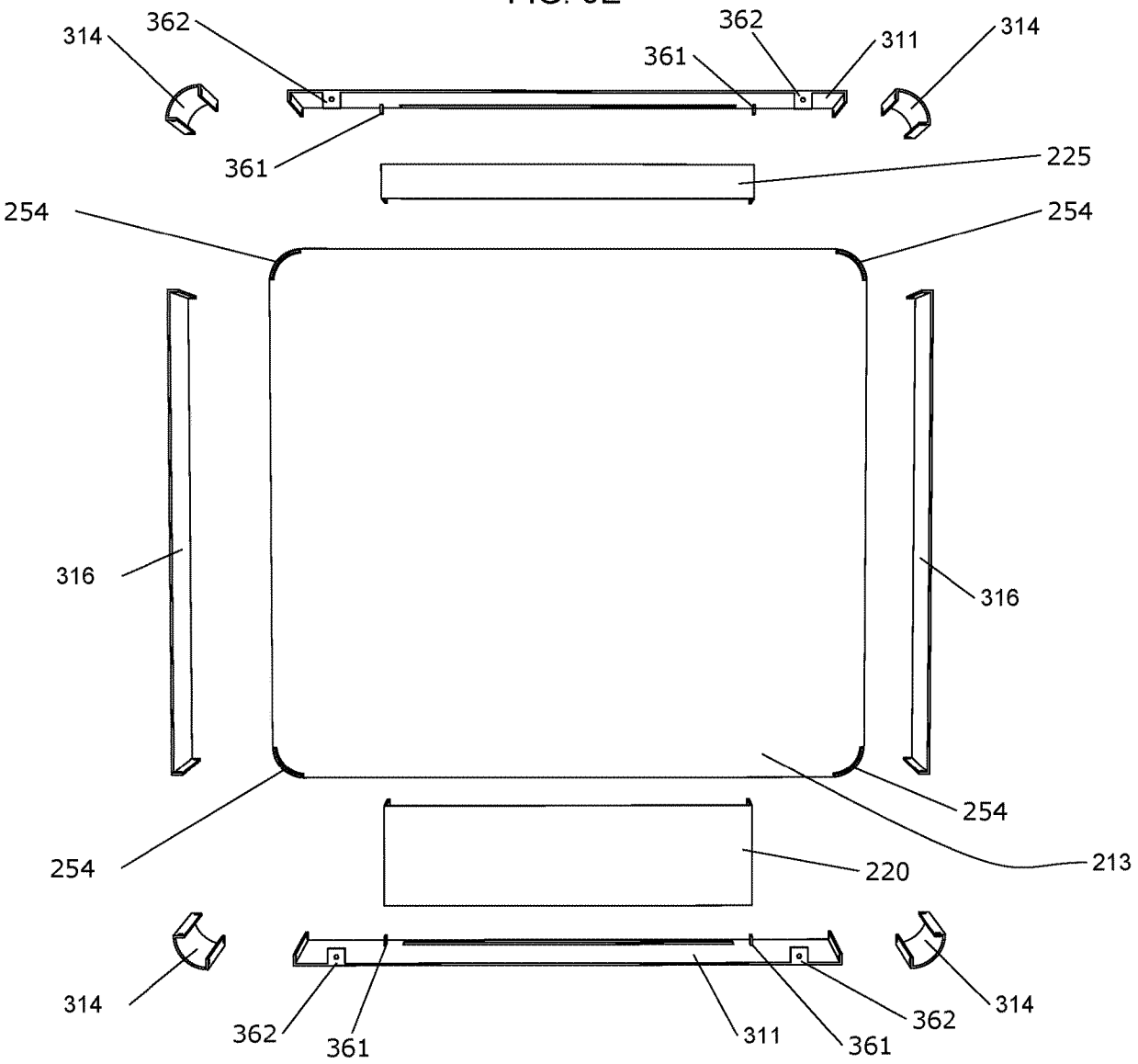
Figure 3F:
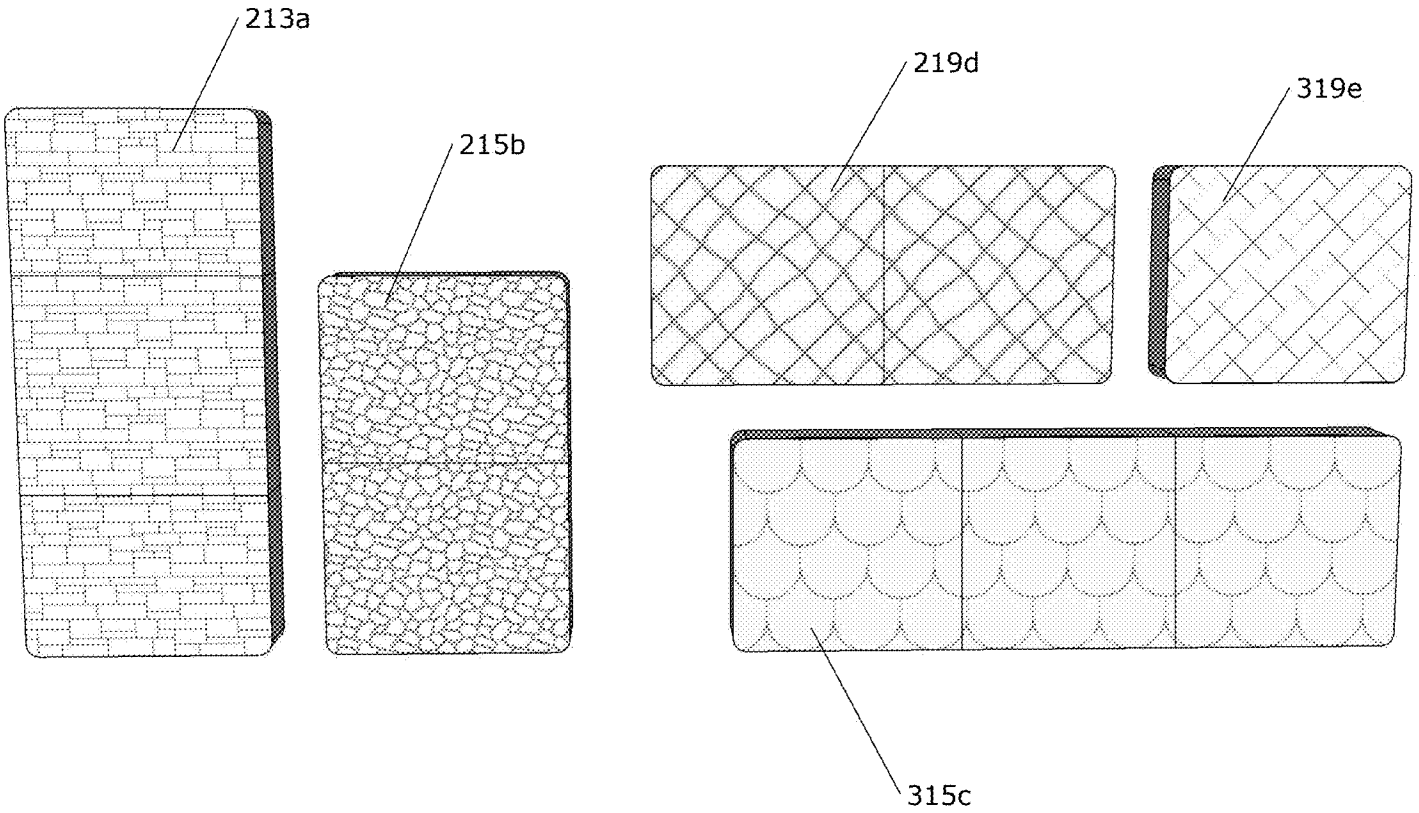
Figure 3G:
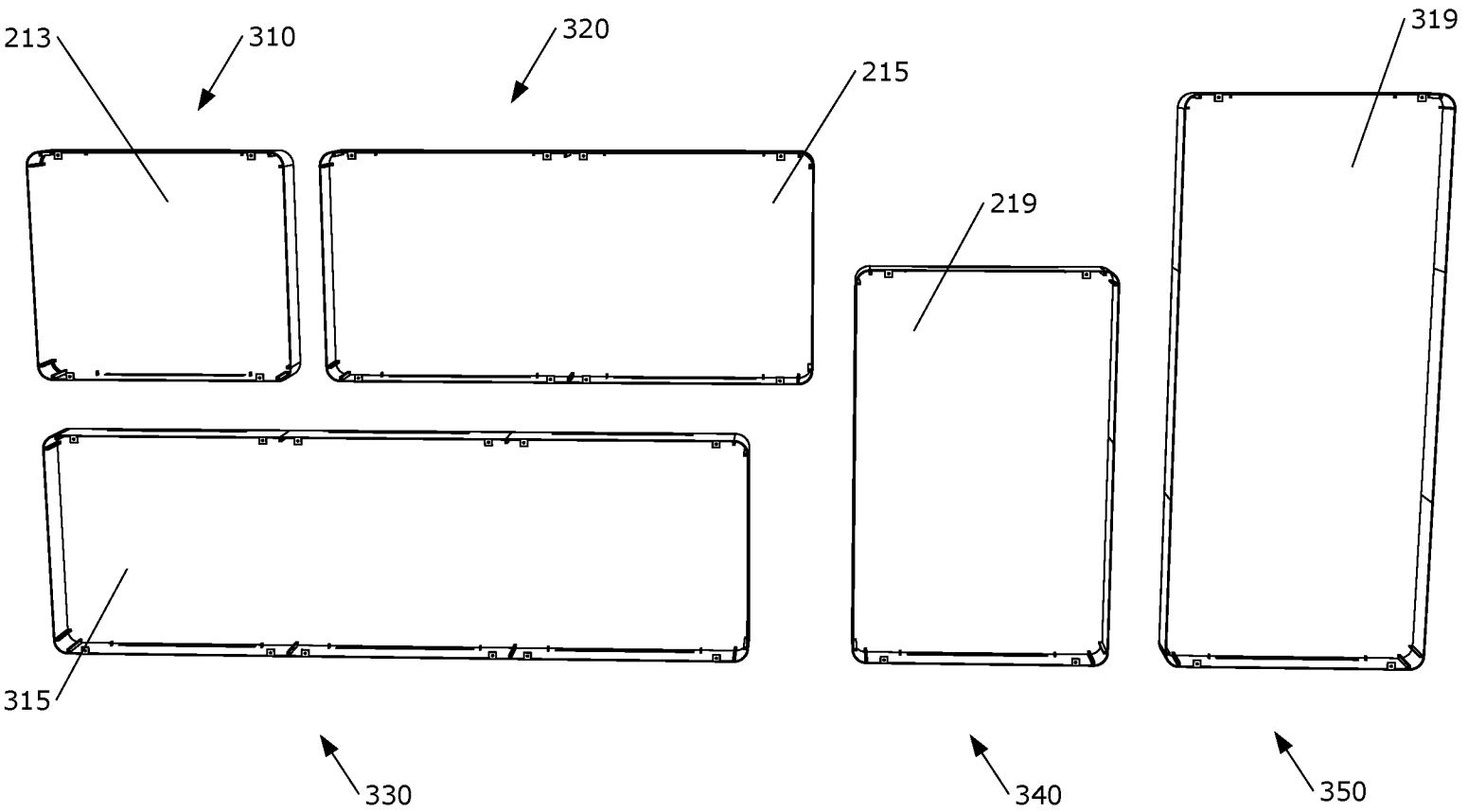
Figure 4B:
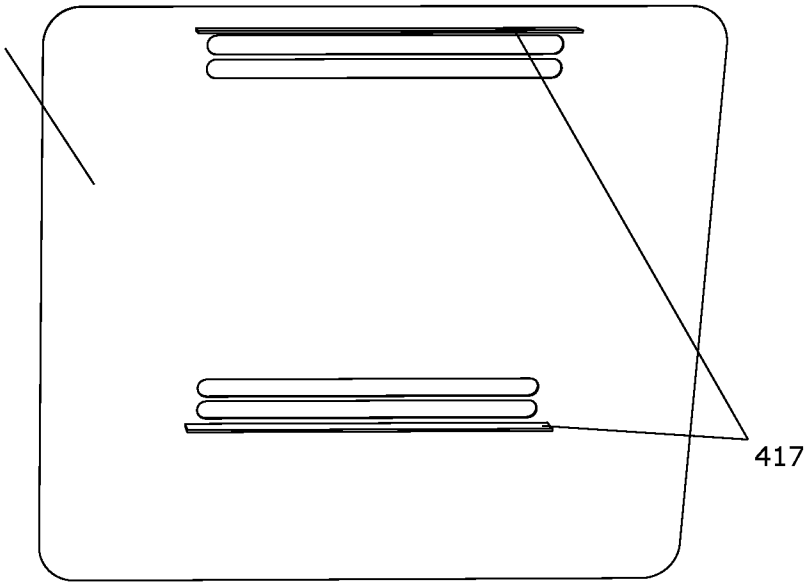
Figure 4A:
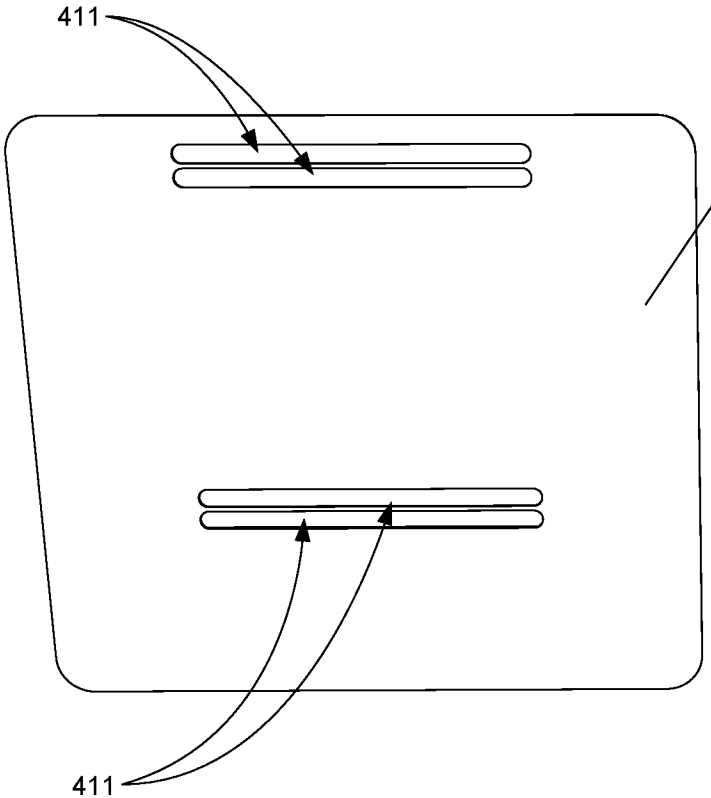
Figure 4C:
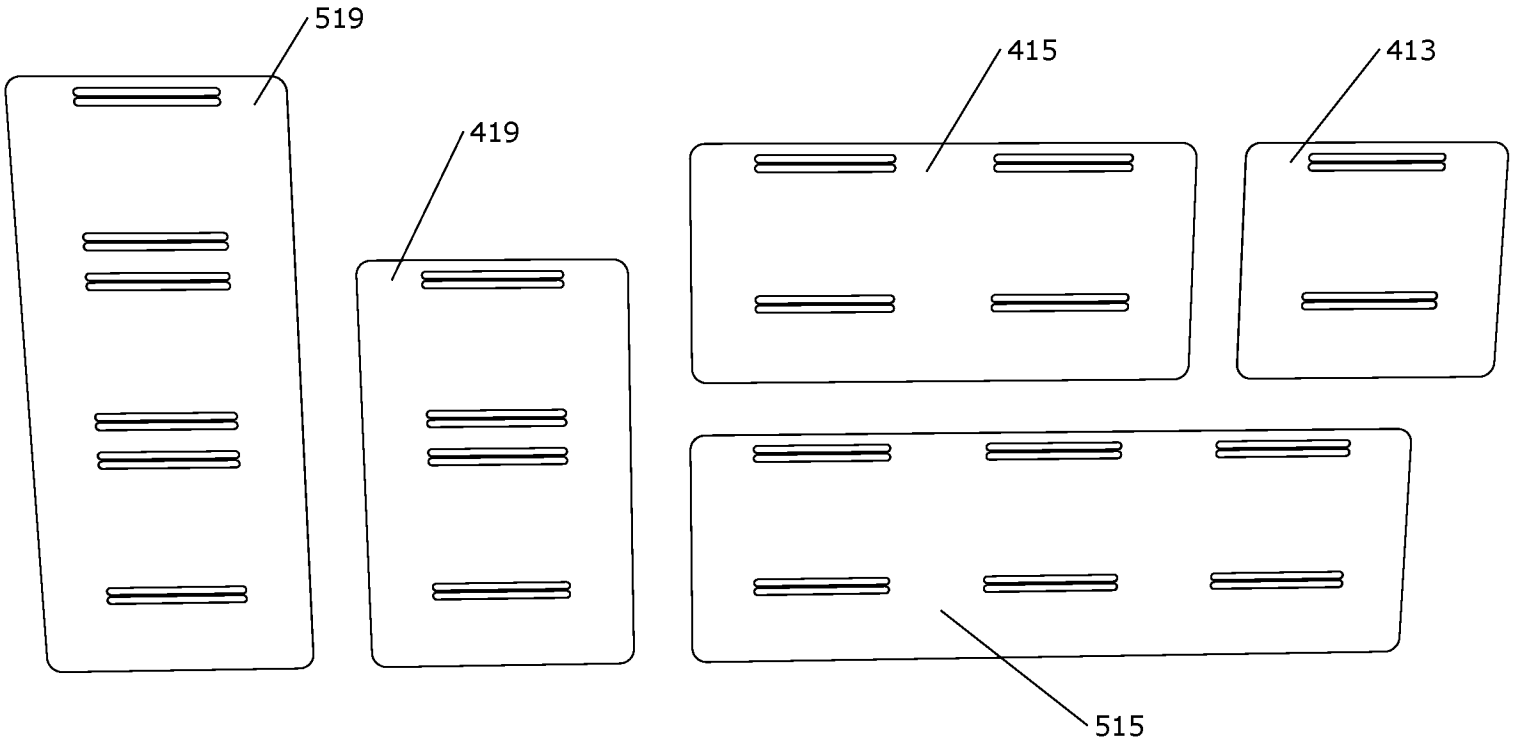
Figure 4D:
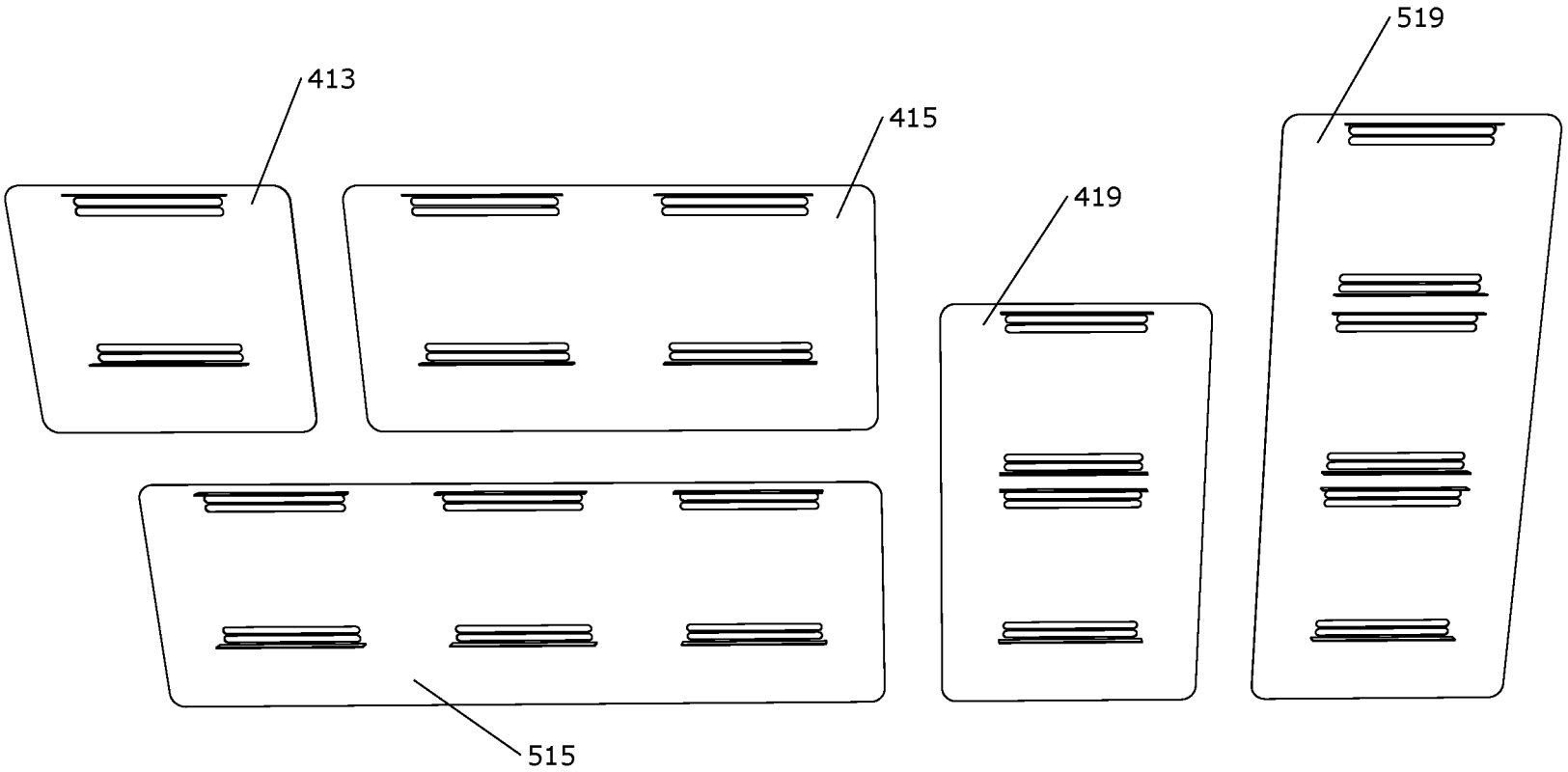
Figure 4E:
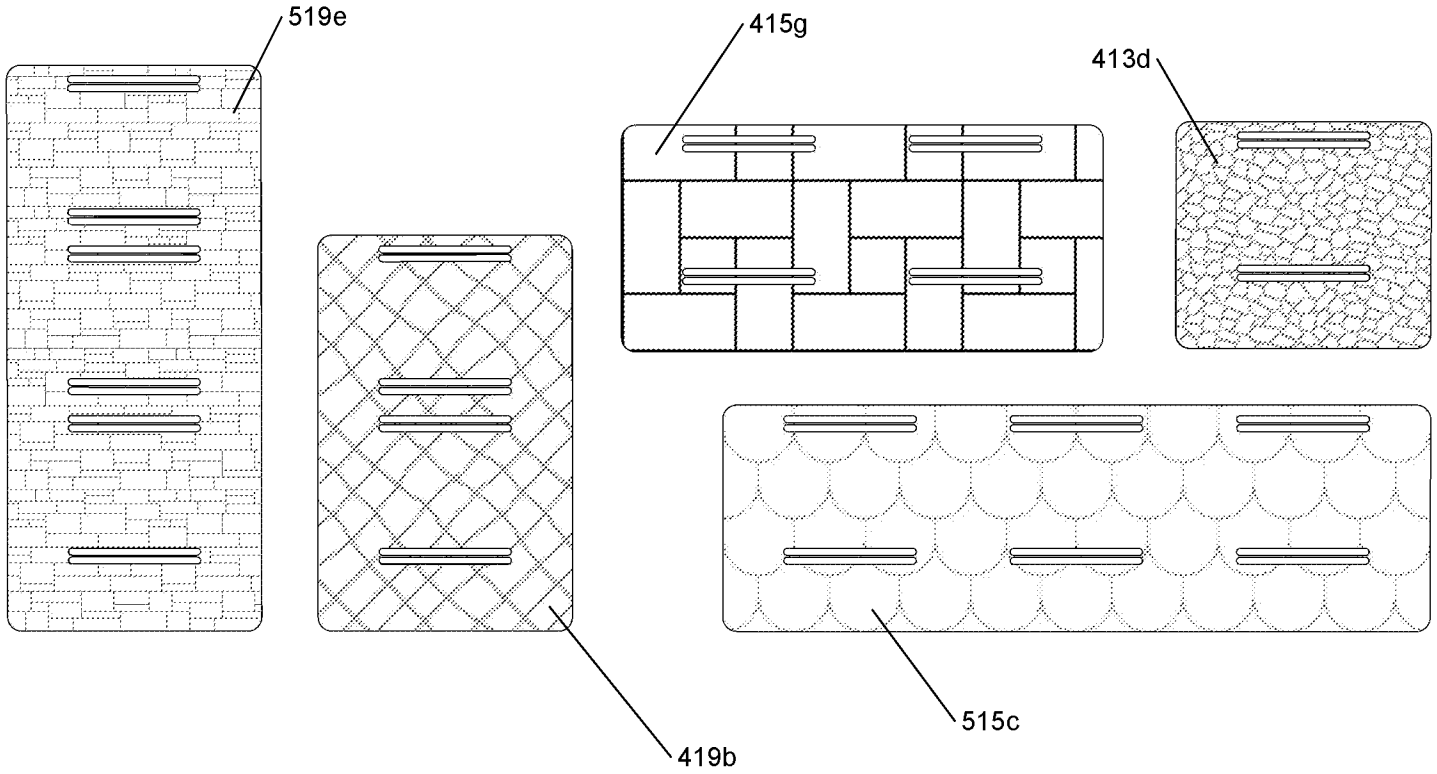
Figure 4F:
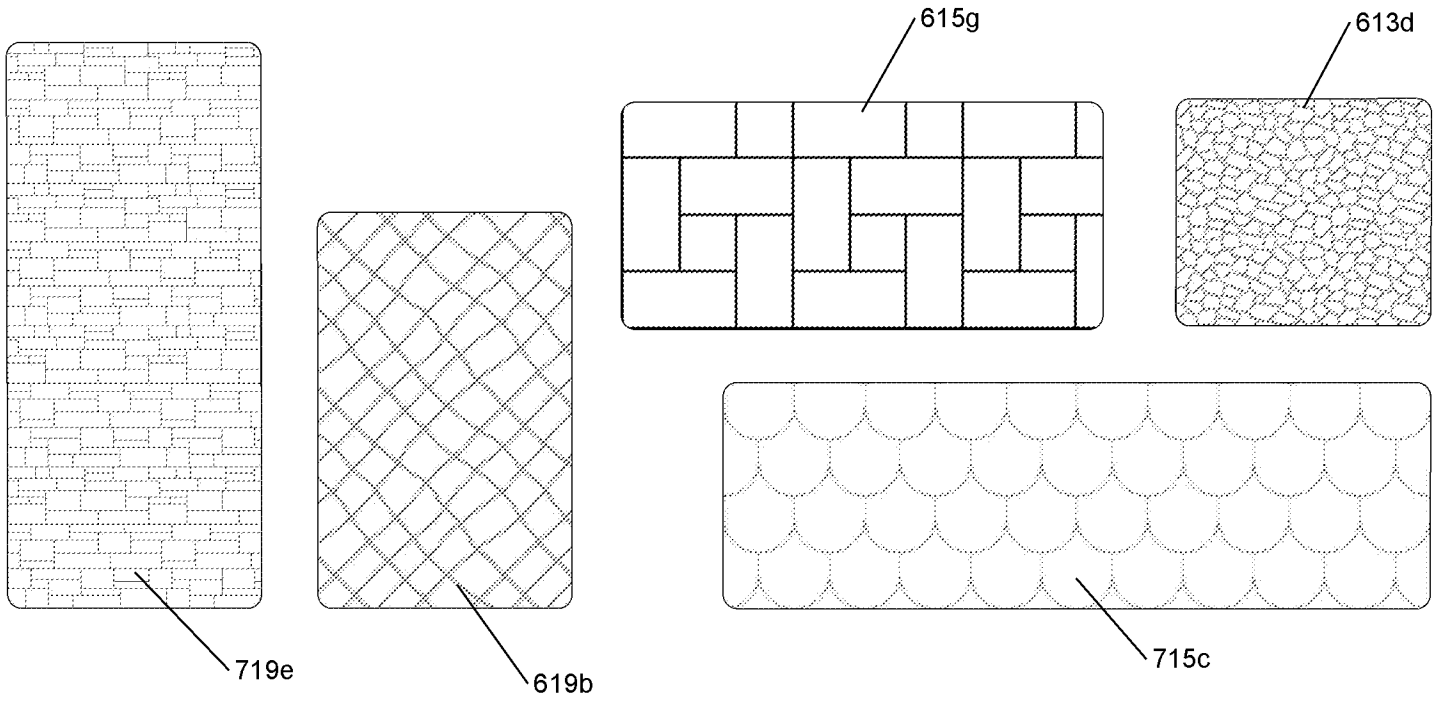
Figure 5:
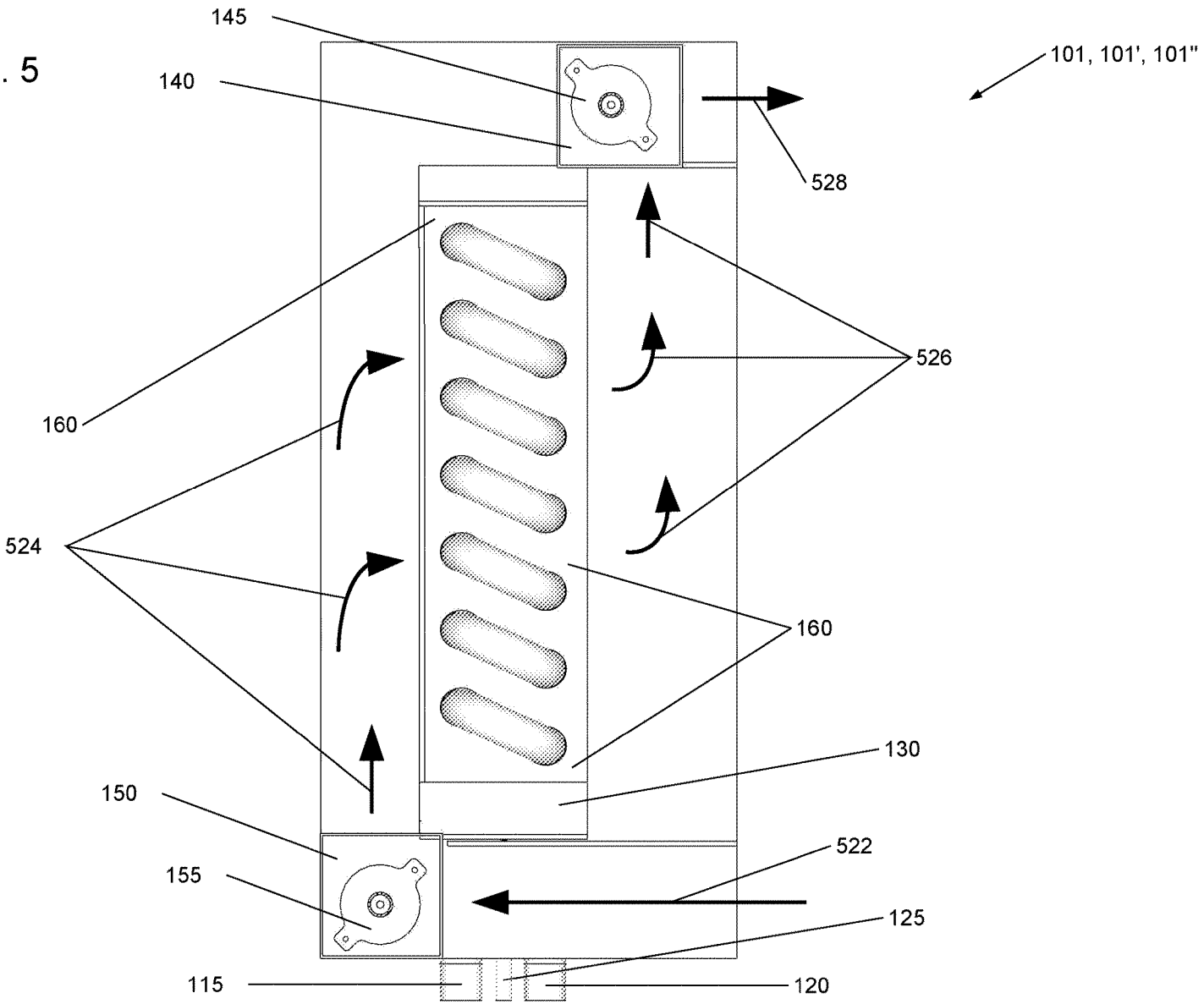

FIG. 2A is a rear perspective view of a customizable modular cover member for covering a single non-recessed, modular base unit, comprising a single face cover member, four edge members (a vented top edge member, a vented bottom edge member, and two side edge members), and four modular corner edge members, wherein each portion of the modular cover member is optionally adapted for selection from a component supply adapted for use for readily customizable, and recustomizable design for covering of a singular non-recessed modular base unit;

FIG. 2B is a front perspective view of the customizable non-recessed, modular cover member of FIG. 2A;

FIG. 2C is a front perspective view of a plurality of customizable non-recessed modular cover members, comprising the single non-recessed modular cover member of FIGS. 2A and 2B, vertically oriented dual-series and triple-series non-recessed modular base unit cover members, and horizontally oriented dual-series and triple-series, non-recessed, modular base unit cover members, wherein each cover member further comprises four non-recessed corner edge members, a plurality of vertical non-recessed edge members, a plurality of non-recessed vented top and bottom edge cover members, and a face cover member, wherein each portion of each modular cover member is optionally adapted for selection from a component supply adapted for use for readily customizable and recustomizable design covering of one or more non-recessed modular base units, whether as a vertically-oriented series of such modular base units, a horizontally-oriented series of such modular base units, or a singular such modular base unit;

FIG. 2D is a rear perspective view of the plurality of customizable non-recessed, modular face cover members of FIG. 2C, showing from the rear that the face cover member thereof is adapted for use with a fan coil-type version of a hydronic system since there is duct work on the rear of the face cover member to appropriately route forced air from the fans of the modular fan coil member;

FIG. 2E is a rear perspective exploded view of a customizable non-recessed modular cover member, wherein each portion of the modular cover member is adapted for selection from a component supply adapted for use for readily customizable and recustomizable design covering of a non-recessed (wall-mount) modular base unit, also showing from the rear that the face cover member is adapted for use with a radiator version of a hydronic system since there is no duct work on the rear of the face cover member, and wherein there is provided an exemplary retaining system comprising curved slidable tabs for retaining the face cover member on the modular corner edge members;

FIG. 2F is a front view of a various face cover members coming in different sizes and having different decorative patterns on the face thereof;

FIG. 2G is a rear perspective view of a plurality of customizable non-recessed, modular face cover members of FIG. 2G, showing from the rear that the face cover member portion thereof is adapted for use with a radiator version of a hydronic system since there is no duct work on the rear of the face cover member FIG. 3A is a rear perspective view of a customizable partially-recessed modular cover member for covering a single partially-recessed, modular base unit, comprising a single face cover member, four edge members (a vented top edge member, a vented bottom edge member, and two side edge members), and four modular corner edge members, wherein each portion of the modular cover member is optionally adapted for selection from a component supply adapted for use for readily customizable, and recustomizable design for covering of a singular partially-recessed modular base unit, wherein the face cover member is suited for use with a fan coil-type modular base unit since it has a baffles, or ducts, for one exemplary way of assisting with holding the face cover member in place relative to the modular base unit, the modular edge cover members, and the modular corner cover members;

FIG. 3B is a front perspective view of the customizable partially-recessed modular cover member of FIG. 3A;

FIG. 3C is a front perspective view of a plurality of customizable partially-recessed modular cover members, comprising the single partially-recessed modular cover member of FIGS. 3A and 3B, vertically oriented dual-series and triple-series partially-recessed modular cover members, and horizontally oriented dual-series and triple-series, partially-recessed, modular base unit cover members, wherein each cover member further comprises four partially-recessed modular corner edge members, a plurality of vertical partially-recessed modular edge members, and a plurality of partially-recessed vented top and bottom modular edge cover members, wherein each portion of each modular cover member is optionally adapted for selection from a component supply adapted for use for readily customizable and recustomizable design covering of one or more partially-recessed modular base units, whether as a vertically-oriented series of such modular base units, a horizontally-oriented series of such modular base units, or a singular such modular base unit;

FIG. 3D is a plurality of rear perspective views of the plurality of customizable partially-recessed modular cover members of FIG. 3C, also showing from the rear that the face cover member is adapted for use with a fan coil-type embodiment of modular base unit of a hydronic system since there is duct work on the rear of the face cover member;

FIG. 3E is a rear perspective exploded view of a customizable partially-recessed modular cover member, wherein each portion of the modular cover member is adapted for selection from a component supply adapted for use for readily customizable and recustomizable design covering of a partially-recessed modular base unit also showing from the rear that the face cover member is adapted for use with a radiator version of a hydronic system since there is no duct work on the rear of the face cover member, and wherein there is provided an exemplary retaining system comprising curved slidable tabs for retaining the face cover member on the modular corner edge members;

FIG. 3F is a front view of a various face cover members coming in different sizes and having different decorative patterns on the face thereof;

FIG. 3G shows a plurality of rear perspective views of the plurality of customizable partially-recessed modular cover members of FIG. 3C, also showing from the rear that the face cover member is adapted for use with a radiator-type embodiment of a hydronic system since there is no duct work on the rear of the face cover member;

FIG. 4A is a front perspective view of a customizable fully-recessed modular cover member for covering a single fully-recessed modular base unit, comprising a single face cover member, wherein the modular cover member is optionally adapted for selection from a component supply adapted for use for readily customizable, and recustomizable design for covering of a singular fully-recessed modular base unit;

FIG. 4B is a rear perspective view of the customizable fully-recessed modular cover member of FIG. 4A, and further showing how the face cover member is able to be retained on the fan coil-type base unit with tabs engaging with portions of the fan coil-type base unit duct work;

FIG. 4C is a front perspective view of a plurality of customizable fully-recessed modular cover members, comprising the single fully-recessed modular cover member of FIGS. 4A and 4B, vertically oriented dual-series and triple-series fully-recessed modular base unit cover members, and horizontally oriented dual-series and triple-series fully-recessed modular base unit cover members, wherein each cover member comprises a face cover member, wherein each said face cover member is optionally adapted for selection from a component supply adapted for use for readily customizable and recustomizable design covering of one or more fully-recessed modular base units, whether as a vertically-oriented series of such modular base units, a horizontally-oriented series of such modular base units, or a singular such modular base unit;

FIG. 4D is a plurality of rear perspective views of the plurality of customizable fully-recessed modular cover members of FIG. 4C;

FIG. 4E is a front view of a various face cover members coming in different sizes and having different decorative patterns on the face thereof;

FIG. 4F is a front view of a various face cover members coming in different sizes for radiator-type hydronic systems;

FIG. 5 shows a side view of a base modular fan coil base unit piped as if it were a singular unit or a top unit, whether a non-recessed, partially-recessed, or fully-recessed modular fan coil unit, and showing how airflow passes through the modular fan coil unit.

Figure 6:
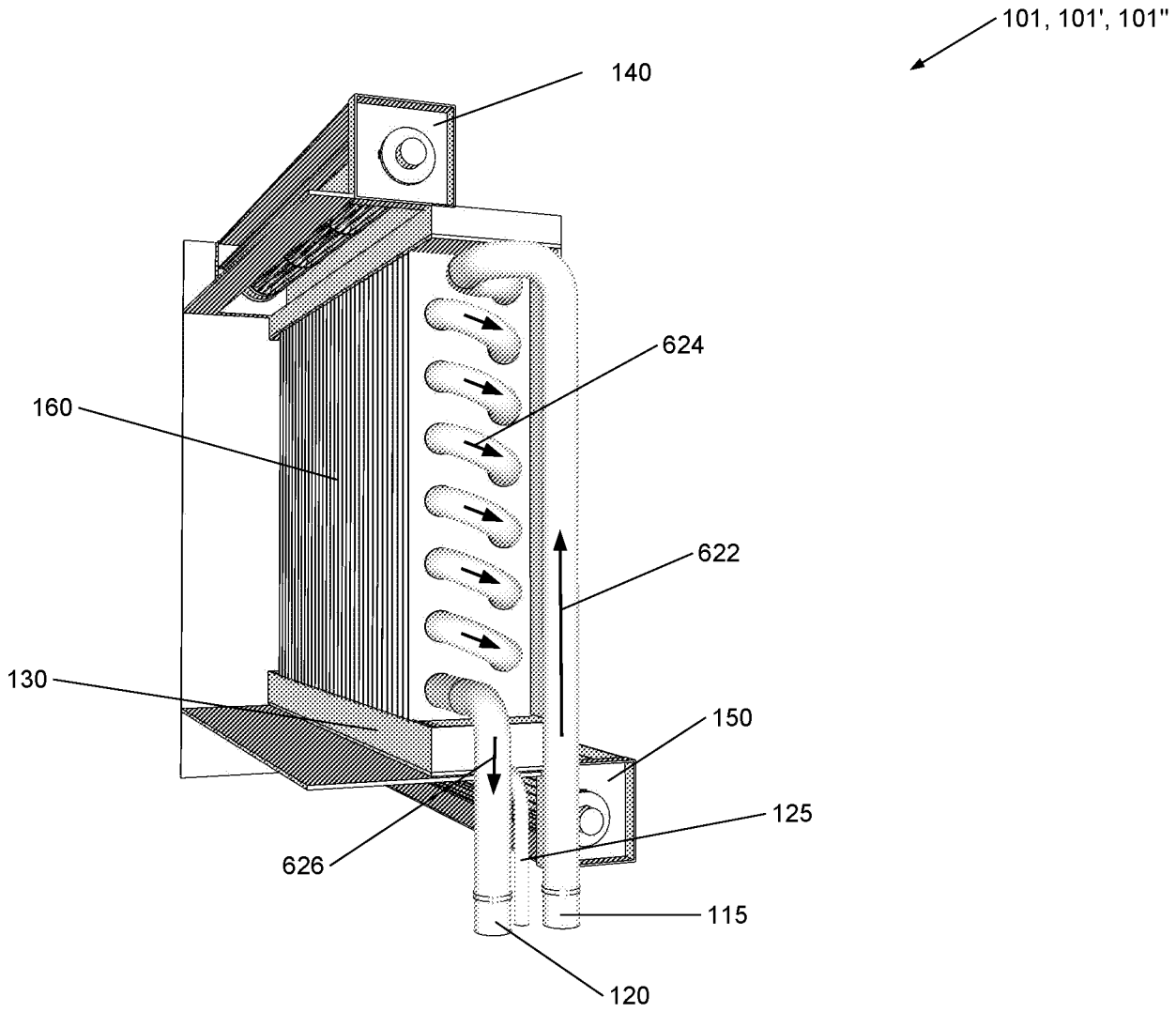

FIG. 6 shows a right front perspective of the modular fan coil base unit of FIG. 5.

Figure 7A:
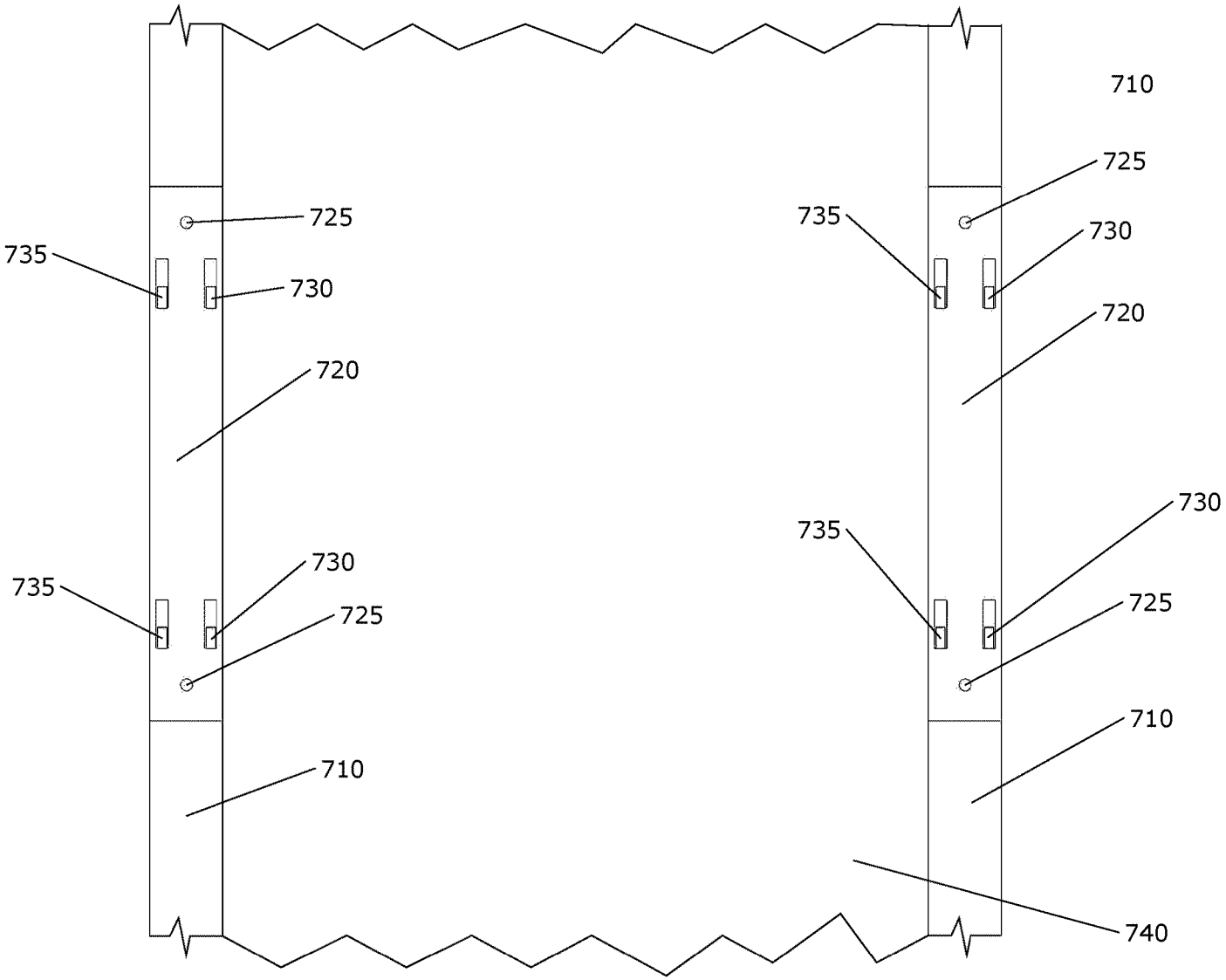
Figure 7B:
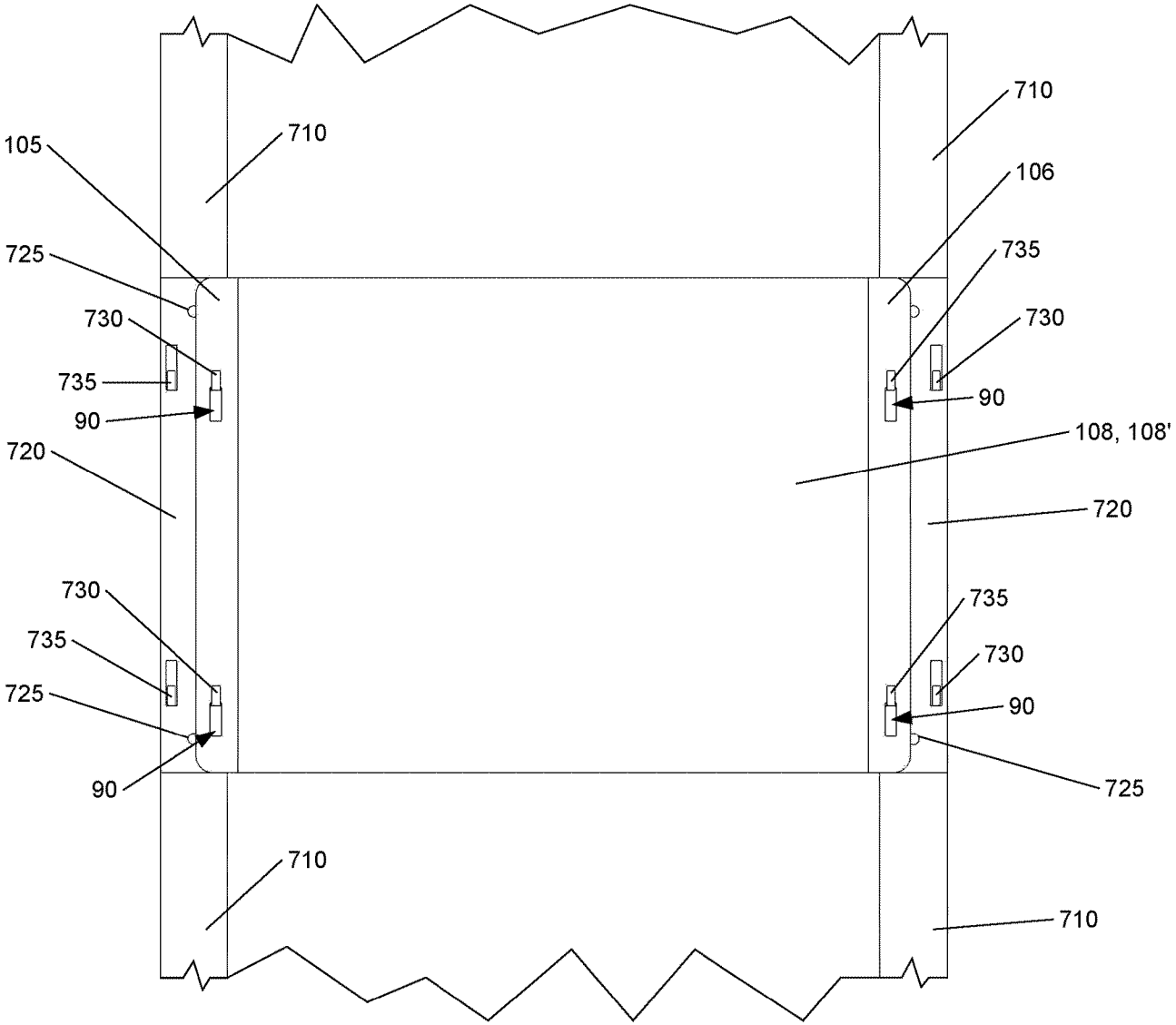
Figure 7C:
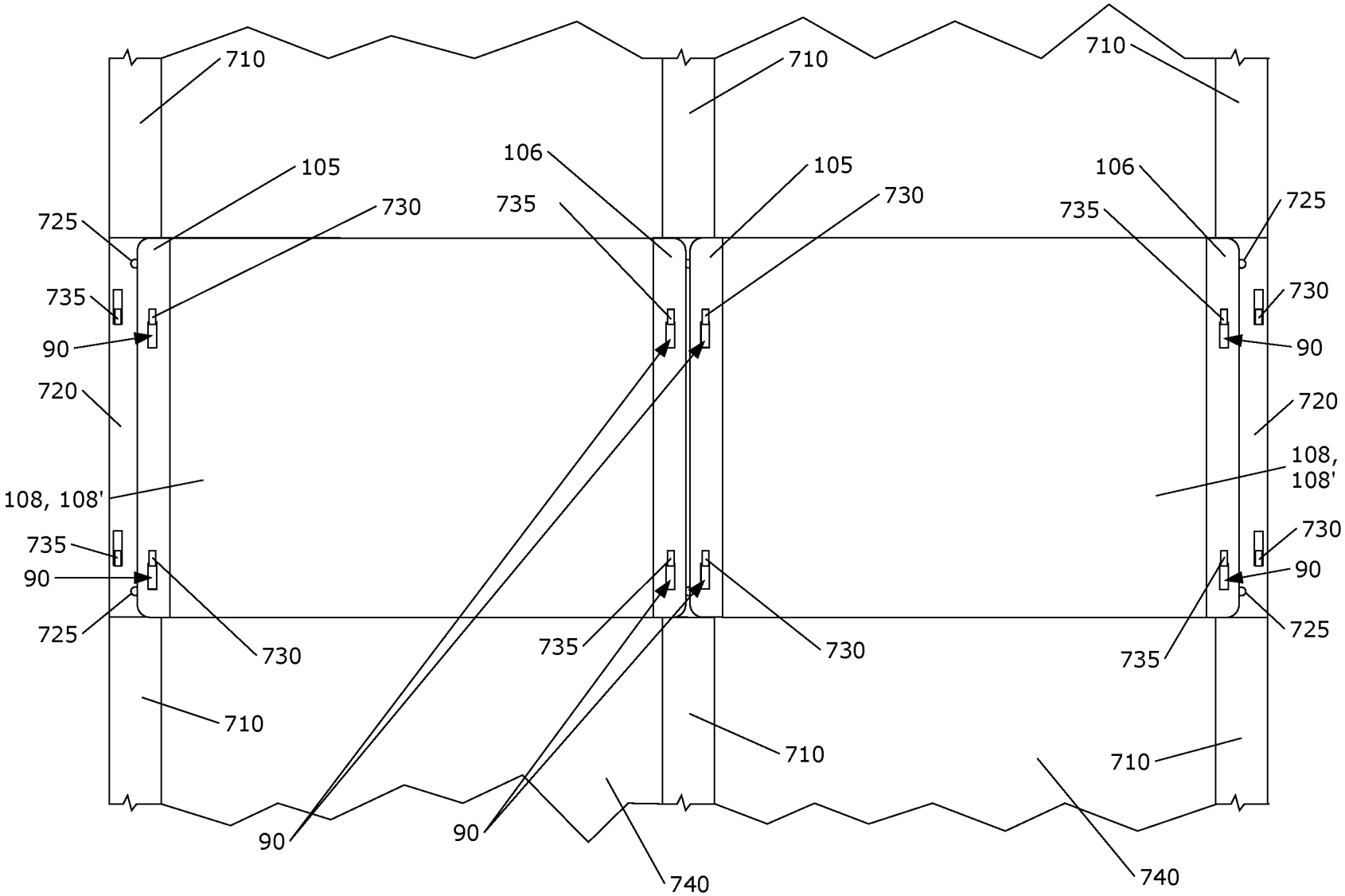
Figure 7F:
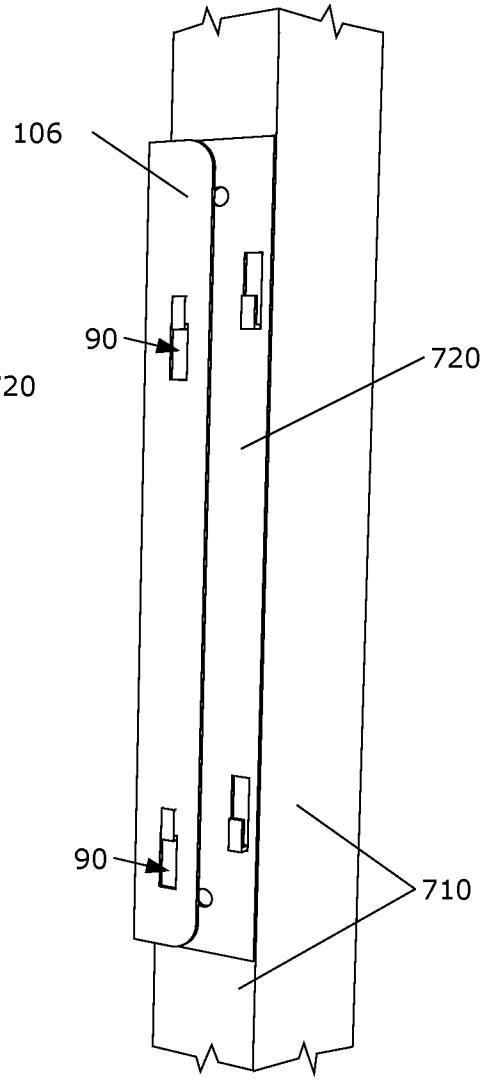
Figure 7E:
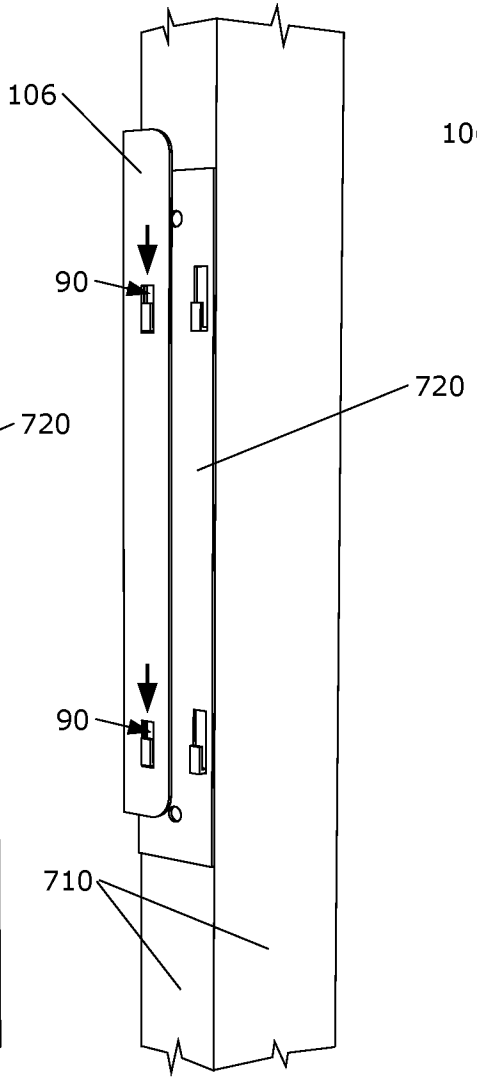
Figure 7D:
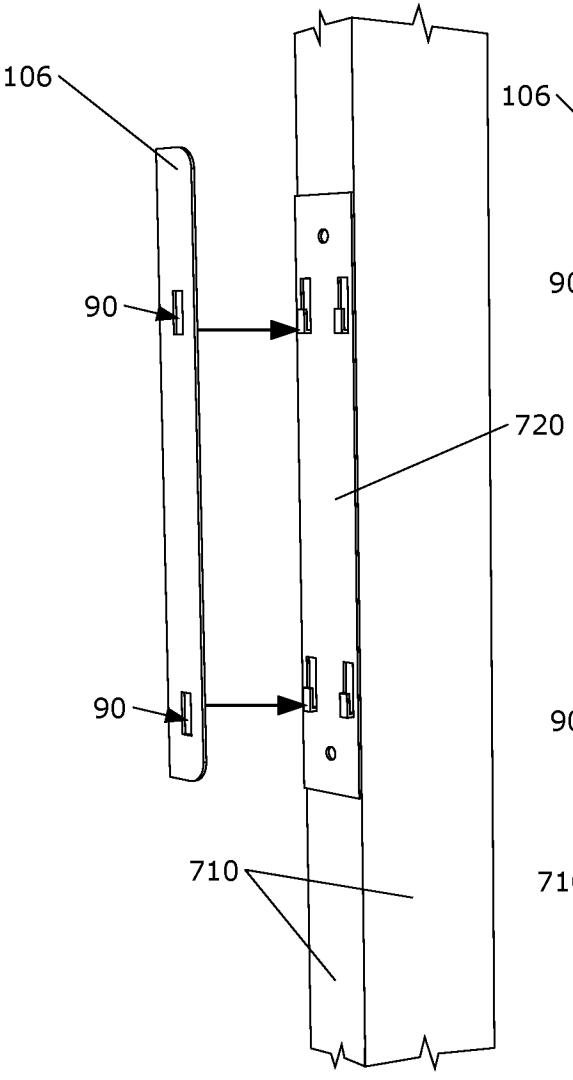
Figure 8A:
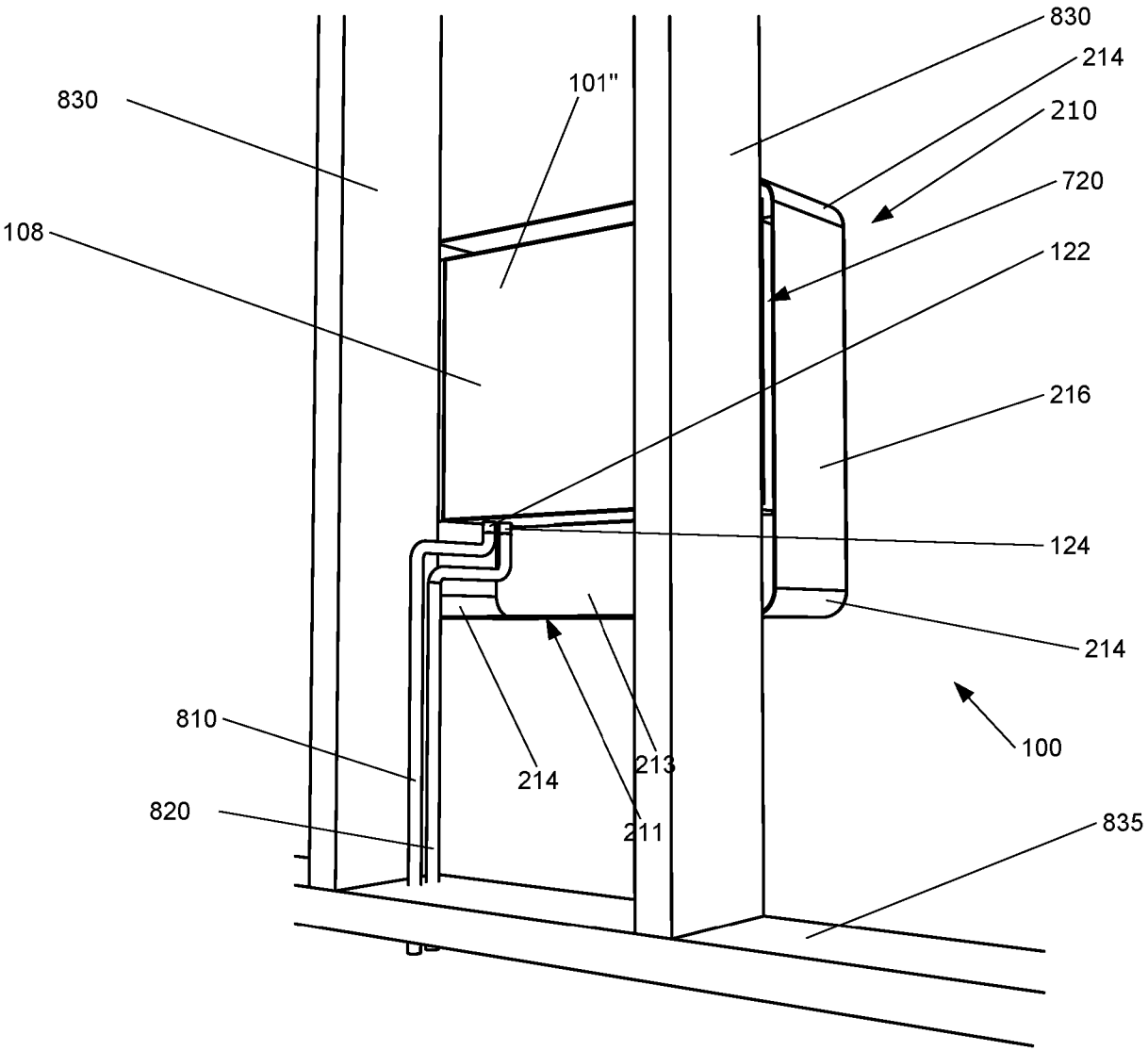
Figure 8B:
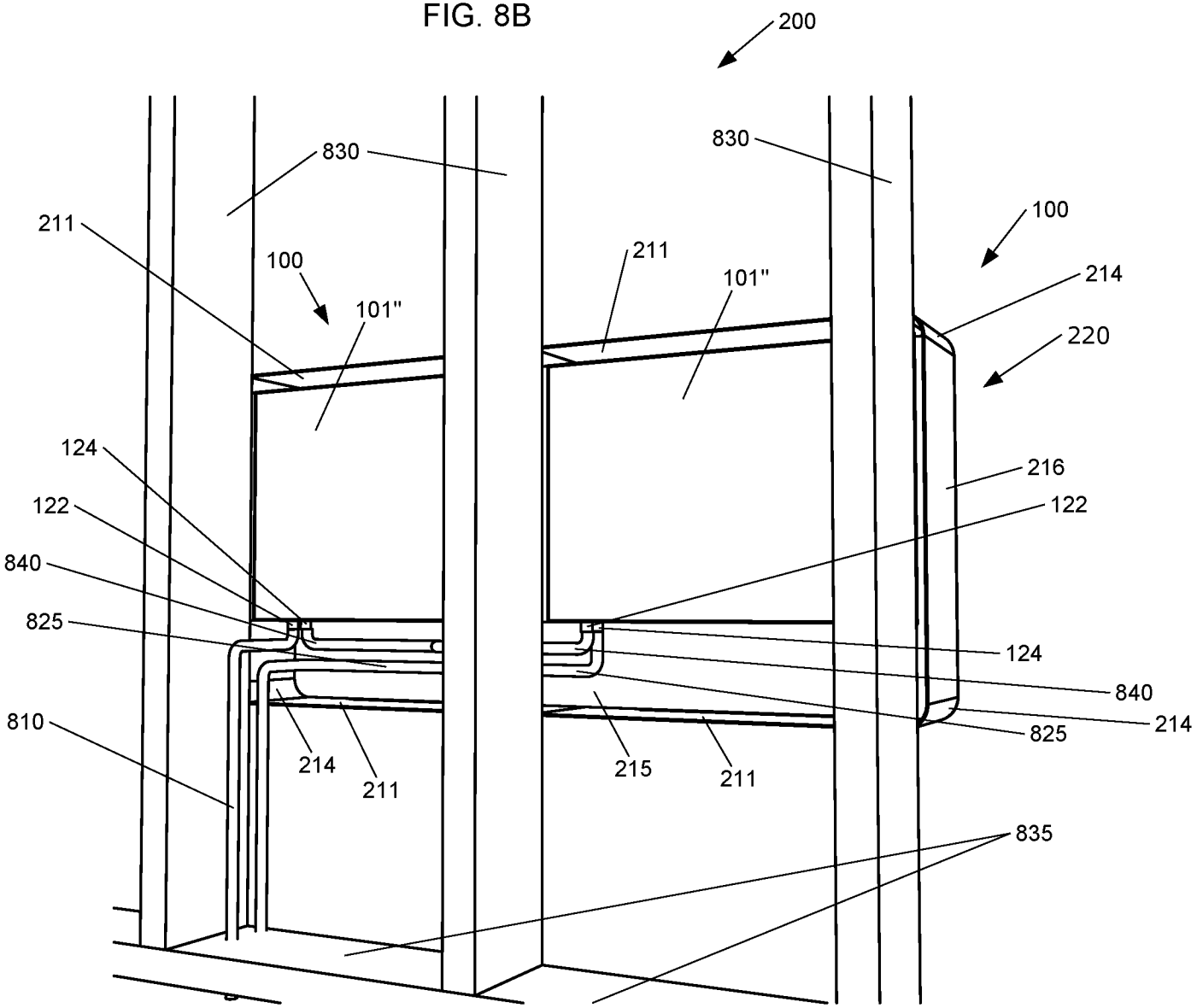
Figure 8C:
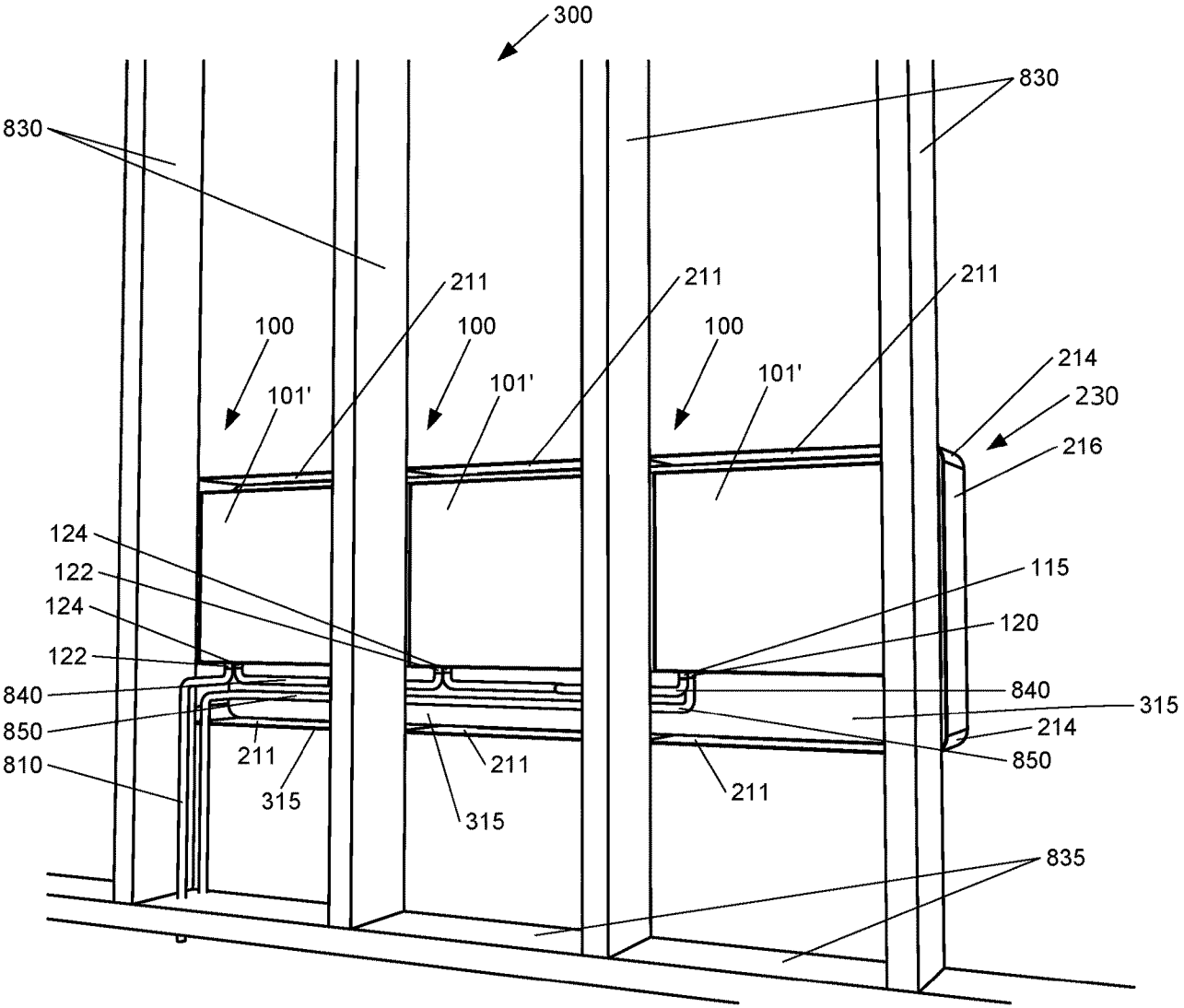
Figure 8D:
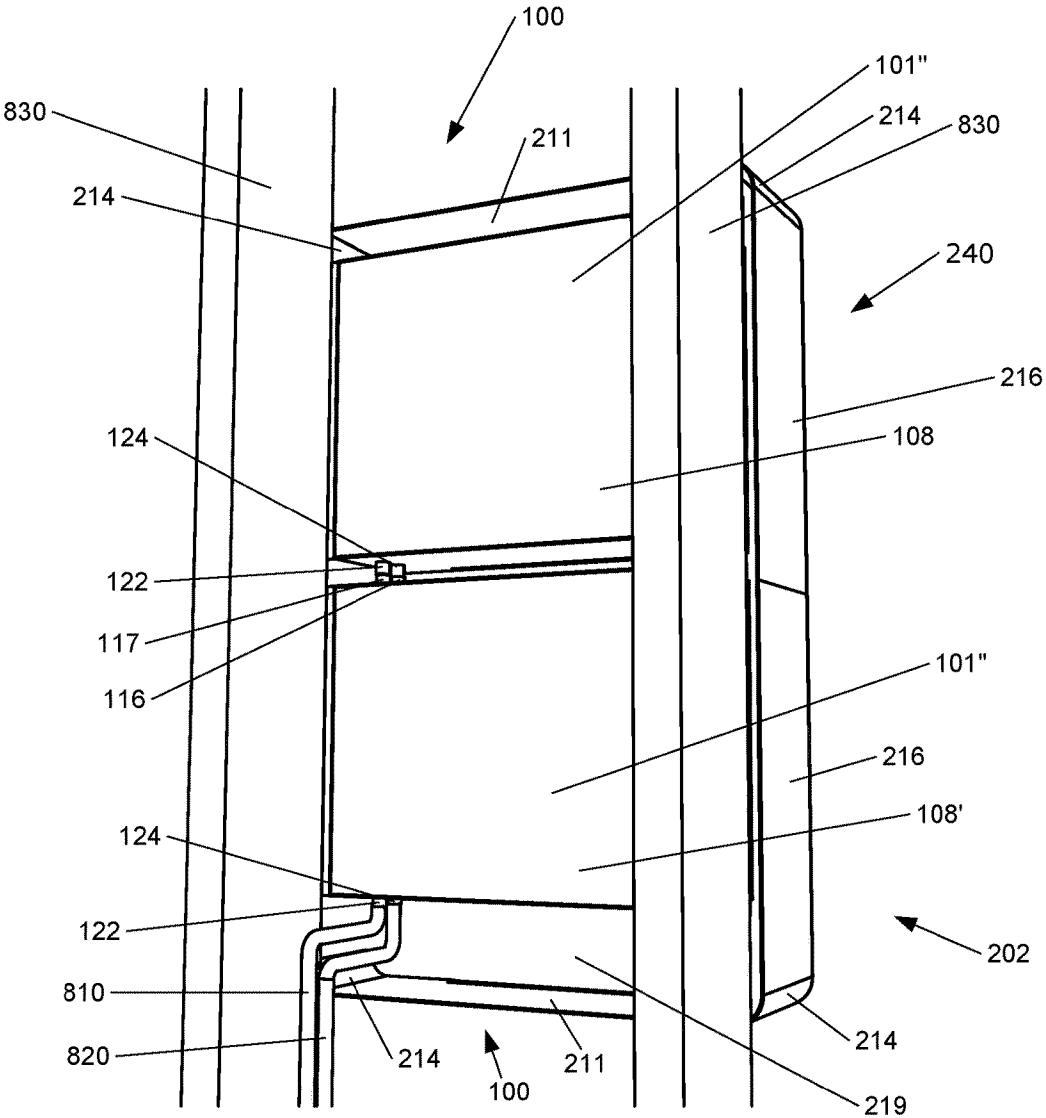
Figure 8E:
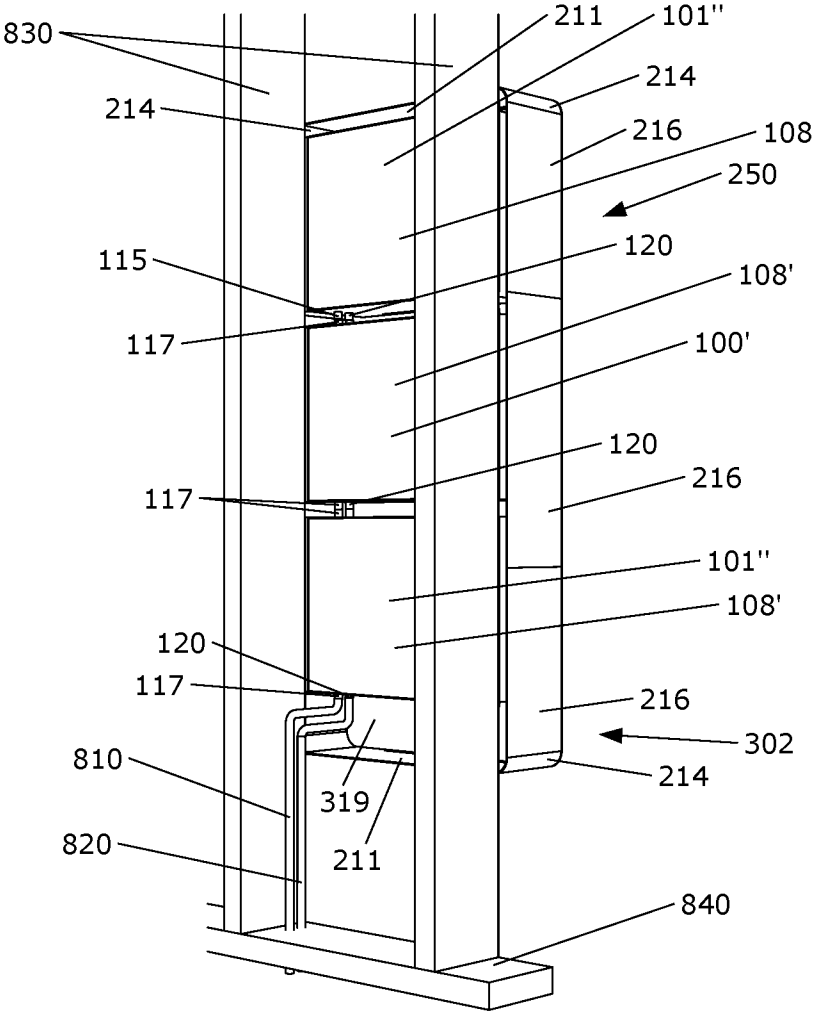
Figure 9A:
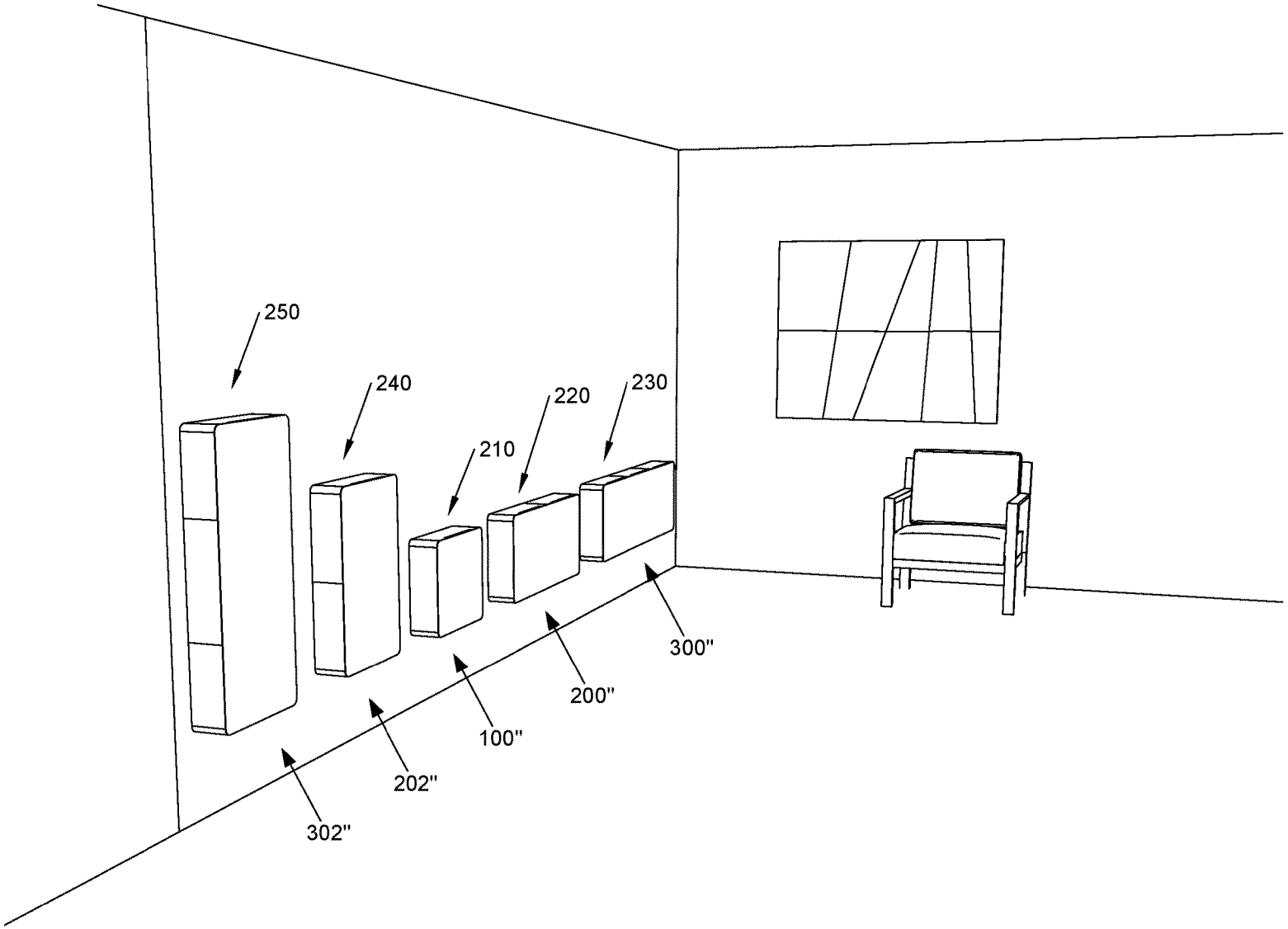
Figure 9B:
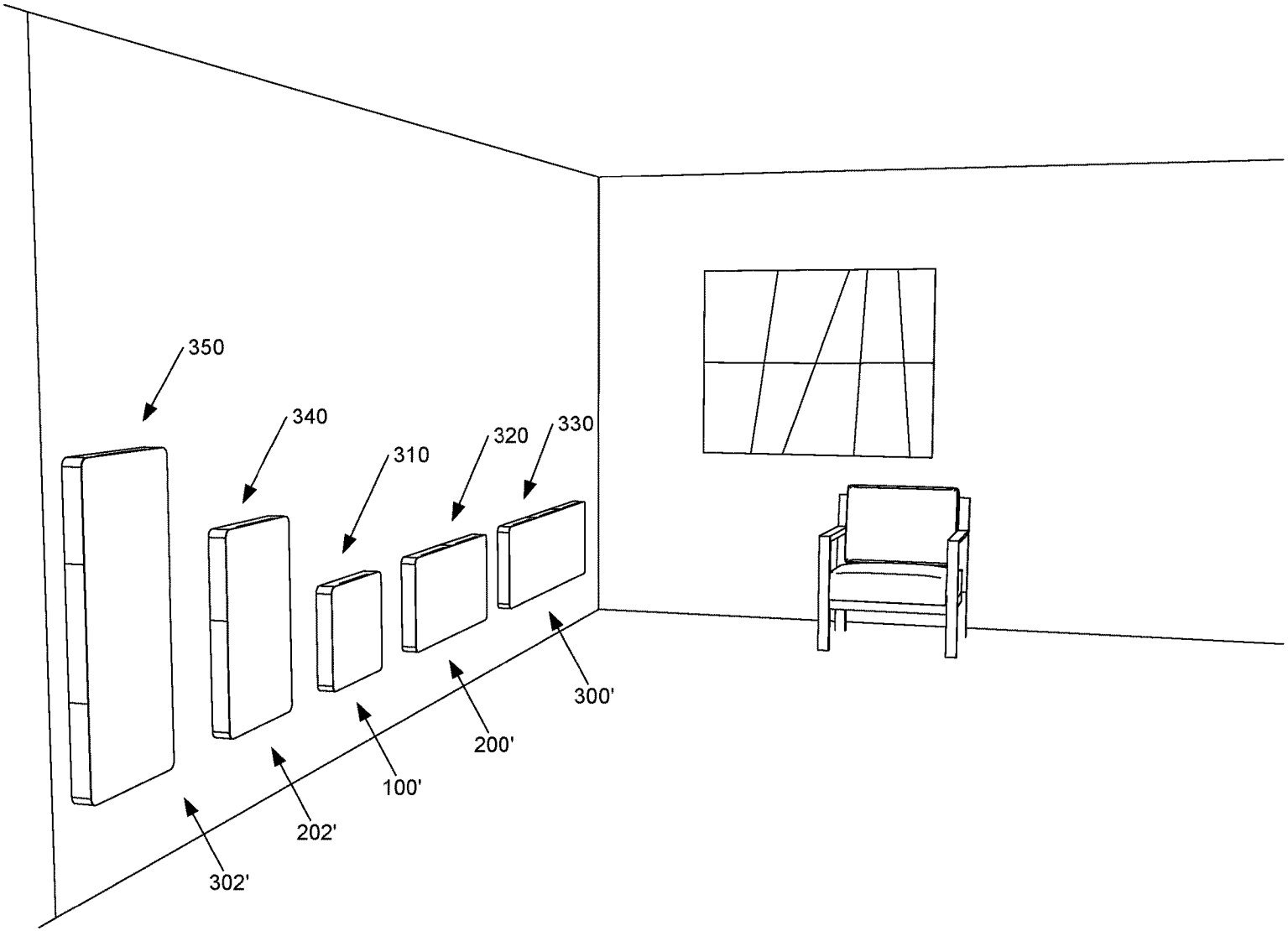
Figure 9C:
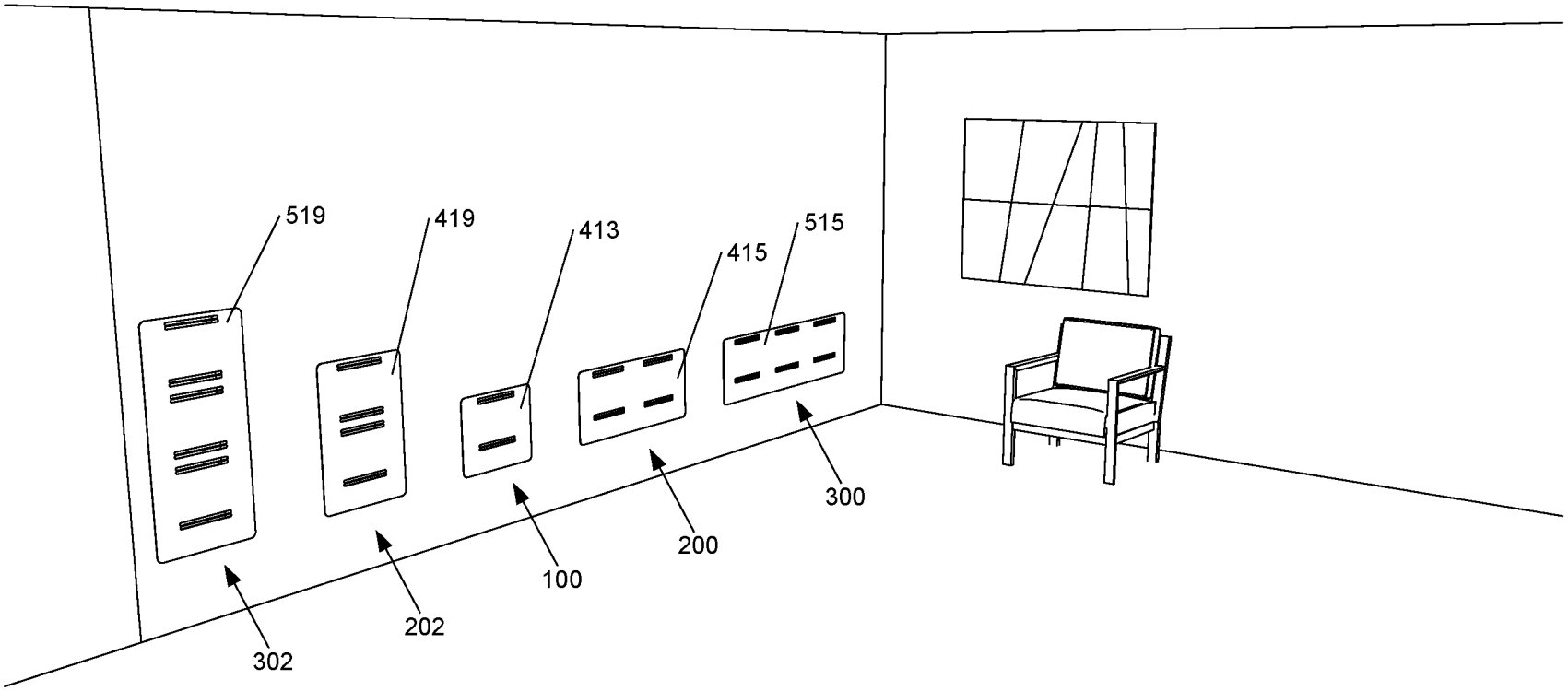
Figure 10:
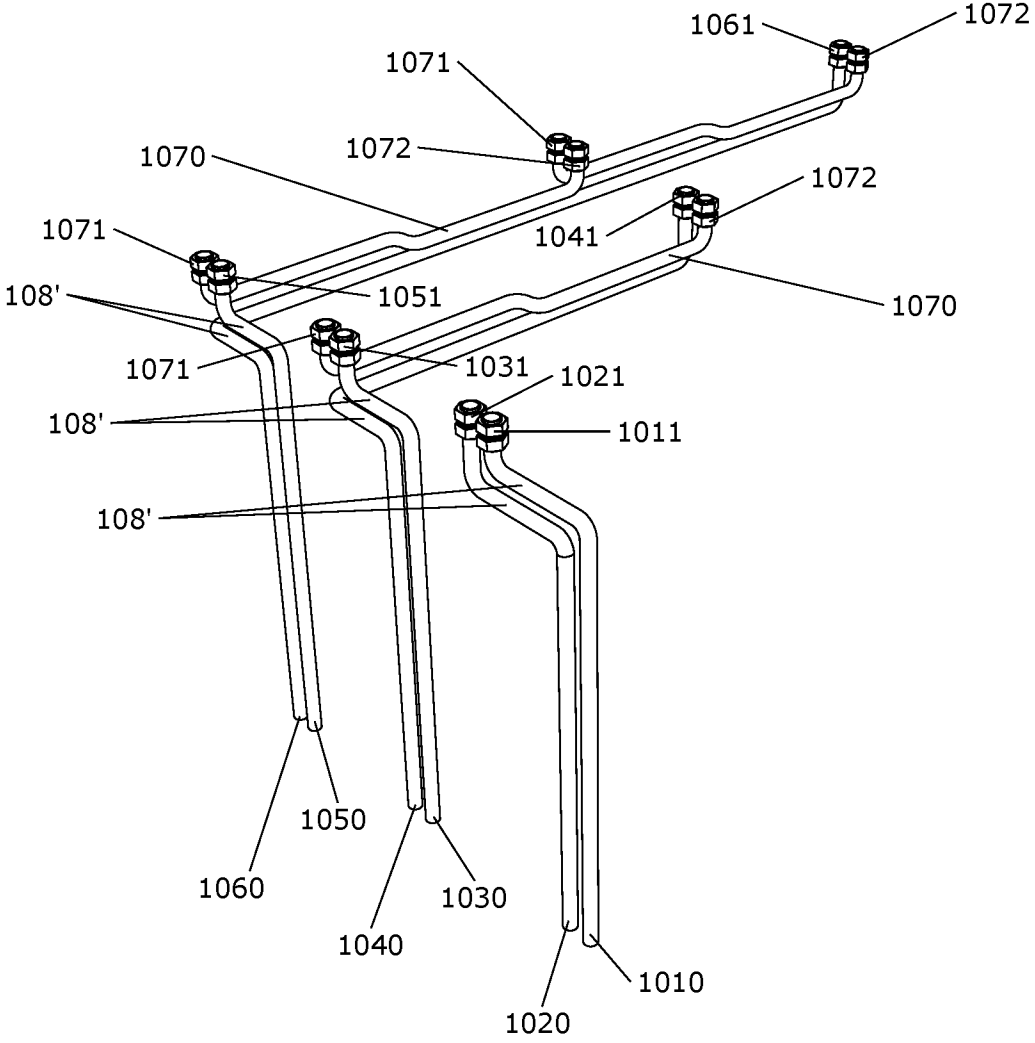
Figure 11:
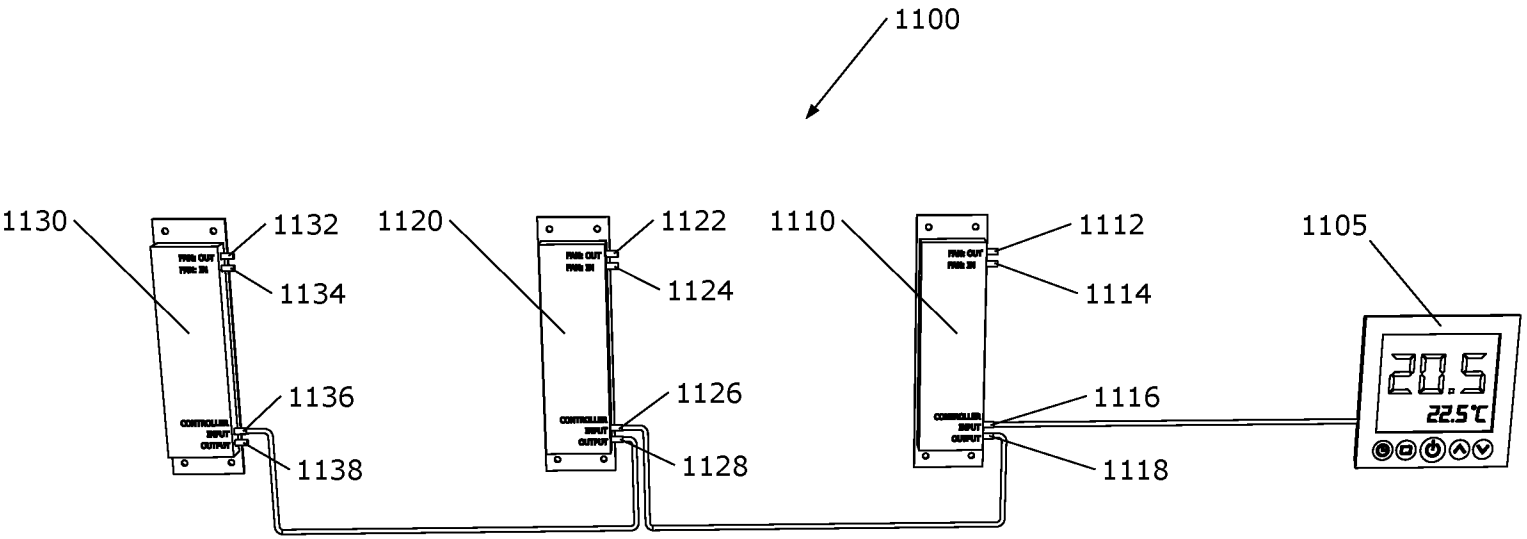
Figure 12:
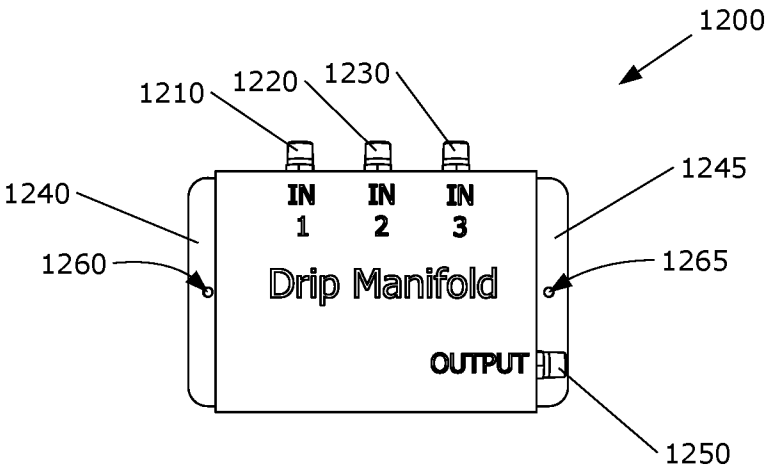
Figure 13A:
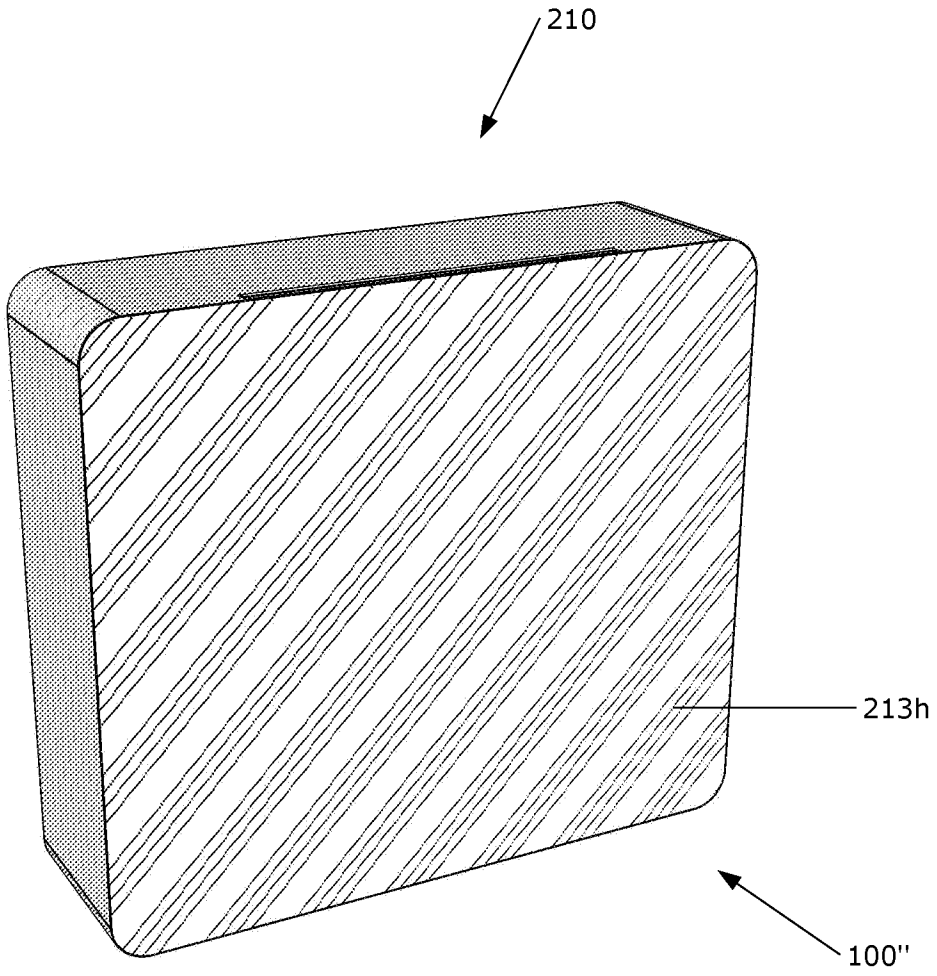
Figure 13B:
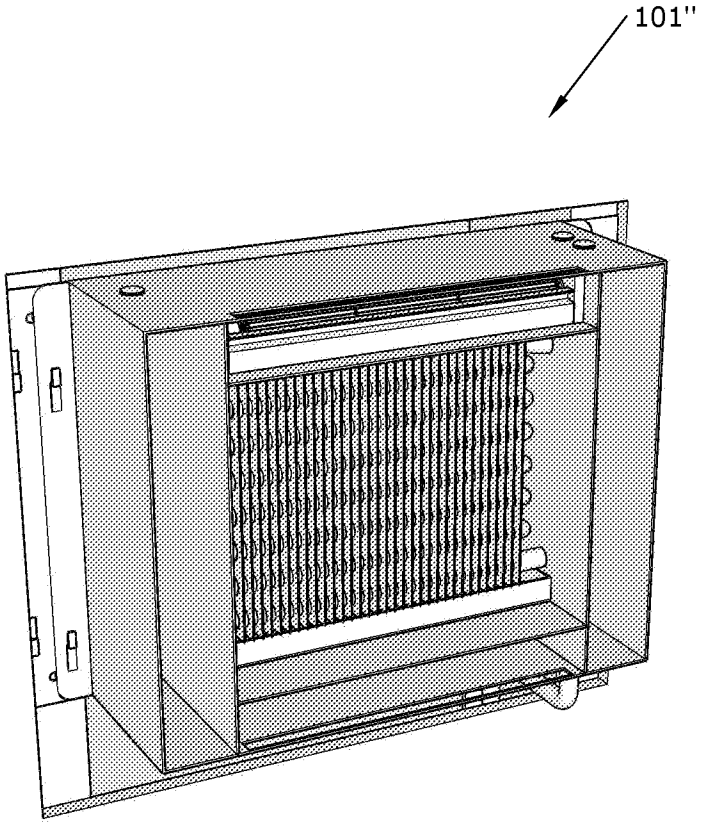
Figure 13C:
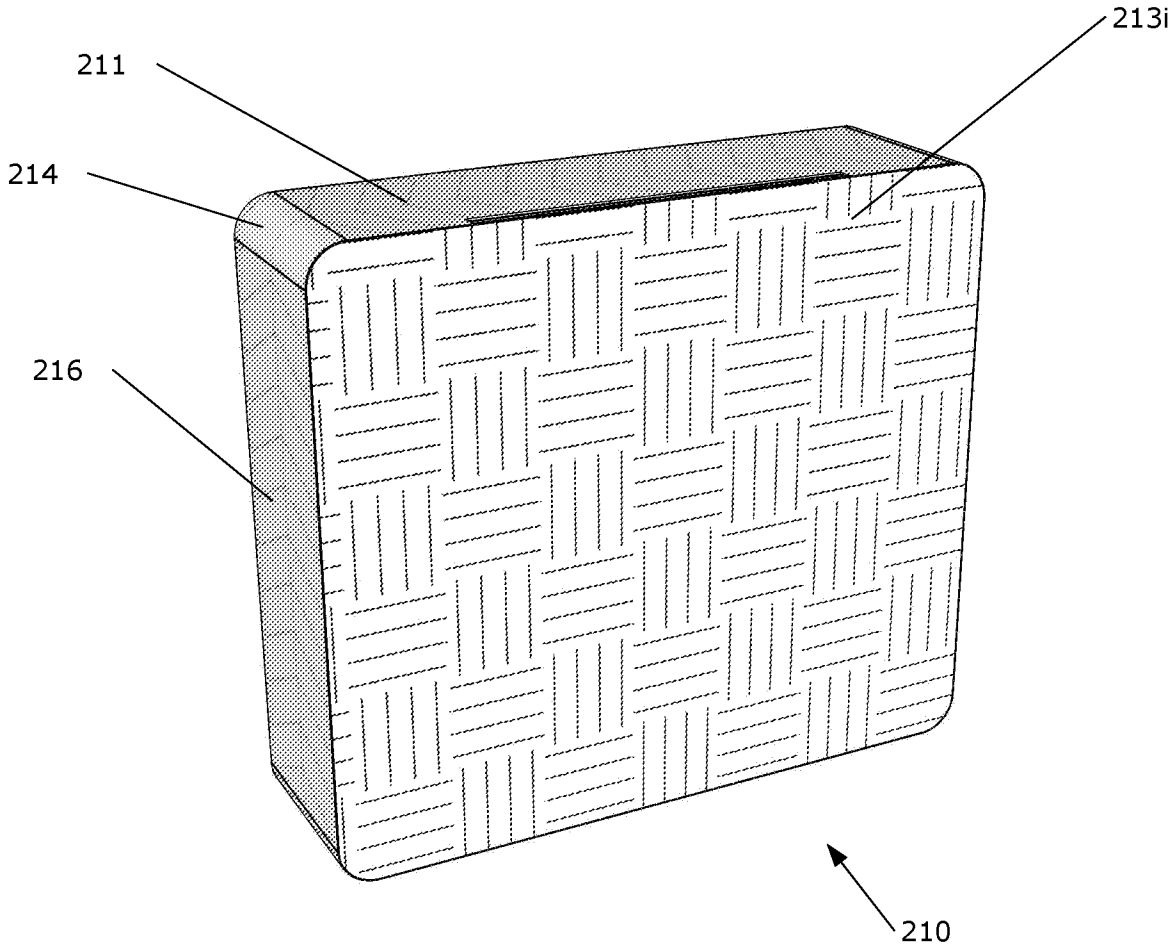
Figure 14A:
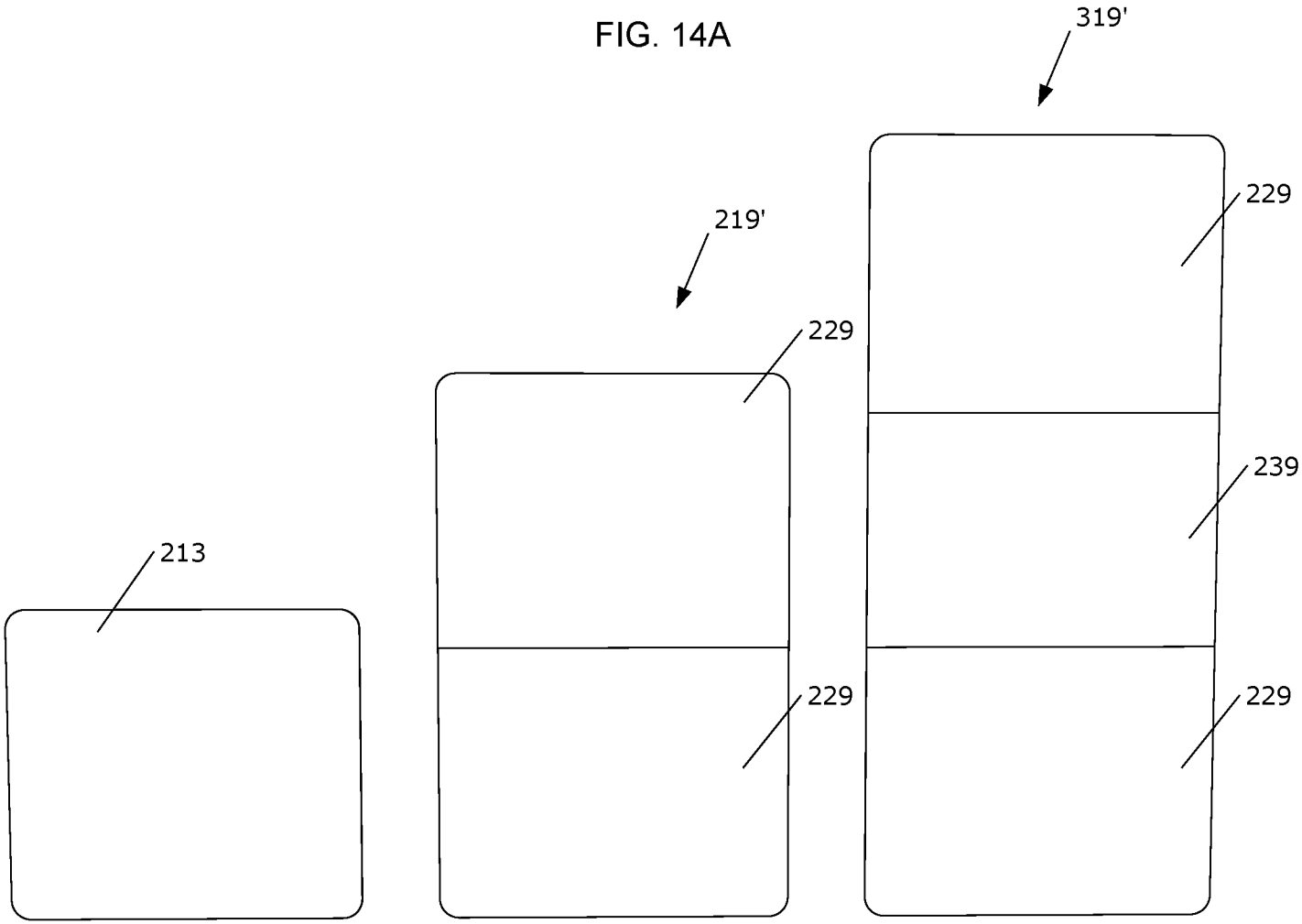
Figure 14B:
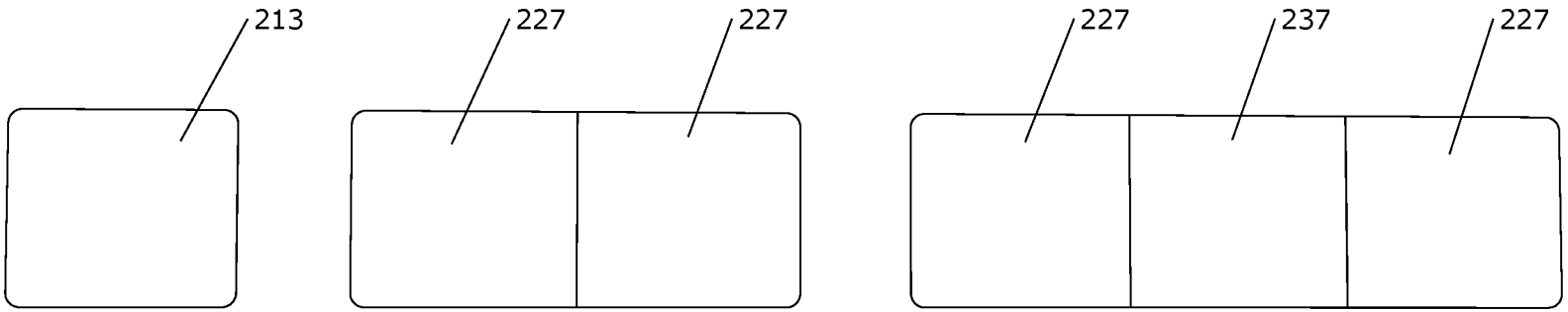

FIG. 7A shows a front view of brackets attached to studs for hanging a modular base unit, whether a non-recessed, partially-recessed, or fully-recessed modular base unit, and whether a fan coil-type modular base unit or a radiator-type of modular base unit;

FIG. 7B shows a front view of the brackets of FIG. 7A, but with a frame portion only (i.e., without showing the fan coil or radiator portion within the frame portion) of the modular base unit installed on the brackets;

FIG. 7C shows a front view of brackets like those of FIGS. 7A and 7B, but with frame portions of two side-by-side modular base units installed on the brackets;

FIGS. 7D-7F each show a right-side perspective view of a bracket like those of FIGS. 7A and 7B, but showing a frame portion of a modular base unit in various stages of a process of being installed on the bracket;

FIG. 8A shows a right rear perspective view of a non-recessed singular modular base unit system installed on studs, such as either a modular fan coil-type unit system or a modular radiator-type unit system, showing sheetrock removed to allow seeing how such a single unit system aligns with the studs and how piping may be accomplished to the modular base unit system without the pipes showing because they would be covered by the modular cover members;

FIG. 8B shows a right rear perspective view of a dual horizontally-aligned non-recessed modular base unit system installed on studs, such as either a modular fan coil-type unit system or a modular radiator-type unit system, showing sheetrock removed to allow seeing how such a dual unit system aligns with the studs and how piping may be accomplished to the dual non-recessed modular base unit system without the pipes showing because they would be covered by the modular cover members;

FIG. 8C shows a right rear perspective view of a triple horizontally-aligned non-recessed modular base unit system installed on studs, such as either a modular fan coil-type unit system or a modular radiator-type unit system, showing sheetrock removed to allow seeing how such a triple unit system aligns with the studs and how piping may be accomplished to the triple non-recessed modular base unit system without the pipes showing because they would be covered by the modular cover members;

FIG. 8D shows a right rear perspective view of a dual vertically-aligned non-recessed modular base unit system installed on studs, such as either a modular fan coil-type unit system or a modular radiator-type unit system, showing sheetrock removed to allow seeing how such a dual vertically-aligned unit system aligns with the studs and how piping may be accomplished to the dual vertically-aligned non-recessed modular base unit system without the pipes showing because they would be covered by the modular cover members;

FIG. 8E shows a right rear perspective view of a triple vertically-aligned non-recessed modular base unit system installed on studs, such as either a modular fan coil-type unit system or a radiator-type unit system, showing sheetrock removed to allow seeing how such a triple vertically-aligned unit system aligns with the studs and how piping may be accomplished to the triple vertically-aligned non-recessed modular base unit system without the pipes showing because they would be covered by the modular cover members;

FIG. 9A shows a front left perspective view of a plurality of different non-recessed modular heating/cooling systems in a room (including single-unit, double-unit, and triple-unit systems), illustrating how differently-designed modular cover members may be implemented as adapted for selection from a component supply adapted for use for readily customizable and recustomizable design coverings of such non-recessed modular base unit systems;

FIG. 9B shows a front left perspective view of a plurality of different partially-recessed modular heating/cooling systems in a room (including single-unit, double-unit, and triple-unit systems), illustrating how differently-designed modular cover members may be implemented as adapted for selection from a component supply adapted for use for readily customizable and recustomizable design coverings of such fully-recessed modular base unit systems;

FIG. 9C shows a front left perspective view of a plurality of different fully-recessed modular heating/cooling systems in a room (including single-unit, double-unit, and triple-unit systems), illustrating how differently-designed modular cover members may be implemented as adapted for selection from a component supply adapted for use for readily customizable and recustomizable design coverings of such fully-recessed modular base unit systems;

FIG. 10 shows an exploded view of an example series of modular piping adapted variously for a single base unit hydronic system, a dual-horizontal base unit hydronic system, and a triple-horizontal base unity hydronic system, wherein water inlets and outlets are shown as being similarly located regardless of whether it is a single, dual-horizontal, or triple-horizontal hydronic system, and wherein the dual-horizontal base unit system and the triple-horizontal base unit system are simply added to a single base unit system, or dual-horizontal base unit system, respectively;

FIG. 11 shows a representative wiring diagram for a triple modular base unit installation, wherein a thermostat sends signals to the first unit, and that unit passes the signal on to any subsequent units, allowing subsequent units (if any) to operate in unison;

FIG. 12 shows a condensation drip manifold to allow preferably flexible condensation drip lines from up to three different units to be received and combined into a single output condensation drip line;

FIGS. 13A-13C show a single base unit hydronic system in three different post-installation design states, wherein in FIG. 13A there is shown a system having a first design of cover member treatment, in FIG. 13B the first design cover treatment is removed showing that the modular base unit remains in-tact and functional, and in FIG. 13C there is shown the same system having a new design treatment, showing that the system is re-customizable, whether the base unit of the system is fully-recessed, partially-recessed, non-recessed (wall mount), all without having to take the base unit system off line;

FIG. 14A shows an alternative embodiment of modular face cover members for varying sizes of hydronic systems, wherein there is provided a single-unit cover member, a plurality of face cover members comprising a double-unit-vertical cover member, and a plurality of face cover members comprising a triple-unit-vertical cover member, wherein the face cover member for each system appears coherent and unitary, except for where there is a joint between portions of the cover members to be adapted to appear as a continuous looking surface;

FIG. 14B shows alternative embodiment of modular face cover members for varying sizes of hydronic systems, wherein there is provided a single-unit cover member, a plurality of face cover members comprising a double-unit-horizontal cover member, and a plurality of face cover members comprising a triple-unit-horizontal cover member, wherein the face cover member for each system appears coherent and unitary, except for where there is a joint between portions of the cover members to be adapted to appear as a continuous looking surface of the cover member; and FIGS. 15A-15E shows steps of methods of installation of the hydronic systems in accordance with one or more aspects of the disclosure.

DETAILED DESCRIPTION

Referring to FIGS. 1A-1E, there are provided various views of a modular base unit portion 101 of a customizable, modular, fan coil-type hydronic system 100, which may be adapted for use in an interior area, such as a house, micro-zone or a room, together with well-known connected hydronic components such as a reversible heat pump, a buffer tank, a pump, an air handler, or a boiler (not shown). The modular base unit 101 comprises a heat exchanger 160, with heat transfer fins 161, and within a modular base unit frame 108 adapted preferably for residing alone, or in series groups, such as for systems 200, 300, 202, 302, for example as shown in FIGS. 8B-8F, for greater heating/cooling needs, between studs of the room's wall Each modular base unit 101 comprises lower and upper vent holes 170, 175, an electronic controller 110, a drip pan 130, upper and lower air circulating fans 140, 150, with corresponding fan motors 145, 155, piping 115, 120, and a condensation drip line 125.

Figure 1A:
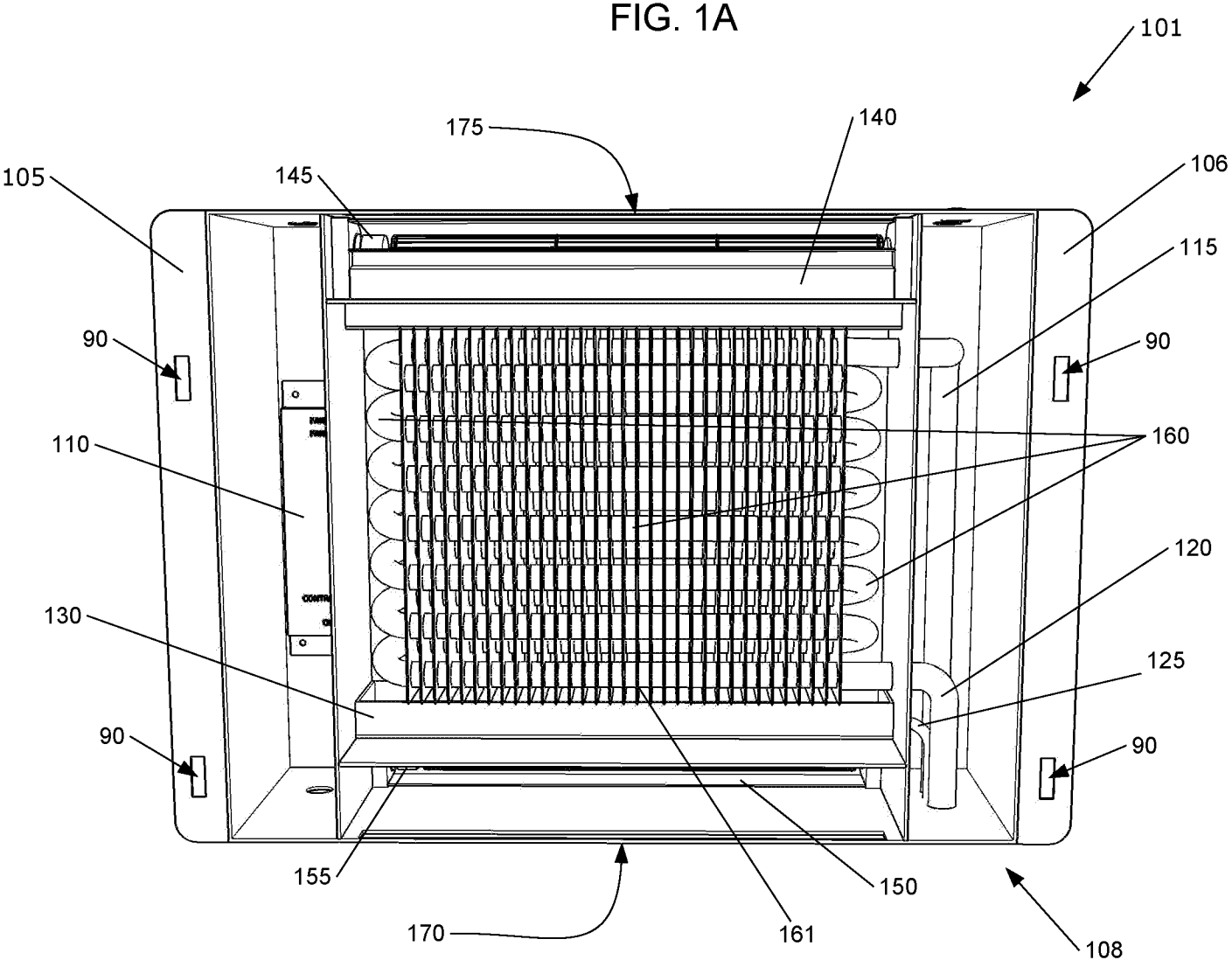
FIG. 1H is a front left perspective view of an embodiment of fan coil-type modular base unit, wherein modular base unit is fully-recessed between the studs of a wall.
FIG. 1I is a front left perspective view of an embodiment of fan coil-type modular base unit, wherein the modular base unit is partially recessed between the studs of a wall.
FIG. 1J is a front left perspective view of an embodiment of fan coil modular base unit, wherein the modular base unit is not recessed between the studs of a wall, but rather is mounted to the surface of the wall.
Figure 1B:
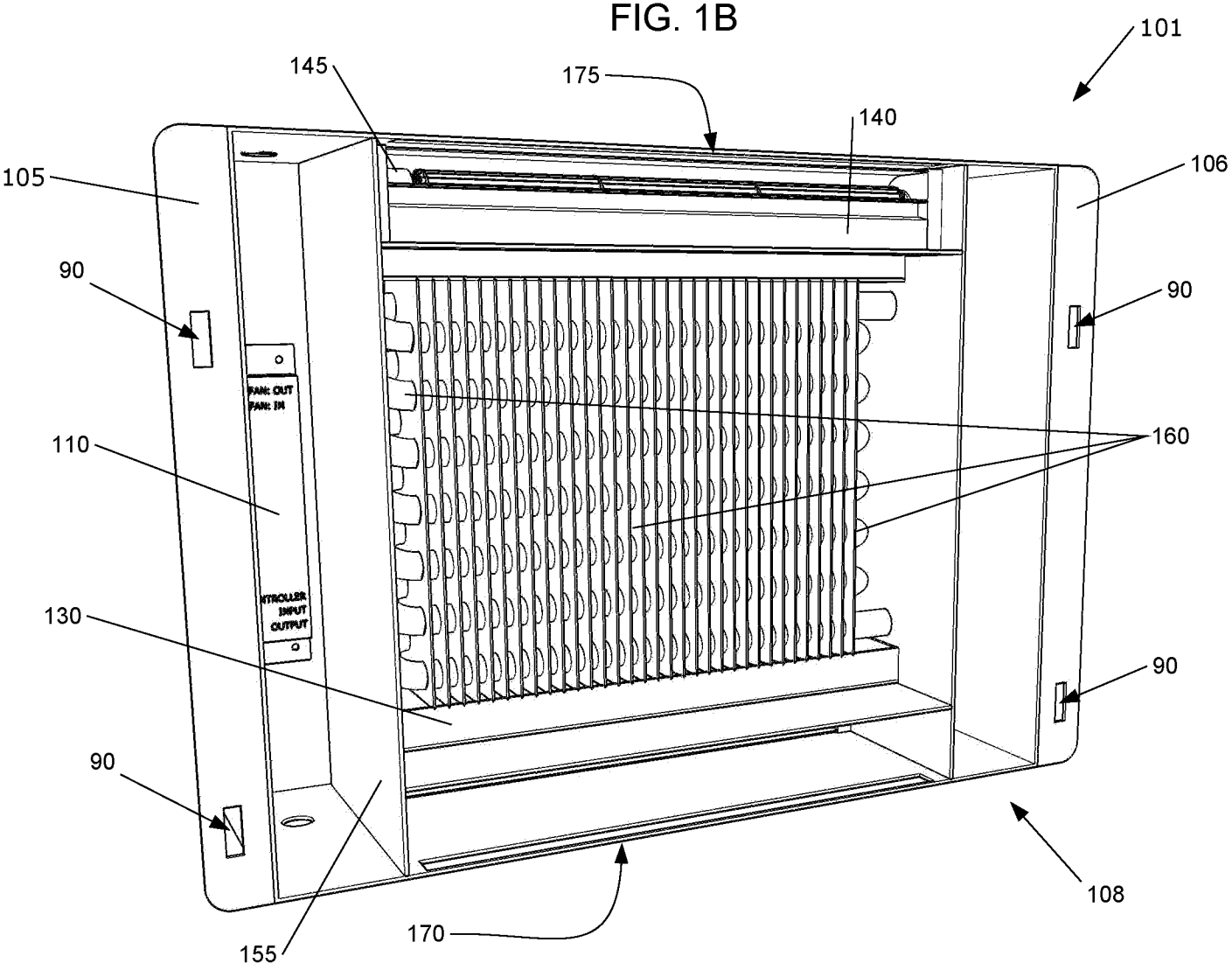
Figure 1D:
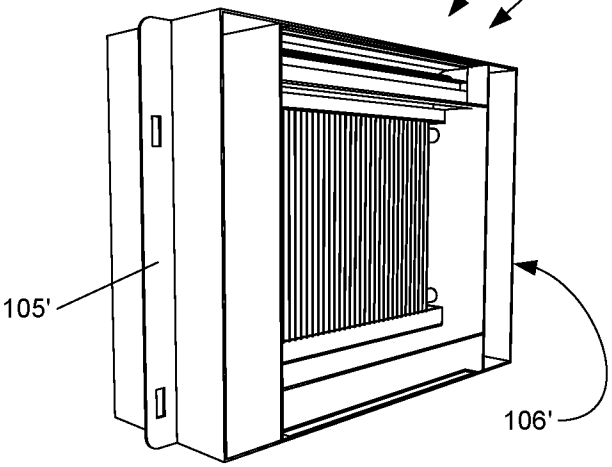
Figure 1E:
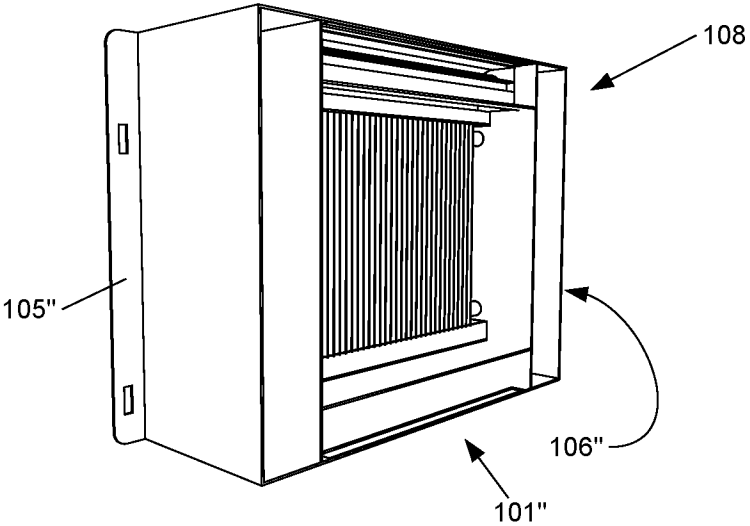
Figure 1C:
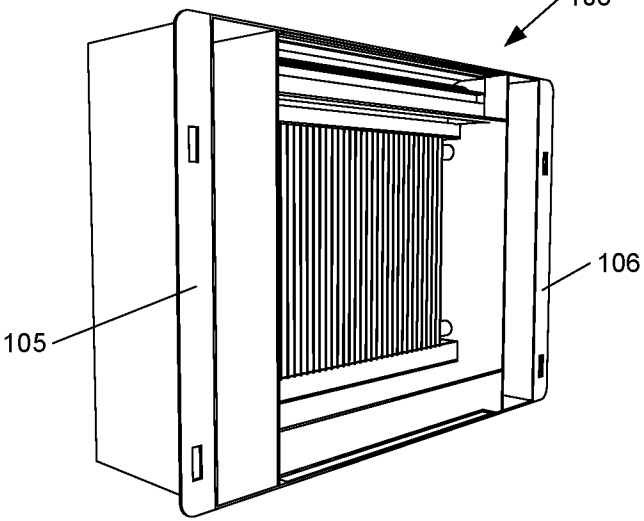

Referring more specifically to FIGS. 1A-1C, the modular base unit 101 of FIG. 1A further comprises flanges 105, 106 with slots 90 for fully-recessed attachment to brackets 720 on wall studs 710 (see e.g., FIGS. 1H and 7A-F), modular base unit 101' further comprises flanges 105', 106' with slots 90 for partially-recessed attachment to brackets 720 on wall studs 710 (see e.g., FIGS. 1I and 7A-F, and modular base unit 101" further comprises flanges 105", 106" with slots 90 for non-recessed attachment to brackets 720 on wall studs 710 (see e.g., FIGS. 1J and 7A-F).

Figure 1F:
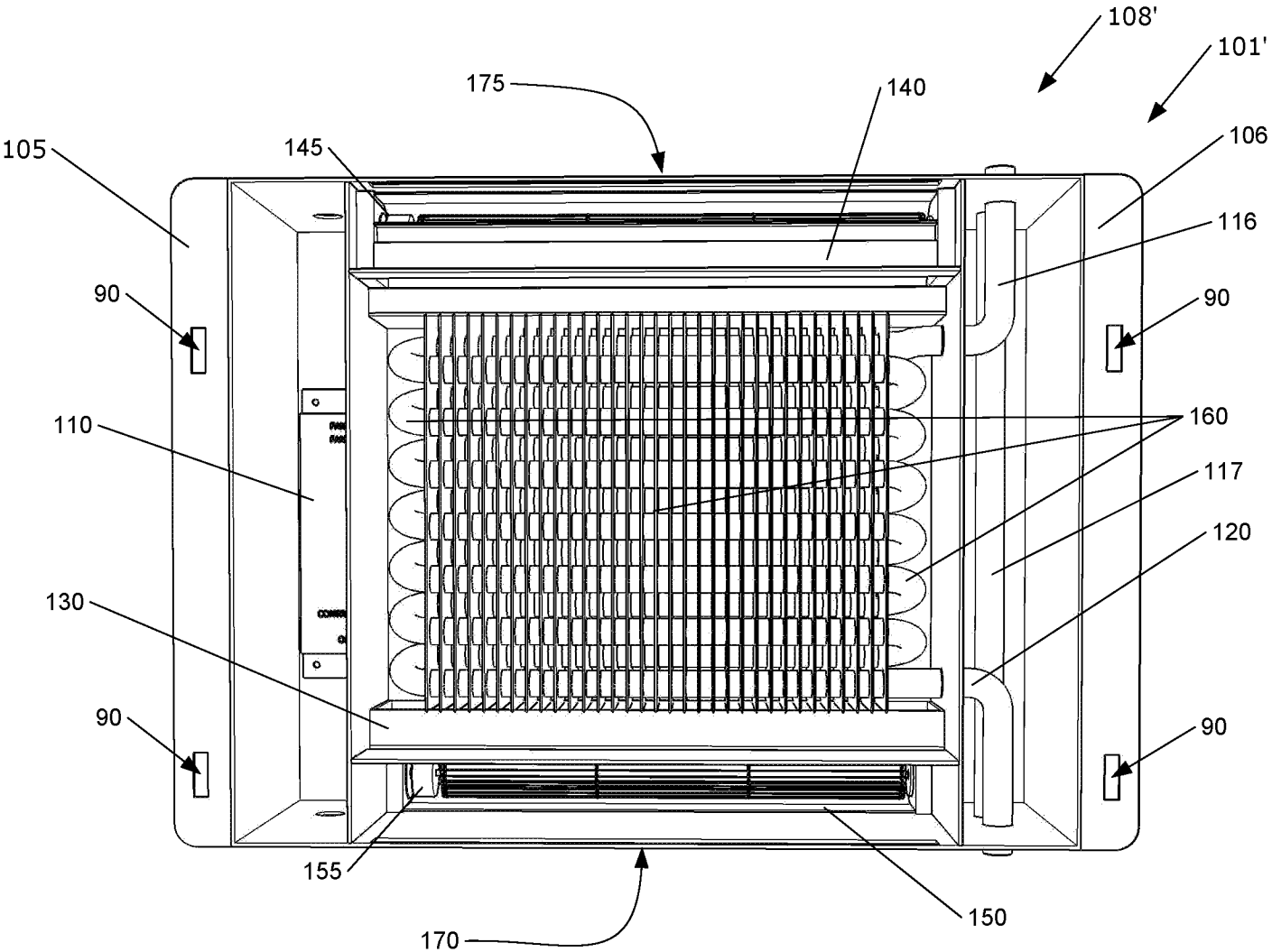
Figure 1G:
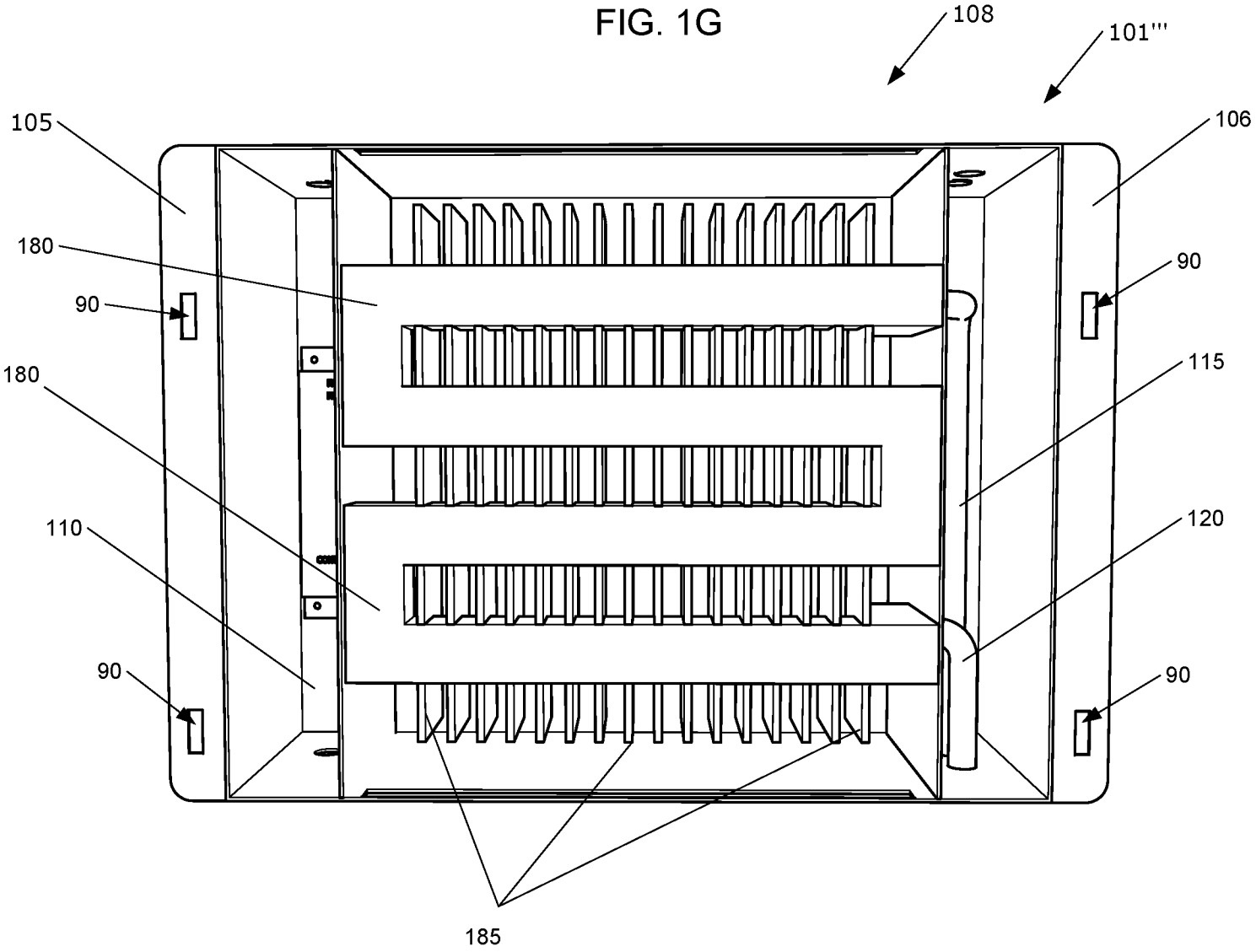
Figure 1H:
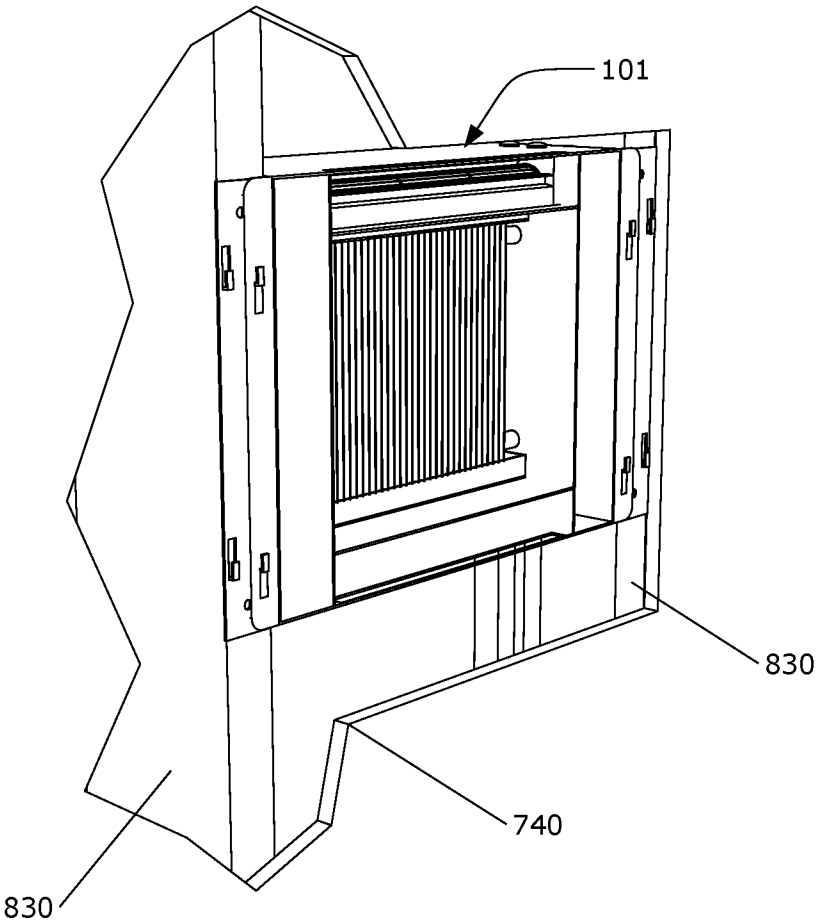
Figure 1I:
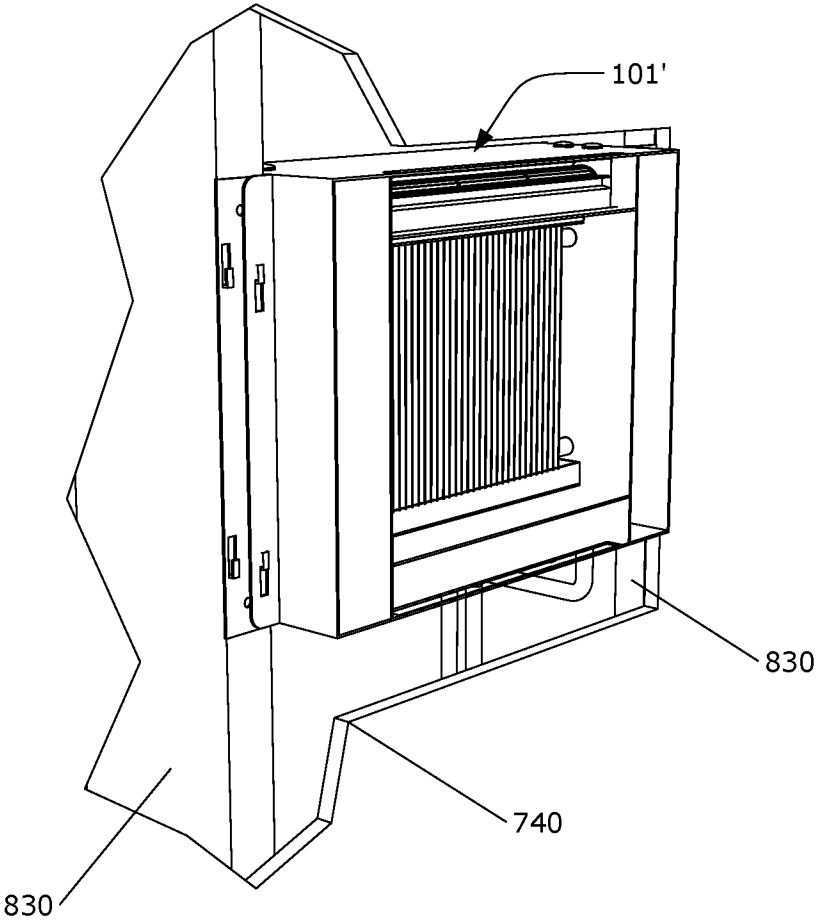
Figure 1J:
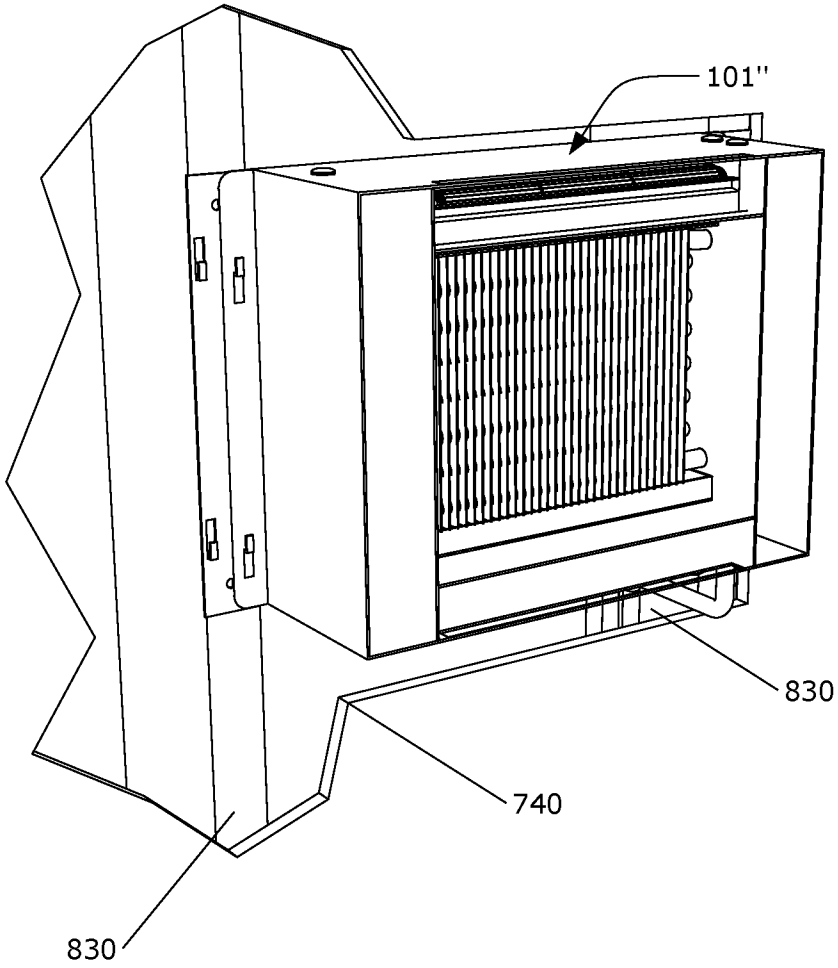

Thus, the base unit portion 101 of FIGS. 1C and 1H is adapted to be completely recessed in the wall between the studs, whereas the modular base unit portion 101' of FIGS. 1D and 1I is adapted to be partially recessed in the wall between the studs, and the modular base unit portion 101" of FIGS. 1E and 1J is adapted to be not recessed (though still residing between the plane of the studs), as in the case of a wall-mounted system 100, 200, 300, 202, 302.

Each modular base unit 101, 101', 101" is adapted for retaining heated, or alternatively cooled, hydronic fluid in the at least one heat exchanger 160 adapted for being circulated throughout modular base unit by the other connected hydronic components. Also, each modular base unit 101, 101', 101" is adapted for successive repeated linear implementation with an at least optional second modular base unit 101, 101', 101", respectively, preferably of like composition as shown for example in FIGS. 8B-8E. And, while it may not be preferable to combine a fully-recessed modular base unit 101 with a non-recessed 101", or partially-recessed 101', modular base unit, doing so would not necessarily depart from the scope of the system 100, 200, 300, 202, 302, as broadly claimed. Thus, the modular base units 101, 101', 101" are readily adaptable to expansion in use to meet increased heating and cooling needs of the room depending upon its size and other characteristics.

As shown in FIGS. 1A, 1F, and 10, there are provided different example frame 108, 108' and example piping configurations for various different configurations of system 100, 200, 300, 202, 302 capable of being designed using modular base unit 101, 101', 101". Thus, referring more specifically to FIG. 10, there are shown three different styles of piping: single unit piping 1010-1020 for a hydronic system 100, double unit piping 1030-1040 for a double horizontal hydronic system 200, and triple unit piping 1050-1060 for a triple horizontal hydronic system 300. The piping configuration 115, 120 of FIG. 1A is provided for a top-most modular base unit 101, 101', 101" of a multi-modular base unit hydronic system, and regarding a single modular base unit hydronic system 100, 100', 100" such piping 115, 120 is adaptable for connection to pipes 1010-1020 using connectors 1011, 1021. Piping configuration 117, 116, 120 of FIG. 1F is for an intermediate or lower-most modular base unit 101, 101', 101" of a multi-modular base unit hydronic system such as a double vertical system 202, or a triple vertical system 302, wherein the lower-most modular base unit is adaptable for connection to pipes 1010-1020 using connectors 1011, 1021. Referring additionally to FIGS. 1H-1J, it will be appreciated that for a wall-mount system 101" (as shown in FIG. 1J) the distance at 1081 in FIG. 10 would be longer, whereas for a partially-recessed system 101' (as shown in FIG. 1I) it would be shorter, and for a fully-recessed system 100 (as shown in FIG. 1H) it would be even shorter. Further, it will be appreciated that various modular components of piping and frame types may be mixed and matched to achieve basic designs of scalable systems from such modular frame and piping components.

Further, pipe 115 of modular base unit 101, 101', 101", 101" is typically used as a hydronic fluid inlet to a system, and pipe 120 of the modular base unit is typically used as a hydronic fluid outlet from the system. The small pipe 125 is provided as a condensation outlet tube.

In the case of a modular base unit 101'" of FIG. 1G, there is provided a radiator style modular base unit. Modular base unit 101" also comprises piping 115, 120, a controller 110, and flanges 105, 106, flanges 105', 106', or flanges 105", 106", depending on whether the modular base unit is adapted for fully-recessed implementation between wall studs, partially-recessed implementation, or non-recessed implementation, respectively and similarly to that described above in terms of the system being fully-recessed, partially-recessed, or non-recessed, by making use of slots 90 as further described in connection with FIG. 7B. In the case of the radiator style modular base unit 101", there are no air circulating fans, condensation drip pan, or condensation drip line, but the modular base unit 101" further comprises a radiator 180 for radiating thermal energy to a face cover member. Further, the various modular piping and frame type considerations discussed previously in connection with the fan coil-types of systems 100, 200, 300, 202, 302 above would apply to similar systems of radiator-types of systems.

Referring to FIGS. 2A-2F, the system 100, 200, 300, 202, 302 comprises a preferably composite cover member 210, 220, 230, 240, 250, respectively, each comprising a plurality of side edge cover members 216, and a plurality of top and bottom cover members 211 having lower and upper vent holes 270, 275 corresponding with vent lower and upper vent holes 170, 175 of frame member 108, 108' to allow the passage of air therethrough from the fans 140, 150. There are also provided a plurality of, for example four, edge corner members 214. Each cover member 210, 220, 230, 240, 250 further preferably comprises a modular face cover member 213. The edge cover members 211, 216 and the edge corner members 214 may be held together with mating tabs 252 on each edge cover member and corner member allowing screwing or otherwise fastening together of the edge cover members and corner cover members. Further, as shown in FIG. 2E, there are provided tab insert members 254 adapted as one exemplary way to interconnect the face cover member 213 and the edge corner members 214, and hence the other edge members 211, 216.

Overall, the cover member 210, 220, 230, 240, 250 is adapted to be secured to the modular base unit 101, 101', 101", 101" by way of lower and upper duct members 220, 225 for channeling airflow from the fans 140, 150 to the lower and upper vent holes 270, 275. The duct members 220, 225 of FIG. 2A are held in place, for example, by screws and tabs 261, and they provide one exemplary way of holding the cover member 210, 220, 230, 240, 250 in place relative to the modular base unit, since the duct may be inserted into front portions of upper and lower cavities of frame 108, 108' for retaining the fan members 140, 150. The face cover member 213 further comprises a peripheral edge 217. The peripheral edge 217 may optionally have curved corners to be adapted for use with a single modular base unit 101, 101', 101", 101". Or, the peripheral edge 217 may be optionally adapted for use with an at least optional second modular face cover member 213 in case an optional second modular base unit 101, 101', 101", 101", or third modular base unit, is included in a linear configuration as shown in optionally in FIGS. 14A-14B, depending upon the particular heating and cooling needs of the interior space.

Preferably, however, there are provided modular unitary face cover members 213, 215, 315, 219, 319, each corresponding to a single face cover member (213), a double horizontal face cover member (215), a triple horizontal face cover member (315), a double vertical face cover member (219), and a triple vertical face cover member (319). As may be seen in FIGS. 2A-2F and 3A-3F, these face cover members 213, 215, 315, 219, 319 may be modularly applicable whether the hydronic system is a partially-recessed system 100' or a non-recessed system 100".

Further, as may be seen in FIGS. 3A and 3E, there are provided differently-sized edge cover members 311, 316 and corner edge cover members 314, since these cover members for a partially-recessed system 100' would be narrower than for a non-recessed system 100". And, of course, for a fully-recessed system 100 there are not needed any edge cover members or corner edge cover members.

Thus, in the case of partially-recessed and non-recessed systems 100', 100", there are provided a plurality of contiguous modular edge members 211, 216 and a plurality of modular corner edge members 214 adapted for being interconnected around and relatively to one or more of the peripheries of the modular face cover member 213, 215, 315, 219, 319, or alternatively any second face cover member 213. These modular edge members 211, 216, and modular corner edge members 214 are contiguous in the sense that they align so as to almost appear as though they are a singular, or integral, member, when in fact they are actually comprised of a plurality of modular edge members. Thus, preferably, the plurality of modular edge members 211, 216, and each of the plurality of modular corner edge members 214, form, singularly or in combination with other cover members working all together to form a seemingly integral face cover member 210, 220, 230, 240, 250, 310, 320, 330, 340, 350 (see FIGS. 2C, 2D, 2E, 2G, 3C, 3D, 3E, 3G). The duct members 220, 225 of FIGS. 2A, 2E, 3A, and 3E are held in place, for example, by screws and tabs 261, and they provide one exemplary way of holding the cover member 210, 220, 230, 240, 250, 310, 320, 330, 340, 350 in place relative to the modular base unit, since the duct may be inserted into front portions of upper and lower cavities of frame 108, 108' for retaining the fan members 140, 150.

The modular edge members and the modular corner edge members may be provided in varying color schemes and exterior pattern designs to give interior designers plenty of options when incorporating the hydronic unit into the existing or changed interior designs of the room. Thus, unlike prior art systems, there is made available the ability to design systems using a plurality of different component supplies (i.e., silver edge members, red edge members, and/or floral pattern face cover members—thus the numbers of possible color combinations for components is great). Such plurality of modular edge members, and the plurality of modular corner edge members, thus form an aesthetically coherent design cover member, irrespective of colors and ornamental designs, for the hydronic system. Still further, the first modular face cover member and the at least optional second contiguous modular face cover member are adapted to be re-customized to achieve one or more alternative other aesthetically coherent designs, irrespective of colors and patterns, for the hydronic system, should the needs of the room change, should the room be remodeled, should new owners with new preferences come along, or simply should the owners change their minds.

In this way, there are provided modular base units, modular face cover members, edge cover members, and corner cover members, all capable of being selected from any of a plurality of component supplies, thus allowing for modular components being combined to allow simple customization and re-customization of hydronic systems.

Each modular face cover member 213 may comprise peripheral edges 217, wherein each of the peripheral edges is adapted to be readily customized to achieve, singularly or in combination with other peripheral edges of other face cover members 213, 215, 315, 219, 319, or edge cover members 211, 214, 216, to form an aesthetically coherently designed looking cover member for the hydronic system 100, 200, 300, 202, 302.

Or, alternatively, as shown in FIGS. 14A and 14B, face cover members 213, 227, 229 may comprise rounded corners on outer corners, but squared-off internal corners as shown for intermediate cover members 229, 239, 227, 237. Thus, in an embodiment, the modular face cover members may have squared-off internal edges, and/or rounded corner edges, as shown in FIGS. 14A and 14B, to allow single-sized face cover members 213 to be used for multiple modular base unit systems 200, 200', 200", 300, 300', 300", 202, 202', 202", 302, 302', 302" (e.g., as shown in FIGS. 9A-9C). Such cover members would appear to have aesthetically coherently designed looking cover members for these respective hydronic systems. Further, it will be appreciated that such modularity is supported for similar radiator-type hydronic systems which are partially-recessed, fully-recessed, or non-recessed.

Thus, in an embodiment the face cover member is contiguous—meaning that even independent of color and ornamental surface design considerations, the face cover members of a system may comprise a single face cover member, or alternatively are designed to look at least like a contiguous face cover member, 215, 315, 219, 319. Accordingly, users are enabled in choosing from single face cover members 215, 315, 219, 319 that cover two or more base members, or a plurality of face cover members as shown in FIGS. 14A and 14B.

Similarly, for face cover members 413, 415, 419, 515, 519 for hydronic systems 100, 200, 202, 300, 302, respectively, there are provided a plurality of internal tab members 417 (as shown in FIG. 4B) for both covering up the vents 170, 175 of modular base units 101, since in that manner air would be routed through vents 411 in the cover members, and for engaging the face cover members with the frames 108, 108' of the modular base units 101, 101', all for fully-recessed hydronic systems.

As shown at FIGS. 2A and 3A, there are provided exemplary tab members 262 for facilitating securing of the cover member 210 (and hence similarly cover members 220, 230, 240, 250, 310, 320, 330, 340, 350) to the wall around base unit members 101', 101".

Since, as shown in FIGS. 2C, 2F, 3C, 3F, and 4C-4E, there are provided unitary face cover members 213, 215, 315, 219, 319, 413, it is provided that the face cover members may be added with the assistance of an interior designer, if desired, after initial installation of the modular base unit members 101, 101', 101", 101" by an installer, such as by a plumber or other qualified hydronic system installer. Further, the face cover members, are therefore also further adapted to be readily recustomized to achieve an alternative aesthetically coherent design, for example if the design of the room were to change. Thus, as shown in FIGS. 13A-13C, there is provided a system 100" having initially a first cover member 210 having a face cover member **213*h* as per a first installation as shown in FIG. 13A. Then, perhaps after a number of years, and as shown in FIG. 13B, for example if the room were to be remodeled, or even if the owners of the room simply changed their minds, or the current owners changed their minds, the cover member 210 could be removed, leaving the modular base unit 101" intact, and thereafter as shown in FIG. 13C, for example with the help of an interior designer, a new cover member 210, having perhaps other colors of upper, lower, and side edge cover members 211, 216, and another color and/or pattern design of face cover member 213*i*** that is better suited for the changed room interior design or changed sentiments of owners of the house/room. This greatly lends to the ease of interior design, or change of such in terms of being re-customizable, since the designer is no longer dependent upon having to remove, replace, or reinstall the hydronic system in order to simply change the exterior design treatments of the system to the degree one would have had to do so before.

Referring specifically to FIG. 8A, there is shown the back side (i.e., with the sheetrock removed to allow viewing of the system) of a hydronic system 100, since it is a single system, having a modular base unit 101" (i.e., a wall-mounted embodiment of the modular base unit), attached to reside between vertical planes of the studs 830 (note that in the wall-mount embodiment the system 100 is preferably located between the studs 830, but it is not recessed. It will be appreciated throughout that where a wall-mounted system is contemplated, it is preferably located between vertical planes defined by the studs, but need not necessarily do so in accordance with the claims hereof, since alternative bracket/hanging members may be devised without departing from the broader aspects of the invention as claimed). The frame 108 for the modular base unit 101" comprises top-type piping 115, 120 (not shown in FIG. 8A). They system 100 further comprises a cover member 210 further comprising side edge cover members 216, top and bottom edge cover members 211, corner edge cover members 214, and a face cover member 213. Pipes 810, 820 are inlet and outlet pipes, respectively, for circulating hydronic fluid to the system 100, and the location of the pipes are such that they would not be visible to persons in the room, since at a lowermost location of the pipes where the pipes extend out of a sole plate 835 they would be hidden behind sheetrock (not shown), whereas the uppermost location of the pipes are hidden behind a lower extent of the cover member 210. Connectors 122 and 124 are used to interconnect the pipes 810, 820 with internal pipes 115, 120 of the modular base unit 101".

Referring specifically to FIG. 8B, there is shown the back side (i.e., with the sheetrock removed to allow viewing of the system) of a hydronic system 200 comprised of two horizontally-aligned, side-by-side, modular base units 101" (i.e., these are wall-mounted embodiments of the modular base units), attached to reside at multiple locations preferably between vertical planes of studs 830. The frame 108 for each modular base unit 101" comprises top-type piping 115, 120 (not shown in FIG. 8B). The system 200 further comprises a cover member 220 further comprising side edge cover members 216, top and bottom edge cover members 211, corner edge cover members 214, and a face cover member 215. Pipes 810, 825 are inlet and outlet pipes, respectively, for circulating hydronic fluid to the system 200, and the location of the pipes are such that they would not be visible to persons in the room, since at a lowermost location of the pipes where the pipes extend out of a sole plate 835 they would be hidden behind sheetrock (not shown), whereas the uppermost location of the pipes are hidden behind a lower extent of the cover member 220, as also are pipes 840 interconnecting the two modular base units 101". Connectors 122 and 124 are used to interconnect the pipes 810, 820 with internal pipes 115, 120 of the modular base units 101".

Referring specifically to FIG. 8C, there is shown the back side (i.e., with the sheetrock removed to allow viewing of the system) of a hydronic system 300 comprised of three horizontally-aligned, side-by-side, modular base units 101" (i.e., these are wall-mounted embodiments of the modular base units), attached to reside at multiple locations between vertical planes of studs 830. The frame 108 for each modular base unit 101" preferably comprises top-type piping 115, 120 (not shown in FIG. 8C). The system 300 further comprises a cover member 230 further comprising side edge cover members 216, top and bottom edge cover members 211, corner edge cover members 214, and a face cover member 315. Pipes 810, 850 are inlet and outlet pipes, respectively, for circulating hydronic fluid to the system 300, and the location of the pipes are such that they would not be visible to persons in the room, since at a lowermost location of the pipes where the pipes extend out of a sole plate 835 they would be hidden behind sheetrock (not shown), whereas the uppermost location of the pipes are hidden behind a lower extent of the cover member 230, as also are pipes 840 interconnecting the two modular base units 101". Connectors 122 and 124 are used to interconnect the pipes 810, 850 with internal pipes 115, 120 of the modular base units 101".

Referring specifically to FIG. 8D, there is shown the back side (i.e., with the sheetrock removed to allow viewing of the system) of a hydronic system 202 comprised of two vertically-aligned, modular base units 101" (i.e., these are wall-mounted embodiments of the modular base units), attached to reside at multiple locations between vertical planes of two studs 830. The frame 108 for the uppermost modular base unit 101" preferably comprises top-type piping 115, 120 (not shown in FIG. 8D), whereas the frame 108' for the lowermost modular base unit 101" comprises base-type, or intermediate-type, piping 117, 116, 120. The system 202 further comprises a cover member 240 further comprising side edge cover members 216, top and bottom edge cover members 211, corner edge cover members 214, and a face cover member 219. Pipes 810, 820 are inlet and outlet pipes, respectively, for circulating hydronic fluid to the system 202, and the location of the pipes are such that they would not be visible to persons in the room, since at a lowermost location of the pipes where the pipes extend out of a sole plate on the floor, they would be hidden behind sheetrock (not shown), whereas the uppermost location of the pipes are hidden behind a lower extent of the cover member 219. Connectors 122 and 124 are used to interconnect the pipes 810, 820 with internal pipes 117, 116, and 120 of the lower modular base unit 101", and internal pipes 115, 120 of the upper modular base unit.

Referring to FIG. 8E, there is shown the back side (i.e., with the sheetrock removed to allow viewing of the system) of a hydronic system 302 comprised of three vertically-aligned, modular base units 101" (i.e., these are wall-mounted embodiments of the modular base units), attached to reside at multiple locations between vertical planes of two studs 830. The frame 108 for the uppermost modular base unit 101" comprises top-type piping 115, 120 (not shown in FIG. 8E), whereas the frames 108' for the lowermost and intermediate modular base units 101" comprise base-type, or intermediate-type, piping 117, 116, 120 (not shown in FIG. 8E). The system 302 further comprises a cover member 250 further comprising side edge cover members 216, top and bottom edge cover members 211, corner edge cover members 214, and a face cover member 319. Pipes 810, 820 are inlet and outlet pipes, respectively, for circulating hydronic fluid to the system 302, and the location of the pipes are such that they would not be visible to persons in the room, since at a lowermost location of the pipes where the pipes extend out of a sole plate on the floor, they would be hidden behind sheetrock (not shown), whereas the uppermost location of the pipes are hidden behind a lower extent of the cover member 219. Connectors 122 and 124 are used to interconnect the pipes 810, 820 with internal pipes 117, 116, and 120 of the lower modular base unit 101", and internal pipes 115, 120 of the upper modular base unit.

Referring to FIG. 9A, there is shown a front left perspective view of a plurality of different non-recessed (i.e., wall-mounted) modular heating/cooling systems (from left to right: 302", 202", 100", 200", 300") in a room (comprising triple vertical unit, double vertical unit, single unit, double horizontal unit, and triple horizontal unit systems, respectively), illustrating how differently-designed modular cover members may be implemented as adapted for selection from a component supply adapted for use for readily customizable and recustomizable design coverings of such non-recessed systems. The cover members for the systems are labeled, 250, 240, 210, 220, 230, respectively, and each cover member preferably comprises the individual modular components described in connection with FIGS. 2A and 2B.

Referring to FIG. 9B, there is shown a front left perspective view of a plurality of different partially-recessed modular heating/cooling systems (from left to right: 302', 202', 100', 200', 300') in a room (comprising triple vertical unit, double vertical unit, single unit, double horizontal unit, and triple horizontal unit systems, respectively), illustrating how differently-designed modular cover members may be implemented as adapted for selection from a component supply adapted for use for readily customizable and recustomizable design coverings of such partially-recessed systems. The cover members for the systems are labeled, 350, 340, 310, 320, 330, respectively, and each cover member preferably comprises the individual modular components described in connection with FIGS. 3A and 3B.

Referring to FIG. 9C, there is shown a front left perspective view of a plurality of different fully-recessed modular heating/cooling systems (from left to right: 302, 202, 100, 200, 300) in a room (comprising triple vertical unit, double vertical unit, single unit, double horizontal unit, and triple horizontal unit systems, respectively), illustrating how differently-designed modular cover members may be implemented as adapted for selection from a component supply adapted for use for readily customizable and recustomizable design coverings of such fully-recessed systems. The face cover members for the systems (there are no edge cover members for a fully-recessed system) are labeled, 519, 419, 413, 415, 515, respectively, and each face cover member preferably comprises the individual modular components described in connection with FIGS. 4A and 4B.

Referring now to FIG. 5, there is shown an airflow diagram for a partial fan coil-type modular base unit, having a heat exchanger 160, upper and lower fans 145, 155 in upper and lower respective fan housings 140, 150, a drip pan 130, and inlet and outlet pipes 115, 120 and condensation pipe 125, such as for example would be the case for similar parts of modular base unit 101, 101', 101". Arrows 522, 524, 526, 528 each show a possible direction of airflow through the system perhaps preferred for a heating operation. However, it will be appreciated that the airflow direction may flow in reverse (for example perhaps as preferred for a cooling operation) without departing from the scope of the invention as claimed.

Referring to FIG. 6, there is shown a hydronic fluid flow diagram for a fan coil-type modular base unit, such as for example modular base unit 101, 101', 101", having a heat exchanger 160, upper and lower fan housings 140, 150, a drip pan 130, and inlet and outlet pipes 115, 120 and condensation pipe 125, such as for example would be the case for similar parts of modular base unit 101, 101', 101". Arrows 622, 624, 626 each show a possible direction of hydronic fluid flow through the system. However, it will be appreciated that the fluid flow direction may be in reverse without departing from the scope of the invention as claimed.

Referring now to FIGS. 7A-7F, there are shown various view of brackets 720 attached to studs 710 for hanging a modular base unit, whether a non-recessed modular base unit 101", a partially-recessed modular base unit 101', or fully-recessed modular base unit 101, and whether a fan coil-type modular base unit 101, 101', 101" or a radiator-type of modular base unit 101". Each bracket 720 preferably comprises left-most upper and lower hooks 735 and right-most upper and lower hooks 730. Further, each bracket 720 has upper and lower screw holes 725 allowing for mounting of the bracket to the stud with screws. In each of the FIGS. 7A-7C there is shown an outer wall 740.

To assist with installation of a modular bae unit 101, 101', 101", 101", it can be seen that slots 90 in tabs 105, 106 of frames 108, 108' are aligned with inner hooks (left-most upper and lower hooks 730, and right most upper and lower hooks 735 as shown in FIG. 7B, and allowed to slide down, as shown by the arrows of FIGS. 7D-7F, until the hooks 730, 735 engage upper portions of each of the slots 90 to hold the frames 108, 108' in place Referring now to FIG. 11, there is shown a representative wiring system 1100 for a triple modular base unit installation, wherein a thermostat 1105 sends signals to a first controller 1110 via input 1116, and that unit passes the signal on to a second controller 1120 via output 1118 to input 1126, and that second controller passes the signal on to a third controller 1130 via output 1128 to input 1136, allowing the modular base units 101, 101', 101" (where applicable) to all operate in unison. The outputs 1112, 1114, 1122, 1124, 1132, 1134 each provide a needed signal to the upper and lower fans 140, 150 of each of the respective modular base units 101, 101', 101".

Referring now to FIG. 12, there is shown a condensation drip manifold 1200, mountable via screw holes 1260, 1265 in flanges 1240, 1245, to allow preferably flexible condensation drip lines 125 (see e.g., FIG. 1A) from up to three different modular base units 101, 101', 101", to be received at inputs 1210, 1220, 1230 and combined into a single output condensation drip line 1250 for helping eliminating condensation from the system 100, 200, 300, 202, 302 to an exterior location.

Referring now to FIGS. 15A-15E, in accordance with another aspect of the disclosure, there is provided a method of installing a hydronic heating and cooling system adaptable to be modularly scalable to meeting heating and cooling needs of a given interior space, in accordance with one or more aspects of the disclosure, the method comprising:

A. Determining the Btu needs and type of heating and cooling system needed to supply the given interior space;

B. Determining a desired configuration of system, whether vertically or horizontally oriented, and whether fully recessed between studs, partially recessed (e.g., approximately ½ way) between the studs, or non-recessed;

C. Selecting an appropriate number of modular base units to supply needed heating and cooling for the given interior space, whether a single modular base unit or a plurality of modular base units, from a modular base unit component supply;

D. Determining an appropriate number of modular edge members, if any, and a single appropriate face cover member, whether for covering a single modular base unit or a plurality of modular base units, from modular edge members, modular corner edge members, and modular face cover members, component supplies;

E. Marking locations for installation on a wall of the space to be treated, being sure to align as level the installation holes in the case of a desired horizontally linear arrangement, and installation holes in the case of a desired horizontally-linear arrangement, and anticipating the possibility for a need for a plurality of side-by-side, or a plurality of vertically-stacked, modular base units residing between the studs;

F. Installing hanging brackets onto studs anticipating the possibility for a need for a plurality of side-by-side, or a plurality of vertically-stacked, modular base units residing between the studs;

G. Hanging the appropriate number of base units on the hanging brackets with the base unit frame members located between the studs (at least in the case of fully recessed and partially recessed models);

H. Hooking up pipes and control unit electronics into the selected number of base units;

I. Selecting desired edge cover members, if any, and face cover members from a plurality of edge cover member and face cover member component supplies;

J. Assembling edge cover members, if any, and attaching them to the wall or a base unit, and attaching a face cover member to form an aesthetic coherent (e.g., substantially singular appearing) face and edge hydronic system covering member;

K. Placing the cover member over the base unit(s) such that vent holes in the one or more base units align with vent holes in one of the modular edge cover members and the face cover member to ensure unimpeded airflow through the system; and L. Securing the cover member onto the base units.

Figure 15A:
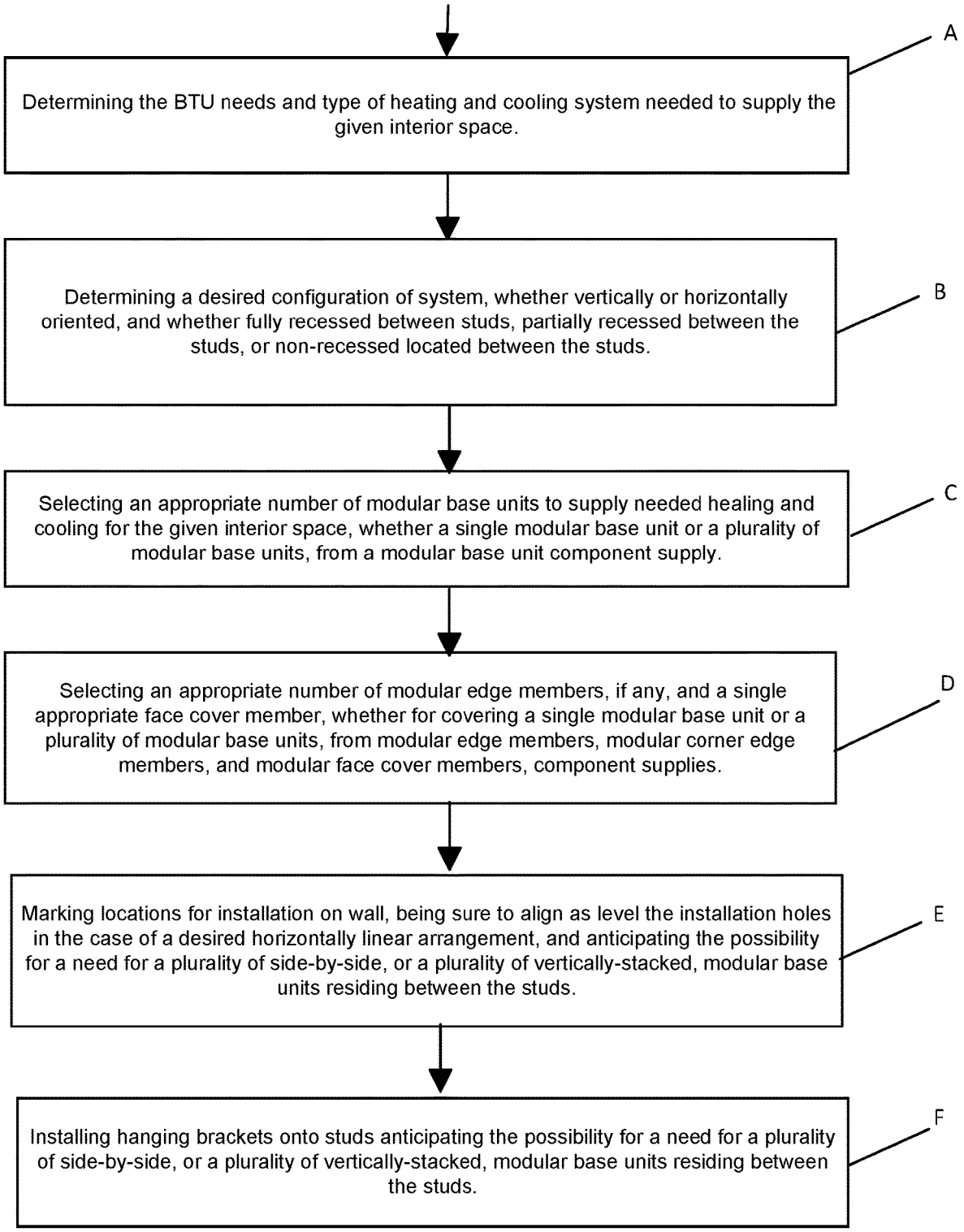
Figure 15B:
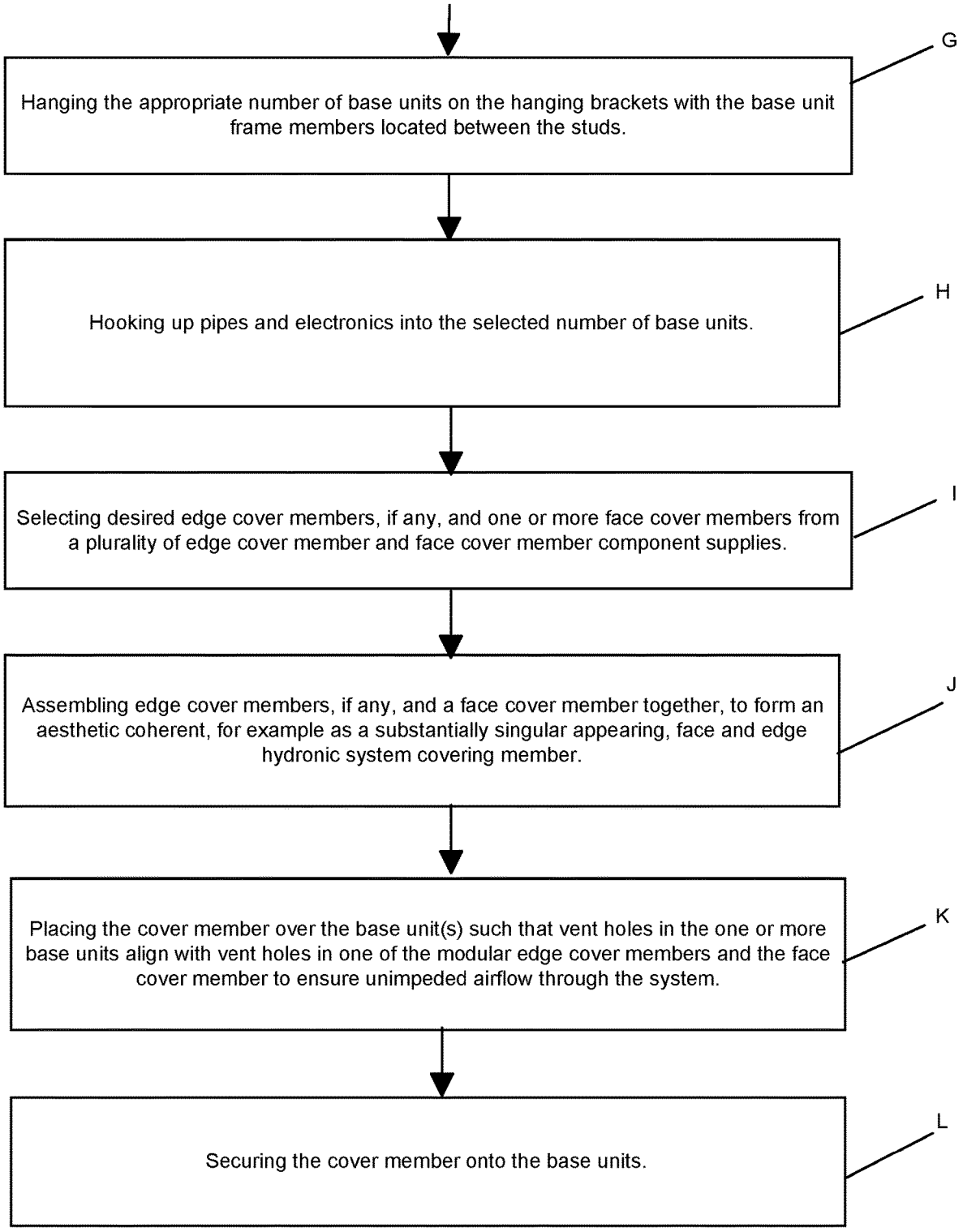
Figure 15C:
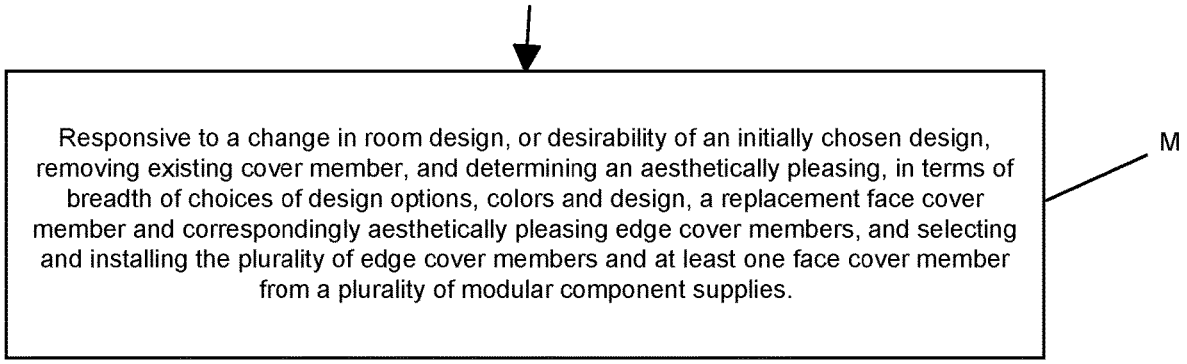

In accordance with another aspect of the disclosure, as shown in FIG. 15C, the method of installing the modular hydronic heating and cooling system further comprises the additional steps, M, after initial installation, of removing an existing cover member, and determining an aesthetically pleasing, in terms of color and design, face cover member and correspondingly aesthetically pleasing edge cover members, and selecting the same from a plurality of modular component supplies to account for changes in room design, system design, and or personal user preference. Thus, it may be seen that, in accordance with an aspect of the disclosure, this method of installing the modular hydronic system enables re-customization and thus enhances the numbers of options available to customers in customizing the appearance of their systems in light of other interior design considerations.

Figure 15D:
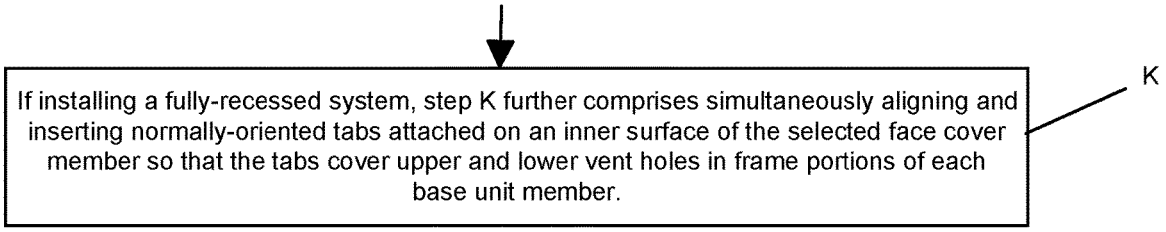

In accordance with yet another aspect of the disclosure, as shown in FIG. 15D, in the case of the method of installing a modular hydronic system that is to be fully-recessed between the studs, the step K. of placing the cover member over the one or more base units further comprises the step of simultaneously aligning and inserting normally-oriented tabs attached on an inner surface of the selected face cover member so that the tabs cover upper and lower vent holes in frame portions of the one or more base units thus effectively re-routing ventilation of the system to the pass through vent holes in the face cover member. This aspect of the disclosure allows usage of the same base unit for each wall-mount, partially-recessed (e.g., approximately ½ way recessed in the wall), and fully-recessed systems, the base units differing from one another only insofar as their respective mounting tabs are located at different locations (forward and aft) on their side frames. This aspect of the disclosure teaches to further facilitate customer choice in customizability of design and further helps the cause of modularity since a single type of base unit may be used, each type of base unit differing from the others only by the location of their mounting tabs on the base unit side frames.

Figure 15E:
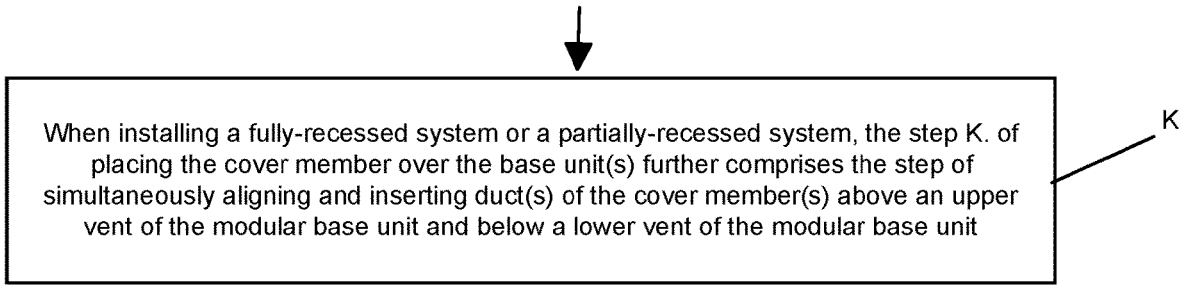

When installing a fully-recessed system or a partially-recessed system, as shown in FIG. 15E, the step K. of placing the cover member over the base unit(s) further comprises the step of simultaneously aligning and inserting duct(s) of the cover members above an upper vent of the modular base unit and below a lower vent of the modular base unit, to help hold the cover member in place relative to the modular base unit. This aspect of the disclosure also lends to modularity of the system since the same base unit may be used for each wall-mount, partially-recessed, and fully-recessed systems, the base units differing from one another only insofar as their respective mounting tabs are located at different locations (forward and aft) on their side frames. This aspect of the disclosure teaches to further facilitate customer choice in customizability of design and further helps the cause of modularity since a single type of base unit may be used, each type of base unit differing from the others only by the location of their mounting tabs on the base unit side frames.

Thus, it will be appreciated that the number of component supplies for the base units may comprise a plurality of different supplies of base units with tabs at the rear of the side frames, or the back of the frames, of the base units, at mid-way on the side frames, or at the front on the side frames, to allow for easy selection and supply (i.e., from a catalog for supplies) depending on a chosen design, whether non-recessed (wall mounted), partially-recessed, or fully-recessed).

Those skilled in the art will recognize the inventive principles disclosed are not limited to the embodiments disclosed herein, and that various aspects of the disclosed embodiments may be combined to achieve additional embodiments. Further, those skilled in the art with the aid of this disclosure will appreciate that the aesthetics of the trim (e.g., the edge cover members, the corner edge cover members, and the face cover member) are both enhanced, both in terms of appearance and ease of installation, by the overall modularity and customizability of the base units of the system and the trim members. Thus, it will be appreciated that, because of the modularity and readily customizable nature of the modular components of the disclosed hydronic systems herein, different color schemes for trim (whether edge members, corner edge members, or face cover members) are swappable from one system to the next, and regarding the edge and corner edge members regardless of the size of a partially-recessed, or non-recessed, system, to facilitate coordination by an interior design professional with chosen other décor of the given interior space. Because the system is modular, it may be scaled to enhance, or reduce, capacity, all without changing the dimensions of the base units, the edge and corner edge members, and optionally even the face cover members of the system.

In the preceding description, numerous details were set forth. It will be apparent, however, to one skilled in the art, that the present invention may be practiced without some of these specific details. Additionally, one of ordinary skill in the art will recognize the inventive principles disclosed are not limited to the embodiments disclosed herein, and that various aspects of the disclosed embodiments may be combined to achieve yet additional embodiments.

While a preferred embodiment of the present disclosure has been shown and described, it will be apparent to those skilled in the art that many changes and modifications may be made without departing from the claimed subject matter in its broader aspects. For example, it will be appreciated that one of ordinary skill in the art may mix and match the various components of the various embodiments of the claimed subject matter without departing from the true spirit of the claims. Thus, it will be appreciated that a portion, portions, or all of the modular customizable hydronic heating and cooling system may be comprised of, for example, radiator units, fan-coil-type units, combined heating and cooling units, exclusively heating units or cooling units, and whereas in a preferred embodiment any of these types of systems is capable of being customized and re-customized, the system is not limited to any one such type of system. The appended claims are therefore intended to cover many changes and modifications as may fall within the true spirit and scope of the invention.

What is claimed is:

1. A customizable, modular, hydronic system adapted for use in heating or cooling an interior area, the system comprising:

at least one modular base unit comprising at least one heat exchanger and a frame, wherein said at least one modular base unit is implemented in a horizontally-aligned plurality of modular base units or a vertically-aligned plurality of modular base units, and wherein each said at least one modular base unit further comprises an internal inlet pipe and an internal outlet pipe connected to the at least one internal heat exchanger within the frame, each said at least one modular base unit being adapted for retaining hydronic fluid in the at least one internal heat exchanger;

piping adapted for:

interconnecting the internal inlet pipe of the at least one modular base unit to the system, and interconnecting the internal outlet pipe of the at least one modular base unit to the system, wherein said piping is adapted for implementing the aligned plurality of modular base units as a singular appearing unitary unit, whether horizontally-aligned or vertically-aligned, and adaptable to be expandable to meet increased heating and cooling needs of the interior area; and a modular contiguous-and-singular-appearing unitary cover member comprising at least one modular face cover member portion per modular base unit, a periphery, and a plurality of edge cover member portions, wherein the plurality of edge cover member portions are adapted for forming said modular contiguous-and-singular-appearing unitary cover member for attaching to said at least one modular base unit at the periphery of said modular contiguous-and-singular-appearing unitary cover member, and further adapted to form said modular contiguous-and-singular-appearing unitary cover member together with the at least one modular face cover member portion of said modular contiguous-and-singular-appearing unitary cover member, said modular contiguous-and-singular-appearing unitary cover member adapted to be readily detachably secured to the system, and at least partially visibly presented to occupants of the interior area.

2. The system of claim 1, wherein said modular contiguous-and-singular-appearing unitary cover member further comprises at least one vent in an anterior surface thereof, and wherein said at least one modular base unit further comprises at least one fan adapted for blowing air across the at least one internal heat exchanger of said at least one modular base unit to carry heated, or alternatively cooled, air from the at least one internal heat exchanger through the at least one vent and into the interior area.

3. The system of claim 1, wherein the plurality of edge cover member portions further comprises a plurality of peripheral corner edge portions, wherein the plurality of peripheral edge portions are adapted for attaching to a periphery of the at least one modular face cover member portion to form different color or surface pattern choices and forming said modular contiguous-and-singular-appearing unitary cover member.

4. The system of claim 1, wherein the number of said at least one modular base units in the aligned plurality of modular base units, and the number of the at least one modular face cover member portions in said modular contiguous-and-singular-appearing unitary cover member are equal.

5. The system of claim 1, wherein the plurality of peripheral edge cover member portions together comprise peripheral side edge portions, peripheral top and bottom edge portions, and peripheral corner edge portions, and wherein the plurality of peripheral edge cover member portions are adapted to be combined together with the at least one modular face cover member portion to form said modular contiguous-and-singular-appearing unitary cover member to enable expansion of the system from a supply of said at least one modular base units and said modular contiguous-and-singular-appearing unitary cover member provided in view of initial and changing interior-design-type considerations.

6. The system of claim 1, wherein said at least one modular base unit, the at least one modular face cover member portion, and the plurality of peripheral edge cover member portions are capable of being used for an installation that is any of:

completely recessed between wall studs of the interior area, partially recessed between the wall studs of the interior area, and not recessed between the wall studs of the interior area, to readily meet initial and changed capacity-type considerations and initial and changed interior-design-type considerations from the same stock of modular base units and modular contiguous-and-singular-appearing unitary cover members.

7. The system of claim 1, wherein said at least one modular base unit comprises a plurality of modular base units in an aligned plurality of modular base units, and wherein the aligned plurality of modular base units is adapted to be fully-recessed between wall studs of the interior area, wherein said cover member further comprises at least one vent on an anterior surface of said modular contiguous-and-singular-appearing unitary cover member and at least one tab normally-oriented relative to the anterior surface of said modular contiguous-and-singular-appearing unitary cover member on an inside surface of modular contiguous-and-singular-appearing unitary cover member, wherein the at least one tab is used for plugging at least one vent in the frame of each said at least one modular base unit to re-route air flow from the at least one vent in the frame to the at least one vent of said modular contiguous-and-singular-appearing unitary cover member.

8. The system of claim 1, wherein said at least one modular base unit is adapted for being recessed substantially midway into a wall of the interior area.

9. The system of claim 1, wherein said modular contiguous-and-singular-appearing unitary cover member has an aesthetic design that appears visually and aesthetically singular, unitary, and contiguous to occupants of the interior area.

10. The system of claim 2, wherein the at least one modular face-cover member portion of said modular contiguous-and-singular-appearing unitary cover member covers the piping to and from the system.

11. The system of claim 1, wherein said modular contiguous-and-singular-appearing unitary cover member covers piping to and from the system.

12. The system of claim 1, further comprising interconnecting piping adapted for interconnecting the internal outlet pipe of one said at least one modular base unit directly to the internal inlet pipe of another said at least one modular base unit, wherein the at least one modular base unit comprises an aligned plurality of modular base units that are linearly-aligned horizontally, and wherein said modular contiguous-and-singular-appearing unitary cover member bridges at least one wall stud of the interior area and covers piping to and from the system and said interconnecting piping between a plurality of modular base units of the aligned plurality of modular base units.

13. The system of claim 1, further comprising interconnecting piping adapted for interconnecting the internal outlet pipe of one said at least one modular base unit directly to the internal inlet pipe of another said at least one modular base unit, wherein the at least one modular base unit comprises an aligned plurality of modular base units linearly-aligned vertically, and wherein said modular contiguous-and-singular-appearing unitary cover member covers piping to and from the system and said interconnecting piping between the aligned plurality of modular base units.

14. The system of claim 1, wherein said at least one modular base unit and another of said at least one modular base unit comprise an aligned plurality of modular base units adapted to be partially-recessed between wall studs of the interior area, and wherein the modular contiguous-and-singular-appearing unitary cover member appears as a singular coherent design and is readily detachably secured to said at least one modular base unit and the another of said at least one modular base unit.

15. A customizable, modular, hydronic system adapted for use in heating or cooling an interior area, the system comprising:

at least one modular base unit comprising at least one heat exchanger and a frame, said at least one modular base unit adapted for use aligned with one or more other such modular base units as part of the system comprising a first and a last at least one modular base unit, wherein each said at least one modular base unit further comprises an internal inlet pipe and an internal outlet pipe connected to the at least one internal heat exchanger within the frame, each said at least one modular base unit being adapted for retaining hydronic fluid in the at least one internal heat exchanger; wherein the at least one modular base unit is adapted to be implemented in an installation of an aligned plurality of such at least one modular base units that is any of:

completely recessed between wall studs of the interior area, partially recessed between the wall studs of the interior area, and not recessed between the wall studs of the interior area, piping adapted for:

interconnecting the internal inlet pipe of the at least one modular base unit to the system, and interconnecting the internal outlet pipe of the at least one modular base unit to the system, adaptable to be expandable to meet increased heating and cooling needs of the interior area; and a modular contiguous-and-singular-appearing unitary cover member comprising at least one modular face cover member portion per modular base unit and a periphery, wherein said modular contiguous-and-singular-appearing unitary cover member covers the aligned plurality of modular base units and said piping, and wherein said modular contiguous-and-singular-appearing unitary cover member is adapted to be readily detachably secured to the system and at least partially visibly presented to occupants of the interior area.

16. A customizable, modular, hydronic system adapted for installation and use at least partially within an interior area to be heated or cooled, and adapted for use with other connected hydronic components, the system comprising:

first and second modular base units, each said first and second modular base unit comprising at least one internal heat exchanger comprising an internal inlet pipe and an internal outlet pipe within a modular base unit frame adapted for being one of completely recessed in a wall of the interior area between studs, partially recessed in the wall of the interior area between the studs, and not recessed in the wall of the interior area, said first and second modular base units being adapted for retaining heated, or alternatively cooled, hydronic fluid in each at least one internal heat exchanger, wherein the internal outlet pipe of the at least one heat exchanger of said first modular base unit is designed to be interconnected with the internal inlet pipe of the at least one internal heat exchanger of said second modular base unit by interconnecting piping, wherein said first and second modular base units comprise an aligned plurality of modular base units, the system thus being readily adaptable for expansion from like supplies to meet increased heating and cooling needs of any of a number of different interior areas by successive repeated implementation of said first and second modular base units; and first and second modular face cover members adapted to be readily detachably secured to each respective said first and second modular base units, wherein each of said first and second modular face cover members comprises a peripheral edge, wherein said first modular face cover member is designed to be adapted for use with said second modular face cover member, singularly, and in combination with each other, to form a modular contiguous-and-singular-appearing unitary cover member readily detachably secured to said first and second modular base units, the modular contiguous-and-singular-appearing unitary cover member appearing as a singular coherent design, the modular contiguous-and-singular-appearing unitary cover member being at least partially visibly presented to occupants of the interior area and adapted to be readily customized from like supplies, and wherein the modular contiguous-and-singular-appearing unitary cover member is also adapted to be readily re-customized from like supplies to achieve an alternative aesthetic design that appears visually and aesthetically singular, unitary, and contiguous.

* * * * *